US011572227B2

(12) United States Patent
Pranadi et al.

(10) Patent No.: US 11,572,227 B2
(45) **Date of Patent: *Feb. 7, 2023**

(54) THERMALLY INSULATED SHIPPING SYSTEM FOR PALLET-SIZED PAYLOAD, METHODS OF MAKING AND USING THE SAME, AND KIT FOR USE THEREIN

(71) Applicant: Cold Chain Technologies, LLC, Franklin, MA (US)

(72) Inventors: Fery Pranadi, Pleasanton, CA (US); Shreyas S. Panse, Boston, MA (US); TzeHo Lee, Needham, MA (US); Mark Fontes, North Scituate, RI (US); Gregory Cook, Holliston, MA (US); Richard Orsini, Roxbury, MA (US); Richard M. Formato, Grafton, MA (US); Karen L. Snyder, Natick, MA (US); Douglas Johnson, Mansfield, MA (US); Timothy D. Stovall, Montgomery, TX (US)

(73) Assignee: COLD CHAIN TECHNOLOGIES, LLC, Franklin, MA (US)

( * ) Notice: Subject to any disclaimer, the term of this patent is extended or adjusted under 35 U.S.C. 154(b) by 23 days.

This patent is subject to a terminal disclaimer.

(21) Appl. No.: 16/687,210

(22) Filed: Nov. 18, 2019

(65) Prior Publication Data

US 2020/0307896 A1 Oct. 1, 2020

Related U.S. Application Data

(63) Continuation of application No. 15/287,701, filed on Oct. 6, 2016, now Pat. No. 10,661,969.

(Continued)

(51) Int. Cl.

| | |
|---|---|
| ***B65D 81/38*** | (2006.01) |
| ***B65D 19/06*** | (2006.01) |

(52) U.S. Cl.

CPC ..... *B65D 81/3823* (2013.01); *B65D 19/06* (2013.01); *B65D 2519/00019* (2013.01);

(Continued)

(58) Field of Classification Search

CPC .... B65D 81/3823; B65D 19/06; B65D 19/38; B65D 57/00; B65D 81/05; B65D 88/74;

(Continued)

(56) References Cited

U.S. PATENT DOCUMENTS

| | | | |
|---|---|---|---|
| 1,865,688 | A | 7/1932 | Hannaford |
| 2,317,005 | A | 4/1943 | Wasserman |

(Continued)

FOREIGN PATENT DOCUMENTS

| | | | |
|---|---|---|---|
| AU | 4085772 | A | 10/1973 |
| CA | 1298564 | C | 4/1992 |

(Continued)

OTHER PUBLICATIONS

"Efficient. Reliable. Refrigerated," Cold Storage 2 Go, coldstorage2go.com http://www.coldstorage2go.com/refrigerated.php, accessed May 1, 2015.

(Continued)

*Primary Examiner* — Rafael A Ortiz

(74) *Attorney, Agent, or Firm* — Kriegsman & Kriegsman

(57) ABSTRACT

Thermally insulated shipping system for use in transporting a pallet-sized payload. In one embodiment, the system includes a plurality of thermally insulating walls arranged to define an interior volume suitable for receiving a pallet-sized payload. The thermally insulating walls include a top wall, a bottom wall, a front wall, a rear wall, a left wall, and a right wall, of which all but the bottom wall include at least two slots facing towards the interior volume. One of the slots is an inner slot that is more proximal to the interior volume, and one of the slots is an outer slot that is more distal to the (Continued)

interior volume. The system also includes a plurality of inner cassettes disposed in at least some of the inner slots and a plurality of outer cassettes disposed in at least some of the outer slots. The inner and outer cassettes include phase-change materials.

31 Claims, 45 Drawing Sheets

Related U.S. Application Data

(60) Provisional application No. 62/399,912, filed on Sep. 26, 2016, provisional application No. 62/237,766, filed on Oct. 6, 2015.

(52) U.S. Cl.
CPC ..... *B65D 2519/00034* (2013.01); *B65D 2519/00044* (2013.01); *B65D 2519/00069* (2013.01); *B65D 2519/0086* (2013.01); *B65D 2519/00159* (2013.01); *B65D 2519/00174* (2013.01); *B65D 2519/00184* (2013.01); *B65D 2519/00194* (2013.01); *B65D 2519/00208* (2013.01); *B65D 2519/00218* (2013.01); *B65D 2519/00268* (2013.01); *B65D 2519/00273* (2013.01); *B65D 2519/00288* (2013.01); *B65D 2519/00293* (2013.01); *B65D 2519/00318* (2013.01); *B65D 2519/00338* (2013.01); *B65D 2519/00502* (2013.01); *B65D 2519/00587* (2013.01); *B65D 2519/00592* (2013.01); *B65D 2519/00641* (2013.01); *B65D 2519/00711* (2013.01)

(58) Field of Classification Search
CPC ..... B65D 2519/00338; B65D 2519/00641; B65D 2519/0086
USPC ..... 206/386, 223, 600, 596; 220/560.12, 220/560.13, 560.14, 560.15, 220/592.01–592.78, 739; 211/162; 62/457.2
See application file for complete search history.

(56) References Cited

U.S. PATENT DOCUMENTS 2,915,235 A 12/1959 Rueckert
3,205,033 A 9/1965 Stentz
3,651,974 A 3/1972 Barry et al.
4,090,659 A 5/1978 Galmiche et al.
4,294,079 A 10/1981 Benson
4,377,075 A 3/1983 Russo
4,741,167 A 5/1988 Wigley
4,845,959 A 7/1989 Magee
4,887,731 A 12/1989 Pett et al.
4,947,658 A 8/1990 Wheeler et al.
5,435,142 A 7/1995 Silber
5,507,405 A 4/1996 Thomas et al.
5,669,233 A * 9/1997 Cook ..... B65D 81/3823 62/457.2
5,881,908 A 3/1999 Hays et al.
5,899,088 A 5/1999 Purdum
5,924,302 A * 7/1999 Derifield ..... B65D 81/3862 62/457.2
5,950,450 A 9/1999 Meyer et al.
5,953,928 A 9/1999 Saia, III et al.
5,987,910 A 11/1999 Kothe et al.
6,016,664 A 1/2000 Larsson et al.
6,116,042 A 9/2000 Purdum
6,325,281 B1 12/2001 Grogan
6,482,332 B1 11/2002 Malach
6,558,608 B2 5/2003 Haraldsson et al.
6,584,797 B1 7/2003 Smith
6,645,598 B2 11/2003 Alderman
6,666,032 B1 12/2003 Rickson et al.
6,718,776 B2 4/2004 Wessling et al.
6,832,562 B2 * 12/2004 Tabor ..... B65D 19/0028 108/55.1
6,868,982 B2 3/2005 Gordon
6,875,486 B2 4/2005 Miller
7,028,504 B2 4/2006 Derifield
7,225,632 B2 6/2007 Derifield
7,240,513 B1 7/2007 Conforti
7,257,963 B2 8/2007 Mayer
7,294,374 B2 11/2007 Romero
7,310,967 B2 12/2007 Aragon
7,328,583 B2 2/2008 Hillman et al.
7,631,799 B2 12/2009 Turvey et al.
7,641,812 B2 1/2010 Alderman
7,704,584 B2 4/2010 Alderman
7,721,566 B1 5/2010 Wilken
7,849,708 B2 12/2010 Goncharko et al.
7,913,511 B2 3/2011 Meyer et al.
8,156,703 B2 4/2012 Alderman
8,250,882 B2 8/2012 Mustafa et al.
8,424,335 B2 4/2013 Corder et al.
8,505,314 B1 8/2013 Romero
8,607,581 B2 12/2013 Williams et al.
8,672,137 B2 3/2014 Seagle et al.
8,763,423 B2 7/2014 Tattam
8,763,886 B2 7/2014 Hall
8,887,515 B2 11/2014 Patstone
8,904,810 B2 12/2014 Schabron et al.
8,938,986 B2 1/2015 Matta et al.
9,045,278 B2 6/2015 Mustafa et al.
9,151,531 B2 10/2015 Wengreen et al.
9,180,998 B2 11/2015 Banks et al.
9,366,469 B2 6/2016 Chapman, Jr.
9,376,605 B2 6/2016 Matta et al.
9,429,350 B2 8/2016 Chapman, Jr.
9,513,067 B2 12/2016 Ahmed
9,556,373 B2 1/2017 Formato et al.
9,598,622 B2 3/2017 Formato et al.
9,707,156 B2 7/2017 Wengreen et al.
9,719,688 B2 8/2017 Holloway et al.
9,814,651 B2 11/2017 Wengreen et al.
9,834,365 B2 12/2017 Pointer et al.
9,877,894 B2 1/2018 Wengreen et al.
9,913,777 B2 3/2018 Wengreen et al.
9,944,449 B2 4/2018 Wood et al.
9,956,140 B2 5/2018 Wengreen et al.
9,957,099 B2 5/2018 White et al.
9,963,287 B2 5/2018 Vogel et al.
10,077,389 B2 9/2018 Formato et al.
10,288,337 B2 5/2019 Blezard et al.
10,501,254 B2 12/2019 Wood et al.
10,562,694 B2 2/2020 Austerberry et al.
10,583,978 B2 3/2020 Longley et al.
10,604,326 B2 3/2020 Longley et al.
10,766,685 B2 9/2020 Kuhn et al.
10,829,675 B2 11/2020 Formato et al.
10,981,714 B2 4/2021 Austerberry et al.
11,137,190 B2 10/2021 Martino
2002/0147242 A1 10/2002 Salyer et al.
2007/0051734 A1 * 3/2007 Kuhn ..... F25D 23/063 220/592.27
2007/0186577 A1 8/2007 Goncharko
2007/0210090 A1 9/2007 Sixt et al.
2008/0276643 A1 11/2008 Heroux et al.
2009/0078708 A1 3/2009 Williams
2010/0301057 A1 12/2010 Tattam et al.
2010/0314397 A1 * 12/2010 Williams ..... B65D 81/3823 220/592.01
2011/0049164 A1 * 3/2011 Banks ..... F25D 3/08 220/592.01
2011/0248038 A1 10/2011 Mayer
2011/0290792 A1 12/2011 Krzak et al.
2012/0279896 A1 * 11/2012 Lantz ..... B65D 25/16 53/473
2013/0015191 A1 1/2013 Seagle et al.

(56) References Cited

U.S. PATENT DOCUMENTS

| | | | | |
|---|---|---|---|---|
| 2013/0228583 | A1 | 9/2013 | Mayer | |
| 2013/0255306 | A1* | 10/2013 | Mayer | F25D 3/08 62/457.2 |
| 2014/0087105 | A1 | 3/2014 | Formato et al. | |
| 2014/0174692 | A1 | 6/2014 | Emond et al. | |
| 2014/0290285 | A1 | 10/2014 | Formato et al. | |
| 2014/0311170 | A1 | 10/2014 | Mills et al. | |
| 2014/0343493 | A1 | 11/2014 | Wengreen | |
| 2015/0166244 | A1 | 6/2015 | Wood et al. | |
| 2015/0239639 | A1 | 8/2015 | Wenner et al. | |
| 2015/0276297 | A1 | 10/2015 | Moore et al. | |
| 2015/0285548 | A1 | 10/2015 | Emond et al. | |
| 2016/0262979 | A1 | 9/2016 | Wengreen et al. | |
| 2016/0362240 | A1 | 12/2016 | Ferracamo, Jr. | |
| 2017/0082344 | A1 | 3/2017 | Tansley | |
| 2017/0240337 | A1 | 8/2017 | Austerberry et al. | |
| 2017/0247169 | A1* | 8/2017 | Losco | B65D 88/744 |
| 2018/0036202 | A1 | 2/2018 | Wengreen et al. | |
| 2018/0093816 | A1 | 4/2018 | Longley et al. | |
| 2018/0100682 | A1 | 4/2018 | Nilsen et al. | |
| 2018/0202700 | A1 | 7/2018 | Anstead et al. | |
| 2018/0328644 | A1 | 11/2018 | Rizzo et al. | |
| 2019/0210790 | A1 | 7/2019 | Rizzo et al. | |
| 2020/0002075 | A1 | 1/2020 | Lee et al. | |
| 2020/0047993 | A1 | 2/2020 | Brabbs et al. | |
| 2020/0231362 | A1 | 7/2020 | Kulangara et al. | |
| 2020/0324959 | A1 | 10/2020 | Longley et al. | |
| 2020/0331686 | A1 | 10/2020 | Longley et al. | |
| 2021/0024270 | A1 | 1/2021 | Mirzaee Kakhki | |
| 2021/0070539 | A1 | 3/2021 | Chasteen et al. | |
| 2021/0292630 | A1 | 9/2021 | Formato et al. | |
| 2021/0300665 | A1 | 9/2021 | Melchor | |
| 2021/0331834 | A1 | 10/2021 | Longley et al. | |
| 2022/0002070 | A1 | 1/2022 | Moghaddas et al. | |
| 2022/0265514 | A1 | 8/2022 | Blezard et al. | |
| 2022/0267081 | A1 | 8/2022 | Conway et al. | |
| 2022/0267657 | A1 | 8/2022 | Blezard et al. | |

FOREIGN PATENT DOCUMENTS

| | | | |
|---|---|---|---|
| EP | 1006058 | A1 | 6/2000 |
| EP | 1110043 | B1 | 11/2004 |
| EP | 2412640 | A1 | 2/2012 |
| EP | 2883811 | A1 | 6/2015 |
| FR | 993538 | A | 11/1951 |
| FR | 2989359 | A1 | 10/2013 |
| FR | 2994420 | A1 | 2/2014 |
| FR | 3001721 | A1 | 8/2014 |
| GB | 1061791 | A | 3/1967 |
| GB | 2383122 | A | 6/2003 |
| GB | 2459392 | A | 10/2009 |
| GB | 2500657 | A | 10/2013 |
| WO | 9843028 | A1 | 10/1998 |
| WO | 0040908 | A1 | 7/2000 |
| WO | 03073030 | A1 | 9/2003 |
| WO | 2014023911 | A1 | 2/2014 |
| WO | 2014083320 | A1 | 6/2014 |
| WO | 2014103344 | A1 | 7/2014 |
| WO | 2014125878 | A1 | 8/2014 |
| WO | 2015044668 | A1 | 4/2015 |
| WO | 2017060695 | A1 | 4/2017 |
| WO | 2017220953 | A1 | 12/2017 |
| WO | 2017220954 | A1 | 12/2017 |

OTHER PUBLICATIONS

"Sofrigam—Thermal Insulated and Cooling Packaging for Cold-Chain Storage and Distribution," Pharmaceutical-technology, pharmaceutical-technology.com http://www.pharmaceutical-technology.com/contractors/materials-handling/sofrigam/sofrigam4.html, accessed May 1, 2015.

"Refrigerated Shipping Containers," Onsite Store Solutions, onsitestorage.com http://onsitestorage.com/refrigerated-containers/, accessed May 1, 2015.

"Pallet Covers, Thermal Shipping Blankets & Liners," Innovative Energy, Inc., insultote.net http://www.insultote.net/insulatedblankets-palletcovers.php, accessed May 1, 2015.

"Tektainer Large Containers," PED—The Insulated Container Company, insulatedcontainers.co.uk http://www.insulatedcontainers.co.uk/?products=tektainer-large-containers, accessed May 1, 2015.

"20ft Shipping Containers—With Optional Full Side Access Now Available," Dainton Portable Buildings, dainton.com http://www.dainton.com/20ft-shipping-containers.html, accessed May 1, 2015.

"Insulation | interior finishing," CTI—Container Technology Inc., containertech.com http://www.containertech.com/container-modifications/insulation-interior-finishing/, accessed May 1, 2015.

"BulkPak PIR Series," Cryopak—a TCP Company, cryopak.com http://www.cryopak.com/en/cold-chain-packaging/insulated-pallet-shippers1/bulkpakpir-series/bulkpak-pir-series/, accessed May 1, 2015.

"Model #GPS-RPS," Sonoco ThemoSafe®, thermosafe.com https://www.thermosafe.com/model/GPS-RPS?Pr10=Healthcare&Pr11=Pallet+Solutions, accessed May 1, 2015.

"Tricon Refrigerated Cargo Container Type 1," Seabox®, seabox.cm http://www.seabox.com/catalog/flyers/sb531.0.dnd.type1.pdf, accessed May 1, 2015.

"40 Foot Insulated Containers With Cargo Doors," Aztec Container, azteccontainer.com http://www.azteccontainer.com/insulated-containers.html, accessed May 1, 2015.

"Thermo Chill™ Transport/Storage Chests," Polar Tech Industries, Inc., coldchain.polar-tech.com http://coldchain.polar-tech.com/viewitems/all-categories-food-insulated-containers/thermo-chill-153-transport-storage-chests, accessed May 1, 2015.

"Product Overview: Pallet shippers," Inmark—Temperature Controlled, inmarktcp.com, http://www.inmarktcp.com/products/palletshippers, accessed May 1, 2015.

"150 QT. Heritage™ XP H20™ Cooler," Coleman, coleman.com, Model No. 3000002236. http://www.coleman.com/product/150-qt-heritagetrade-xp-h20trade-cooler/3000002236#.VUOsS2RVhBc, accessed May 1, 2015.

Advertisement for family of TimeSaver shipping containers, Pharmaceutical & Medical Packaging News, 14(4): 7 (Apr. 2006).

ThermoSafe Catalog, SCA Packaging North America, Arlington Heights, Illinois (2004).

Exam Packaging Catalog, Exam Packaging SPRL/BVBA, Strombeek-Bever, Belgium (Jan. 2016).

Search Report and Written Opinion dated Dec. 20, 2016 in PCT Application No. PCT/US2016/055862, the corresponding PCT application to the present application.

Sales literature for KoolTemp Concept Designed Universal Solution: KoolTemp-1070L4D-RFG-GSK, Topa Thermal Packaging, Voorhout, The Netherlands (2015).

Sales literature for KoolTemp insulated pallet container—ZX4500, Cold Chain Technologies, Inc., Franklin, Massachusetts (2009).

Press Release entitled "Pelican BioThermal Launches Innovative Credo Cargo Pallet Shipper System," http://pelicanbiothermal.com/news/pelican-biothermal-launches-innovative-credo-cargo-pallet-shipper-system (Jan. 27, 2016).

Sales literature for Pelican BioThermal Credo Cargo, Pelican BioThermal, Plymouth, MN (2018).

European Search Report dated Apr. 3, 2019, in European Patent Application No. EP 16 85 4372, said application being the European counterpart to the present application.

Sales literature for World Courier Cocoon, AmerisourceBergen Corporation, Chesterbrook, PA (2019).

U.S. Appl. No. 16/246,435, inventors James Robert Chasteen et al., filed Jan. 11, 2019.

U.S. Appl. No. 17/585,139, inventors James Nilsen et al., filed Jan. 26, 2022.

U.S. Appl. No. 17/842,544, inventors Anthony Rizzo et al., filed Jun. 16, 2022.

U.S. Appl. No. 17/700,149, inventors TzeHo Lee et al., filed Mar. 21, 2022.

U.S. Appl. No. 16/827,086, inventors Dawn E. Smith et al., filed Mar. 23, 2020.

(56) References Cited

OTHER PUBLICATIONS

U.S. Appl. No. 17/687,382, inventors James R. Chasteen et al., filed Mar. 4, 2022.
U.S. Appl. No. 17/726,318, inventors Henry Melchor et al., filed Apr. 21, 2022.
U.S. Appl. No. 17/891,631, inventors Heather M. Conway et al., filed Aug. 19, 2022.
U.S. Appl. No. 17/668,569, inventors William C. Blezard et al., filed Feb. 10, 2022.
U.S. Appl. No. 17/668,610 inventors William C. Blezard et al., filed Feb. 10, 2022.
U.S. Appl. No. 17/508,418 inventors William C. Blezard et al., filed Oct. 22, 2021.

* cited by examiner

THERMALLY INSULATED SHIPPING SYSTEM FOR PALLET-SIZED PAYLOAD, METHODS OF MAKING AND USING THE SAME, AND KIT FOR USE THEREIN

CROSS-REFERENCE TO RELATED APPLICATIONS

The present application is a continuation of U.S. patent application Ser. No. 15/287,701, inventors Fery Pranadi et al., filed Oct. 6, 2016, which, in turn, claims the benefit under 35 U.S.C. 119(e) of U.S. Provisional Patent Application No. 62/237,766, filed Oct. 6, 2015, and U.S. Provisional Patent Application No. 62/399,912 filed Sep. 26, 2016, the disclosures of all of which are incorporated herein by reference.

BACKGROUND OF THE INVENTION

The present invention relates generally to thermally insulated shipping systems and relates more particularly to thermally insulated shipping systems of the type that may be used to transport pallet-sized payloads.

Thermally insulated shipping systems of the type that may be used to transport pallet-sized payloads of temperature-sensitive materials, such as biological and/or pharmaceutical products, are well-known. Illustrative examples of thermally insulated shipping systems that may be used to transport pallet-sized payloads are discussed below.

In U.S. Patent Application Publication No. US 2011/0049164 A1, inventor Banks et al., which was published Mar. 3, 2011, and which is incorporated herein by reference, there is disclosed an insulated pallet shipper and methods of making and using the same. The insulated pallet shipper of the foregoing published patent application is said to include an insulated container that includes a top wall, a bottom wall, a left side wall, a right side wall, a rear wall, and a front wall, the aforementioned walls collectively defining a cavity. A plurality of coolant members are positioned within the cavity, some of the coolant members being laid horizontally on top of the bottom wall, some of the coolant members being mounted vertically along the inside surfaces of the left side and right side walls, and some of the coolant members being laid horizontally on top of a tray that is positioned below the top wall. Each of the coolant members includes a plurality of stacked, individually-wrapped coolant bricks encased within a single cardboard container. The single cardboard container comprises a closed-ended sleeve, and each of the stacked, individually-wrapped coolant bricks comprises a foam refrigerant block encased in a flexible metal foil. At least some of the coolant members are pre-conditioned at a refrigerating temperature and at least some of the coolant members are pre-conditioned at a freezing temperature.

In U.S. Pat. No. 8,763,423 B2, inventor Tattam, which issued Jul. 1, 2014, and which is incorporated herein by reference, there is disclosed a temperature control system for a transport container having a base and at least one side wall and a cover, the temperature control system comprising a foldable sleeve having first and second major planes, which in an unfolded state retain a thermal pack which is attached to a side of the container operable to retain temperature control (thermal packs) within, the sleeve conveniently having a spacer means to maintain a temperature within a closed container by virtue of heat transfer with the thermal pack, yet prevents contact with product.

In U.S. Pat. No. 7,028,504 B2, inventor Denfield, which issued Apr. 18, 2006, and which is incorporated herein by reference, there are disclosed several embodiments of containers constructed of, for example, rigid polyurethane foam. The containers are particularly useful for, among other purposes, small and large shipments, such as via air freight, including via LD3 shipping containers. Such containers are basically formed of a bottom, preferably with a tray, for holding product, four sides, and a lid, and preferably with a coolant tray. Furthermore, the bottom, sides and lid are designed to interlock (the sides and base preferably are slide-locked or are tongue and grooved, as opposed to typical 45 degree corners that do not lock together or "grip" together), so as to reduce thermal convection. Also, preferably, a rigid polyurethane foam is molded to form a bottom for the container and can have "pallet" grooves as distinguished from using wood which can invite termite problems, particularly in an air freight environment. The coolant tray preferably is a slide-in tray which contains a suitable coolant, such as dry ice or gel packs, and which also is preferably made of rigid polyurethane foam to maintain the coolant out of direct contact with the product. In addition, the interior walls and bottom of the container can be configured to provide a convection design to create a controlled air flow within the product compartment, and this air flow can reduce the temperature gradient within the product compartment and thus provide better and even temperature control when shipping biological and other products.

In U.S. Patent Application Publication No. US 2013/0015191 A1, inventors Seagle et al., which was published on Jan. 17, 2013, and which is incorporated herein by reference, there is disclosed a climate control container that is lightweight, strong, that forms an ultraviolet light, weather/dust particle barrier and that controls the climate inside the climate cargo container to protect the integrity of the cargo. In one embodiment, the climate control cargo container comprises (a) a load bearing structure having a first core and a first thermoplastic layer surrounding the first core; and (b) an enclosure having at least a second core and a second thermoplastic layer surrounding the second core. One or both of the load bearing structure and the enclosure have one or more pockets for locating one or more phase change materials capable of multiple cycles of phase transformation for climate control.

In PCT International Publication No. WO 2014/083320 A1, published Jun. 5, 2014, and which is incorporated herein by reference, there is disclosed a thermally insulated shipping container. The shipping container comprises an inner structure including an inner base, a front inner wall, a rear inner wall opposed to the front inner wall, a pair of opposed side inner walls each extending between the front and rear inner walls and an inner lid. The container also comprises an outer structure including an outer base, a front outer wall, a rear outer wall opposed to the front inner wall, two side outer walls each extending between the front and rear outer walls and an outer lid. A cavity extends at least between the inner and outer walls, the cavity being arranged to receive a plurality of cool packs. The container, when empty, is arranged to be transported disassembled in a flat packed state prior to being assembled for use. A portion of each of the two side outer walls is hinged at one end to a respective end of one of the front or rear outer walls.

In French Patent Application Publication No. FR 2 994 420 A1, which was published Feb. 14, 2014, and which is incorporated herein by reference, there is disclosed a protection cover for protecting products placed on a pallet during transport of products on vehicle. The cover has flexible rectangular sealed walls, e.g., four side walls, and a flexible wall forming a bottom, and a rectangular opening part provided in front of the bottom, where the opening part forms a parallelepiped space between the walls. One of the sealed walls is a polyurethane film or a PVC film. The opening part has a section slightly greater than that of a pallet. The side walls and the bottom have thickness ranging between 150 microns and 1 mm and are assembled along edges by thermal or ultrasounds or high frequency welding or by bonding. The publication is also directed at the following: (1) a thermal protection system for products placed on a pallet; and (2) a method for protecting products placed on a pallet during transport.

Other documents that may be of interest include the following, all of which are incorporated herein by reference: U.S. Pat. No. 8,672,137 B2, inventors Seagle et al., issued Mar. 18, 2014; U.S. Pat. No. 8,607,581 B2, inventors Williams et al., issued Dec. 17, 2013; U.S. Pat. No. 7,913,511 B2, inventors Meyer et al., issued Mar. 29, 2011; U.S. Pat. No. 7,721,566 B1, inventor Wilken, issued May 25, 2010; U.S. Pat. No. 7,328,583 B2, inventors Hillman et al., issued Feb. 12, 2008; U.S. Pat. No. 7,257,963 B2, inventor Mayer, issued Aug. 21, 2007; U.S. Pat. No. 6,832,562 B2, inventors Tabor et al., issued Dec. 21, 2004; U.S. Pat. No. 5,669,233, inventors Cook et al., issued Sep. 23, 1997; U.S. Patent Application Publication No. 2010/0301057 A1, inventors Tattam et al., published Dec. 2, 2010; U.S. Patent Application Publication No. US 2008/0276643 A1, inventors Heroux et al., published Nov. 13, 2008; U.S. Patent Application Publication No. US 2007/0051734 A1, inventor Kuhn, published Mar. 8, 2007; PCT International Publication No. WO 2014/023911 A1, published Feb. 13, 2014; and French Patent Application Publication No. FR 2 989 359 A1, published Oct. 18, 2013.

SUMMARY OF THE INVENTION

It is an object of the present invention to provide a novel shipping system that may be used to transport a pallet-sized payload.

Therefore, according to one aspect of the invention, there is provided a shipping system for use in transporting a pallet-sized payload, the shipping system comprising (a) a plurality of walls, the plurality of walls being arranged to define an interior volume suitable for receiving a pallet-sized payload, wherein at least one of the walls comprises at least two slots facing towards the interior volume, one of the slots being an inner slot that is more proximal to the interior volume and one of the slots being an outer slot that is more distal to the interior volume; and (b) a first cassette, the first cassette comprising a quantity of phase-change material and being removably mounted in one of the inner slot and the outer slot.

In a more detailed feature of the invention, the plurality of walls may comprise a top wall, a bottom wall, a front wall, a rear wall, a left wall and a right wall.

In a more detailed feature of the invention, the interior volume may have a generally rectangular prismatic shape.

In a more detailed feature of the invention, the interior volume may be dimensioned to receive a payload having dimensions of length×width×height selected from at least one of 48"×40"×45", 48"×42"×45", and 48"×42"×46".

In a more detailed feature of the invention, each of the top wall, the bottom wall, the front wall, the rear wall, the left wall, and the right wall may comprise thermal insulation.

In a more detailed feature of the invention, the thermal insulation may comprise a panel of rigid polyurethane foam.

In a more detailed feature of the invention, each of the top wall, the front wall, the rear wall, the left wall and the right wall may comprise a pair of brackets facing towards the interior volume, each of the brackets may comprise an inner track and an outer track, the inner tracks of the pair of brackets may jointly define the inner slot, and the outer tracks of the pair of brackets may jointly define the outer slot.

In a more detailed feature of the invention, the first cassette may be removably mounted in the inner slot, the shipping system may further comprise a second cassette, and the second cassette may comprise a quantity of phase-change material and may be removably mounted in the outer slot.

In a more detailed feature of the invention, the first cassette and the second cassette may have similar overall dimensions.

In a more detailed feature of the invention, the system may further comprise a skid, and the bottom wall, the front wall, the rear wall, the left wall and the right wall may be removably mounted in the skid.

In a more detailed feature of the invention, the system may further comprise at least one corner bracket pivotally mounted on the exterior of one of said walls and constructed to support the weight of said wall when said wall is pivoted outwardly.

In a more detailed feature of the invention, the first cassette may comprise a plurality of sleeves, and each of said sleeves may comprise phase-change material.

In a more detailed feature of the invention, the sleeves may not be identical to one another.

In a more detailed feature of the invention, the first cassette may comprise a container and a plurality of sleeves disposed within the container, the plurality of sleeves may comprise a pair of outer sleeves and at least one inner sleeve, and the at least one inner sleeve may be positioned between the pair of outer sleeves.

In a more detailed feature of the invention, the at least one inner sleeve may comprise three inner sleeves.

In a more detailed feature of the invention, the outer sleeves may be identical to one another, each may comprise a first container and phase-change material disposed within the first container, the inner sleeves may be identical to one another, and each may comprise a second container and phase-change material disposed within the second container.

In a more detailed feature of the invention, the types and/or quantities of phase-change materials in the outer sleeves and in the inner sleeves may be selected so that the outer sleeves provide greater thermal protection than the inner sleeves.

In a more detailed feature of the invention, the inner sleeves may comprise water or a water-based phase-change material, the outer sleeves may comprise water or a water-based phase-change material, the inner sleeves and the outer sleeves may comprise the same phase-change material, and the outer sleeves may comprise a greater quantity of the phase-change material than the inner sleeves.

In a more detailed feature of the invention, each of the inner sleeves and the outer sleeves may comprise at least one organic phase-change material, and the outer sleeves may comprise an organic phase-change material having a comparatively greater latent heat than the at least one organic phase-change material of the inner sleeves.

In a more detailed feature of the invention, each of the outer sleeves may comprise two gelled organic phase-change materials, one of the two gelled organic phase-change materials may be disposed at opposite ends of the outer sleeve and may have a comparatively greater latent heat, and the other gelled organic phase-change material may be disposed medially within the outer sleeve and may have a comparatively lesser latent heat.

In a more detailed feature of the invention, the outer sleeves may be identical to one another, each of the outer sleeves may comprise a container and a plurality of temperature-control members disposed within the container, each temperature-control member may comprise a foam block impregnated with water or a water-based phase-change material, and the foam block may be sealed between a pair of polymer films.

In a more detailed feature of the invention, the at least one inner sleeve may comprise three identical inner sleeves, each of the three identical inner sleeves may comprise a container and a temperature-control member disposed within the container, the temperature-control member may comprise a plurality of foam blocks each impregnated with water or a water-based phase-change material, the foam blocks may be disposed within a multi-compartmented receptacle, and the cumulative quantity of water or a water-based phase-change material in the outer sleeves may exceed that in the inner sleeves.

In a more detailed feature of the invention, the outer sleeves may be identical to one another, each of the outer sleeves may comprise a container, an insulating member may be disposed in the container, a plurality of temperature-control members may be disposed within the container, the plurality of temperature-control members may comprise a first temperature control member and a second temperature-control member, the first temperature-control member may comprise a first phase-change material, the second temperature-control member may comprise a second phase-change material, and the first phase-change material and the second phase-change material may be different from one another.

According to another aspect of the invention, there is provided a shipping system for use in transporting a pallet-sized payload, the shipping system comprising (a) a plurality of thermally insulating walls, the plurality of thermally insulating walls being arranged to define an interior volume suitable for receiving a pallet-sized payload, the plurality of thermally insulating walls comprising a top wall, a bottom wall, a front wall, a rear wall, a left wall, and a right wall, wherein at least two of the top wall, the front wall, the rear wall, the left wall, and the right wall comprise at least two slots facing towards the interior volume, one of the slots being an inner slot that is more proximal to the interior volume and one of the slots being an outer slot that is more distal to the interior volume; (b) a plurality of inner cassettes, the plurality of inner cassettes being disposed in at least some of the inner slots, each of the inner cassettes comprising at least a first phase-change material; and (c) a plurality of outer cassettes, the plurality of outer cassettes being disposed in at least some of the outer slots, each of the outer cassettes comprising at least a second phase-change material, the second phase-change material being different from the first phase-change material.

In a more detailed feature of the invention, each of the top wall, the front wall, the rear wall, the left wall, and the right wall may comprise the inner slot and the outer slot.

In a more detailed feature of the invention, the plurality of inner cassettes may comprise five inner cassettes and the plurality of outer cassettes may comprise five outer cassettes, the five inner cassettes may be disposed in the inner slots of the top wall, the front wall, the rear wall, the left wall and the right wall, and the five outer cassettes may be disposed in the outer slots of the top wall, the front wall, the rear wall, the left wall and the right wall.

In a more detailed feature of the invention, each of the inner cassettes may comprise a first receptacle holding two identical outer sleeves and three identical inner sleeves, each of the two identical outer sleeves may comprise a first container holding a first insulation panel, a first temperature-control member aligned with the first insulation panel, and a plurality of second temperature-control members positioned at opposite ends of the first insulation panel, the first temperature-control member may comprise a first gelled organic phase-change material having a phase-change temperature of approximately +3° C., the second temperature-control member may comprise a second gelled organic phase-change material having a phase-change temperature of approximately +5° C., each of the three identical inner sleeves may comprise a second container holding a second insulation panel and a third temperature-control member aligned with the second insulation panel, and the third temperature-control member may comprise a third gelled organic phase-change material having a phase-change temperature of approximately +3° C.

In a more detailed feature of the invention, each of the outer cassettes may comprise a second receptacle holding two identical outer sleeves and three identical inner sleeves, each of the two identical outer sleeves may comprise a third container holding a plurality of fourth temperature-control members, each of the fourth temperature-control members may comprise a foam brick impregnated with water or a water-based phase-change material and sealed within a pair of polymer films, each of the three identical inner sleeves may comprise a fourth container holding a fifth temperature-control member, the fifth temperature-control member may comprise a multi-compartmented container holding a plurality of foam bricks impregnated with water or a water-based phase-change material, and the inner sleeves may hold less phase-change material than the outer sleeves.

In a more detailed feature of the invention, the inner cassettes may be preconditioned at about +5° C. and the outer cassettes may be preconditioned at about −20° C.

In a more detailed feature of the invention, each of the front wall, the rear wall, and the top wall may comprise the inner slot and the outer slot.

In a more detailed feature of the invention, the plurality of inner cassettes may comprise three inner cassettes and the plurality of outer cassettes may comprise three outer cassettes, the three inner cassettes may be disposed in the inner slots of the top wall, the front wall, and the rear wall, and the three outer cassettes may be disposed in the outer slots of the top wall, the front wall, and the rear wall.

In a more detailed feature of the invention, each of the left wall and the right wall may comprise a single slot facing towards the interior volume.

In a more detailed feature of the invention, the system may further comprise a first side cassette and a second side cassette, each of the first side cassette and the second side cassette may comprise phase-change material, the first side cassette may be disposed in the single slot of the left wall, and the second side cassette may be disposed in the single slot of the right wall.

In a more detailed feature of the invention, the system may further comprise a pair of sleeves, each of the sleeves may comprise phase-change material, one of the sleeves may be disposed over the single slot of the left wall, and the other sleeve may be disposed over the single slot of the right wall.

In a more detailed feature of the invention, each of the top wall, the front wall, the rear wall, the left wall, and the right wall may comprise the inner slot and the outer slot, the plurality of inner cassettes may comprise five inner cassettes, the plurality of outer cassettes may comprise three outer cassettes, the five inner cassettes may be disposed in the inner slots of the top wall, the front wall, the rear wall, the left wall and the right wall, and the three outer cassettes may be disposed in the outer slots of the top wall, the left wall and the right wall.

In a more detailed feature of the invention, each of the five inner cassettes may comprise a first container holding two outer sleeves and three inner sleeves, each of the two outer sleeves may comprise a gelled organic phase-change material, each of the three inner sleeves may comprise water or a water-based phase-change material, each of the three outer cassettes may comprise a second container holding two outer sleeves and three inner sleeves, each of the two outer sleeves and the three inner sleeves may comprise water or a water-based phase-change material, and each of the two outer sleeves comprises more phase-change material than the three inner sleeves.

In a more detailed feature of the invention, the gelled organic phase-change material may have a phase-change temperature of approximately +17° C.

In a more detailed feature of the invention, the five inner cassettes may be preconditioned at about +22° C. and the three outer cassettes may be preconditioned at about +5° C.

According to another aspect of the invention, there is provided a shipping system for use in transporting a pallet-sized payload, the shipping system comprising (a) a plurality of thermally insulating walls, the plurality of thermally insulating walls being arranged to define an interior volume suitable for receiving a pallet-sized payload, the plurality of thermally insulating walls comprising a top wall, a bottom wall, a front wall, a rear wall, a left wall, and a right wall, wherein each of the front wall, the rear wall, the left wall, and the right wall comprise at least two slots facing towards the interior volume, one of the slots being an inner slot that is more proximal to the interior volume and one of the slots being an outer slot that is more distal to the interior volume; (b) a first inner sleeve, the first inner sleeve disposed in the inner slot of the front wall and comprising a phase-change material; (c) a second inner sleeve, the second inner sleeve disposed in the inner slot of the rear wall and comprising a phase-change material; (d) a third inner sleeve, the third inner sleeve disposed in the inner slot of the left wall and comprising a phase-change material; and (e) a fourth inner sleeve, the fourth inner sleeve disposed in the inner slot of the right wall and comprising a phase-change material.

In a more detailed feature of the invention, the system may further comprise a tray positioned over the payload in the interior volume, and the tray may hold a phase-change material.

In a more detailed feature of the invention, the phase-change material in the first, second, third and fourth sleeves and in the tray may be dry ice.

In a more detailed feature of the invention, the system may further comprise eight additional inner sleeves, a first two of the eight additional sleeves may be disposed adjacent to the first inner sleeve in the inner slot of the front wall to form a first triplet of sleeves, a second two of the eight additional sleeves may be disposed adjacent to the second inner sleeve in the inner slot of the rear wall to form a second triplet of sleeves, a third two of the eight additional sleeves may be disposed adjacent to the third inner sleeve in the inner slot of the left wall to form a third triplet of sleeves, a fourth two of the eight additional sleeves may be disposed adjacent to the fourth inner sleeve in the inner slot of right wall to form a fourth triplet of sleeves, the outer sleeves of each triplet may contain dry ice, and the middle sleeve of each triplet may be empty.

In a more detailed feature of the invention, the outer slot of each of the front wall, the rear wall, the left side wall, and the right side wall may be empty.

In a more detailed feature of the invention, the system may further comprise a first insulation panel disposed in the outer slot of the front wall, a second insulation panel disposed in the outer slot of the rear wall, a third insulation panel disposed in the outer slot of the left wall, and a fourth insulation panel disposed in the outer slot of the right wall.

In a more detailed feature of the invention, the system may further comprise a first outer cassette disposed in the outer slot of the front wall, a second outer cassette disposed in the outer slot of the rear wall, a third outer cassette disposed in the outer slot of the left wall, and a fourth outer cassette disposed in the outer slot of the right wall, and each of the first, second, third and fourth outer cassettes may comprise phase-change material.

It is another object of the present invention to provide a kit for use in making the above-described thermally insulated shipping system.

It is still another object of the present invention to provide methods of making and using the above-described thermally insulated shipping system.

Additional objects, as well as aspects, features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF THE INVENTION

The present invention is directed at a shipping system that may be used to maintain a temperature-sensitive payload within a desired temperature range for a particular period of time. The system, which may be used with a pallet-sized payload optionally positioned on a pallet, possesses certain features of modularity that permit the system to be modified, if desired, to suit particular thermal needs. More specifically, the system may comprise a plurality of thermally insulated walls. The plurality of walls may be used collectively to fashion a thermally insulated volume for receiving the payload. In addition, one or more of the walls may include a mounting mechanism facing towards the thermally insulated volume and defining, at least in part, an inner slot and an outer slot. The inner slot, which is located more proximal to the payload, may be used to receive a first thermal device. The outer slot, which is located more distal to the payload, may be used to receive a second thermal device. As can be appreciated, by selectively using the first thermal device and/or the second thermal device and by modifying the thermal characteristics of the first thermal device and/or the second thermal device, one may adjust the thermal characteristics of the shipping system as a whole.

Figure 1:
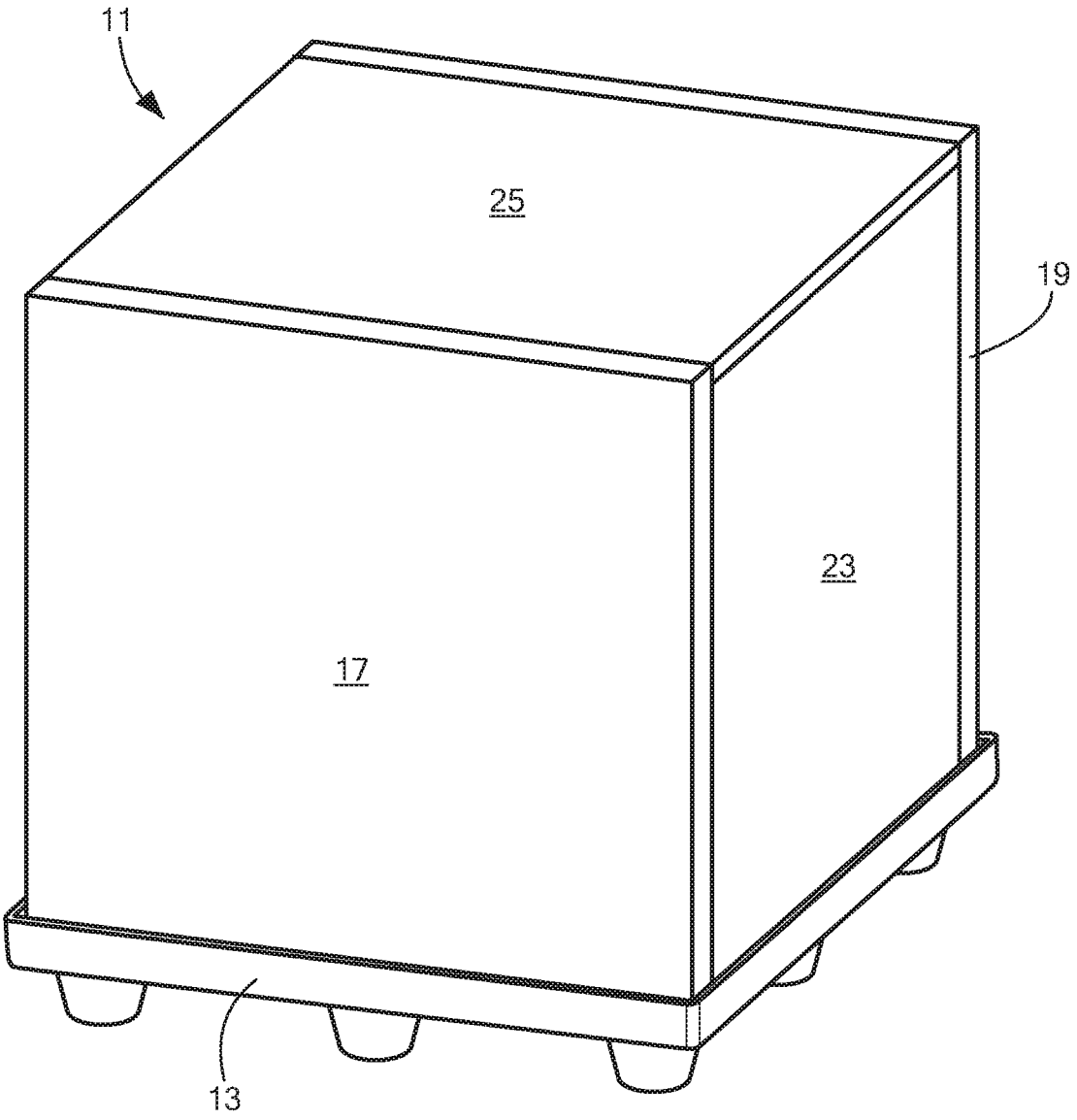
FIG. 1 is a front perspective view of a first embodiment of a thermally insulated shipping system that may be used to transport a pallet-sized payload, the thermally insulated shipping system being constructed according to the teachings of the present invention.
Figure 2:
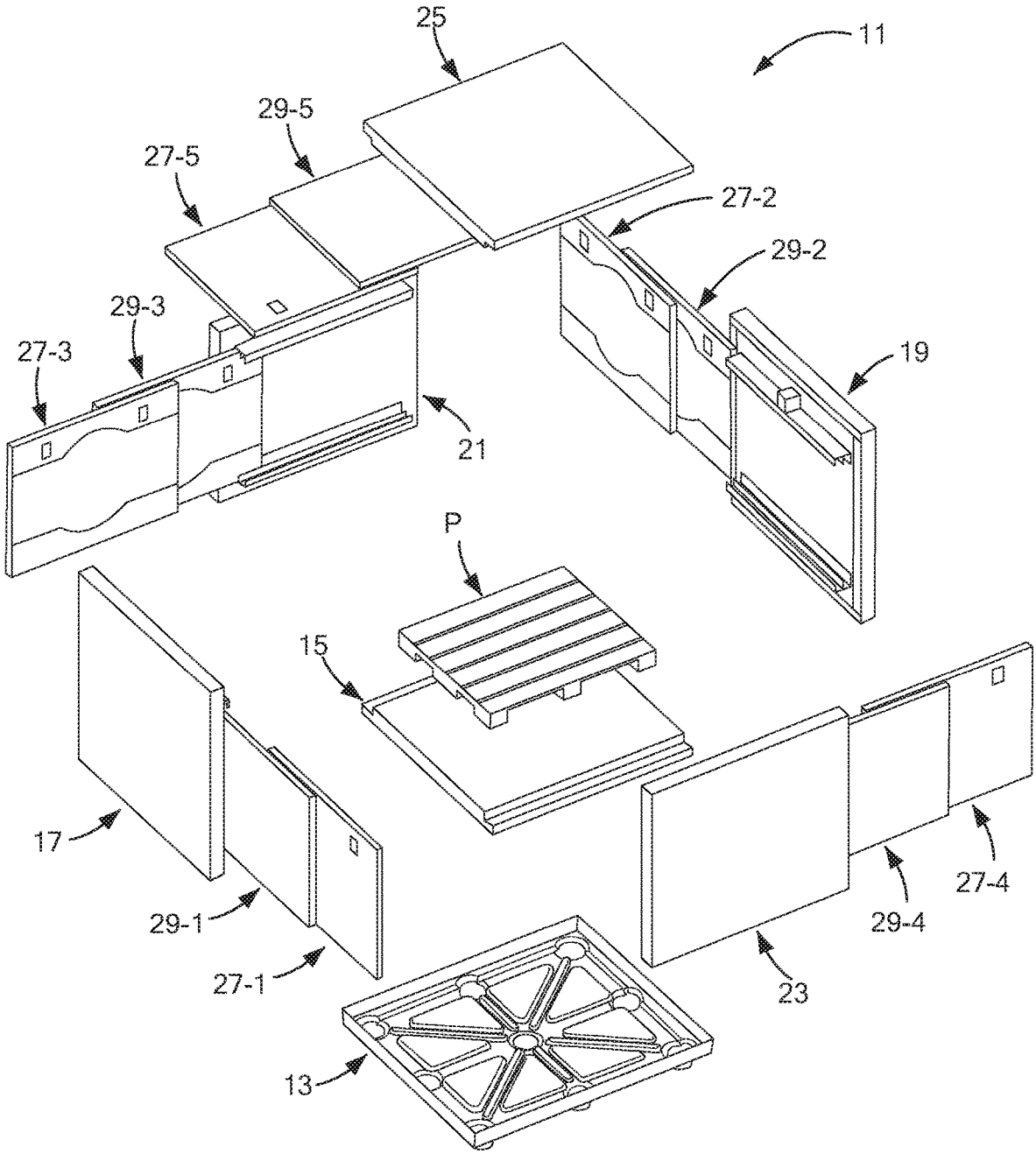
FIG. 2 is a partially exploded perspective view of the thermally insulated shipping system shown in FIG. 1.
Figure 3A:
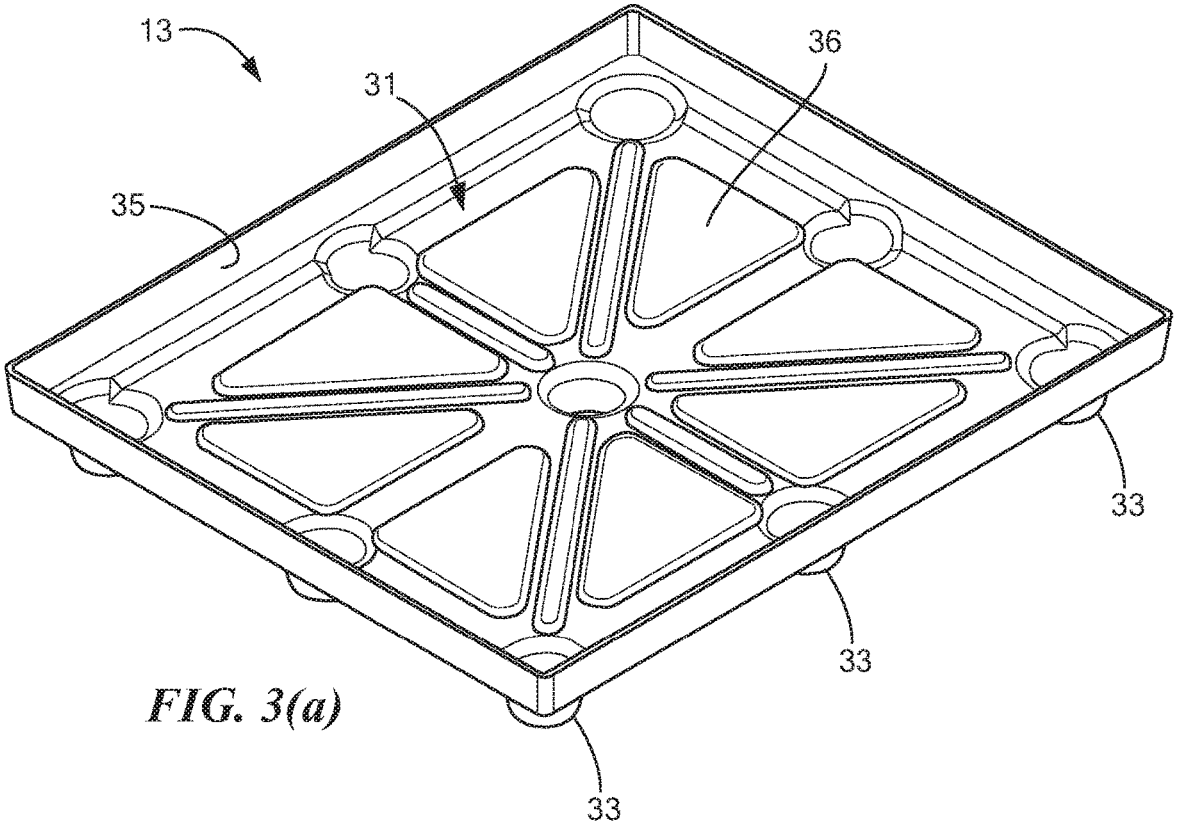
FIGS. 3(*a*) through 3(*e*) are enlarged top perspective, enlarged bottom perspective, enlarged top, enlarged bottom, and enlarged side views, respectively, of the skid shown in FIG. 2.
Figure 3B:
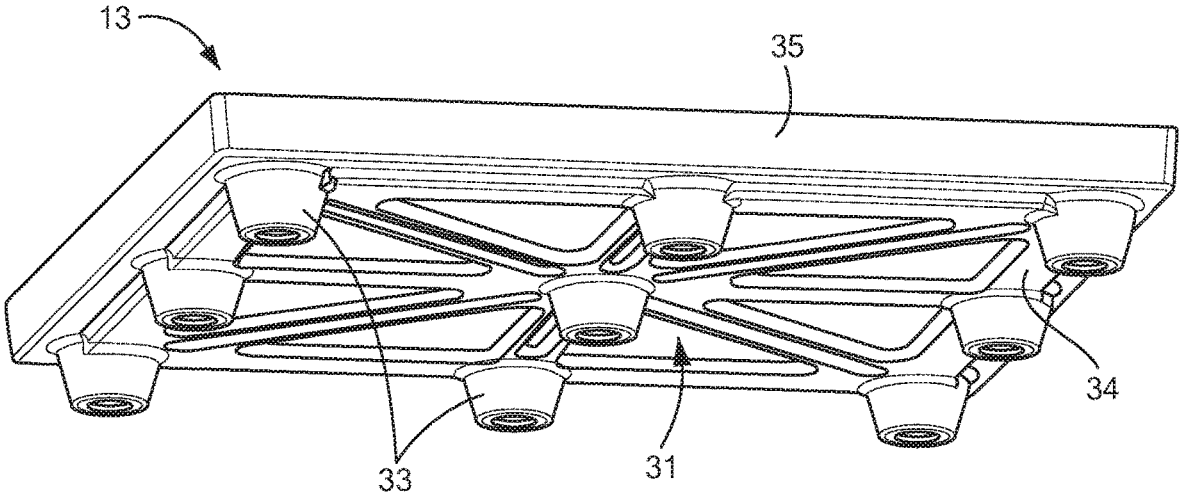
Figure 3C:
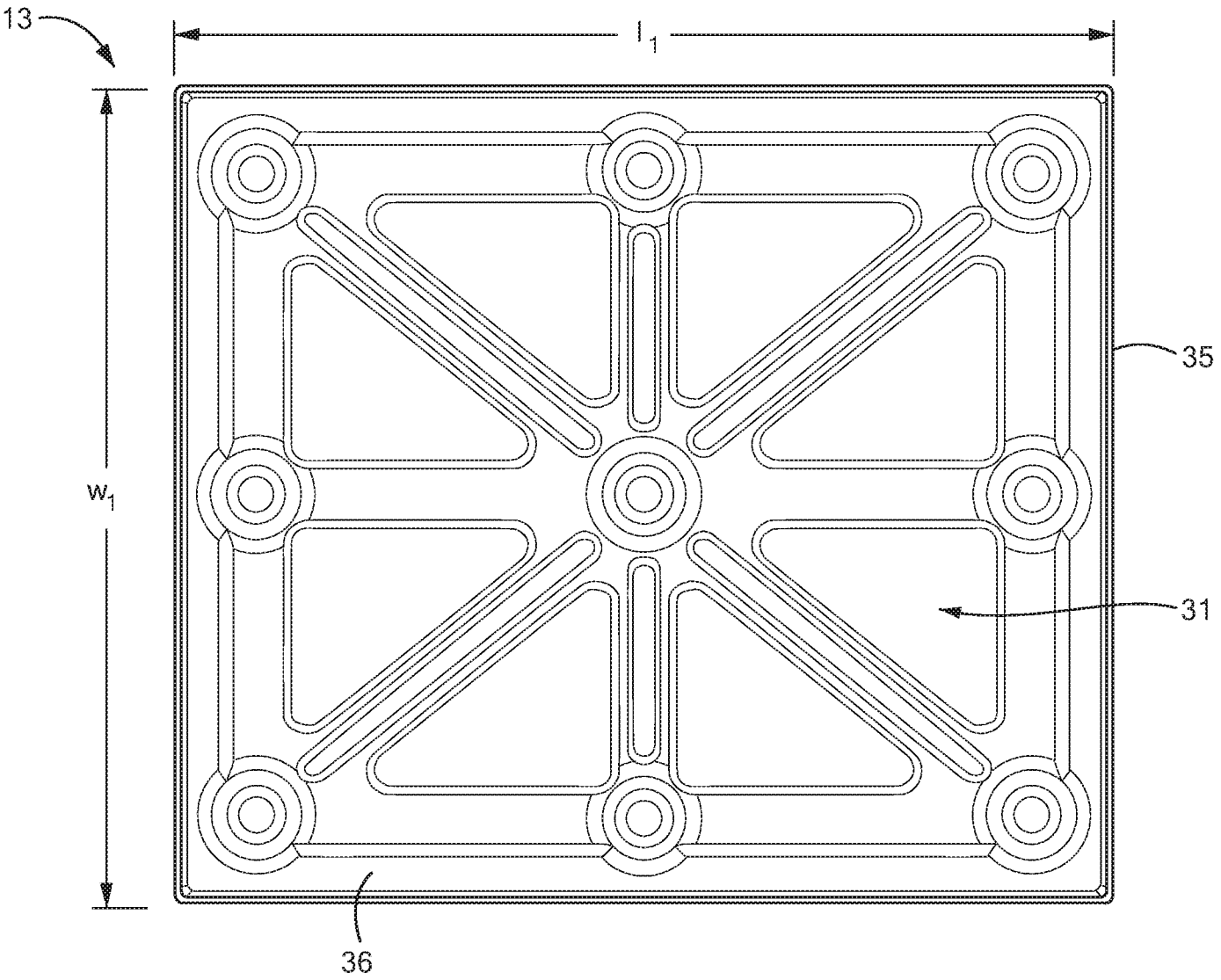
Figure 3D:
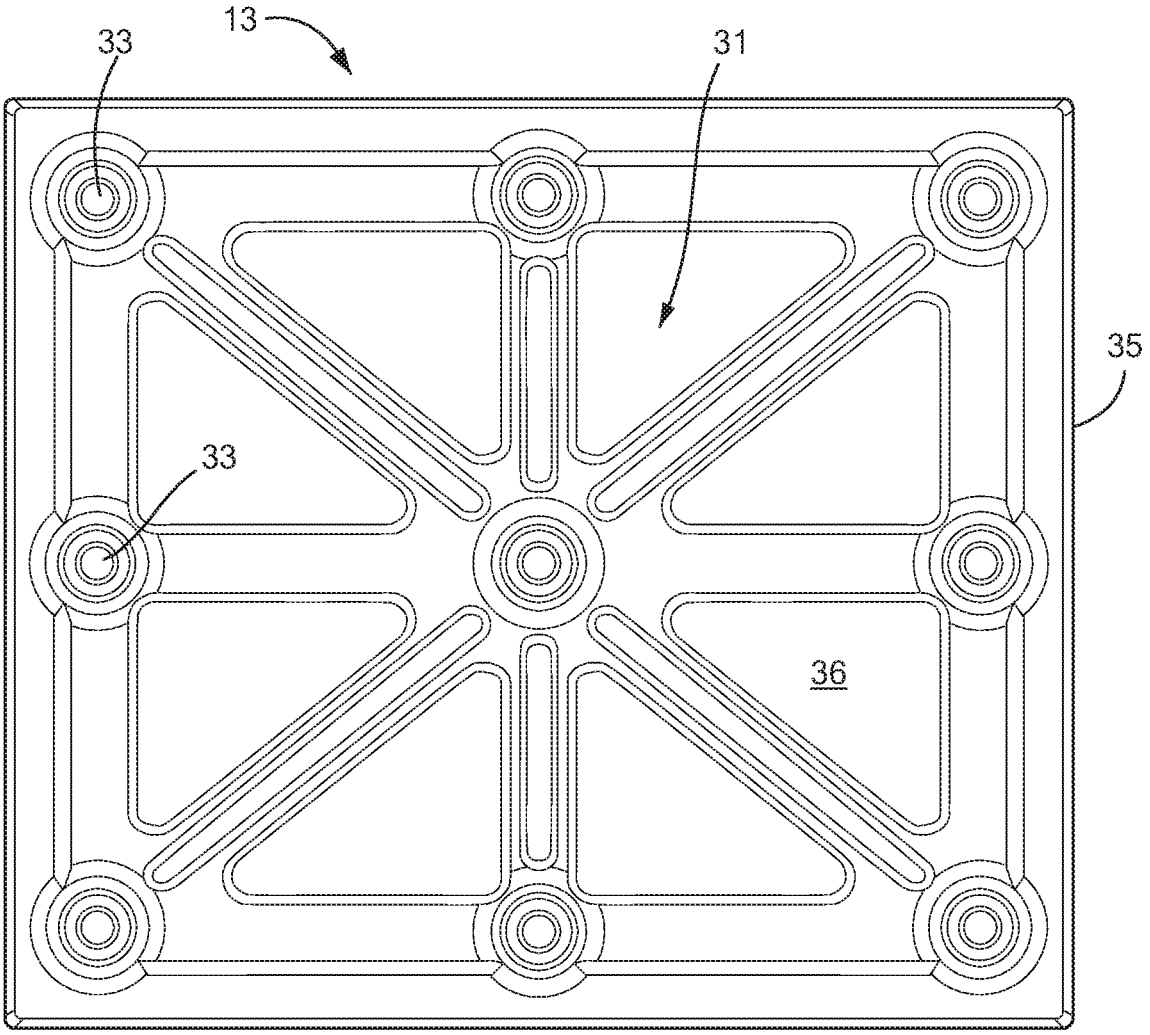
Figure 3E:
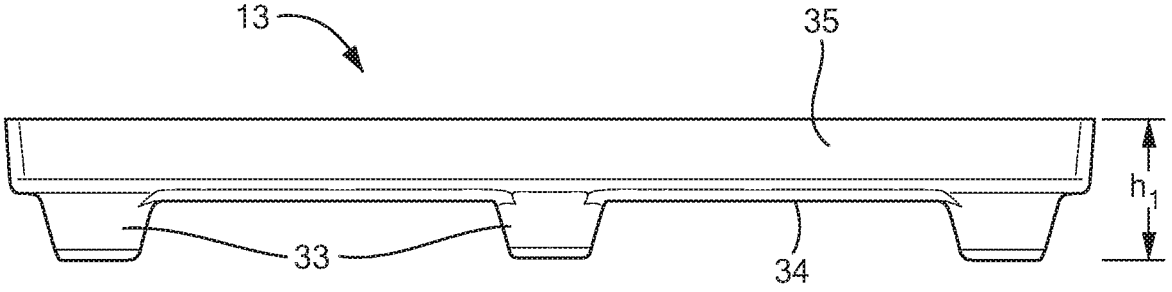
Figure 4A:
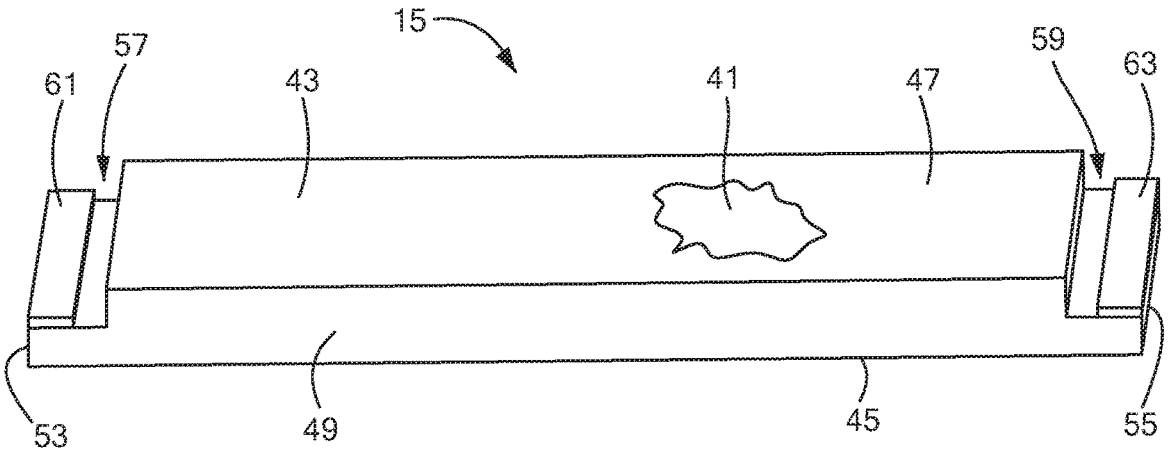
FIGS. 4(*a*) through 4(*d*) are enlarged top perspective, enlarged bottom perspective, enlarged rear, and enlarged right side views of the bottom wall shown in FIG. 2, with FIG. 4(*a*) being broken away in part to reveal the thermally insulating panel.
Figure 4B:
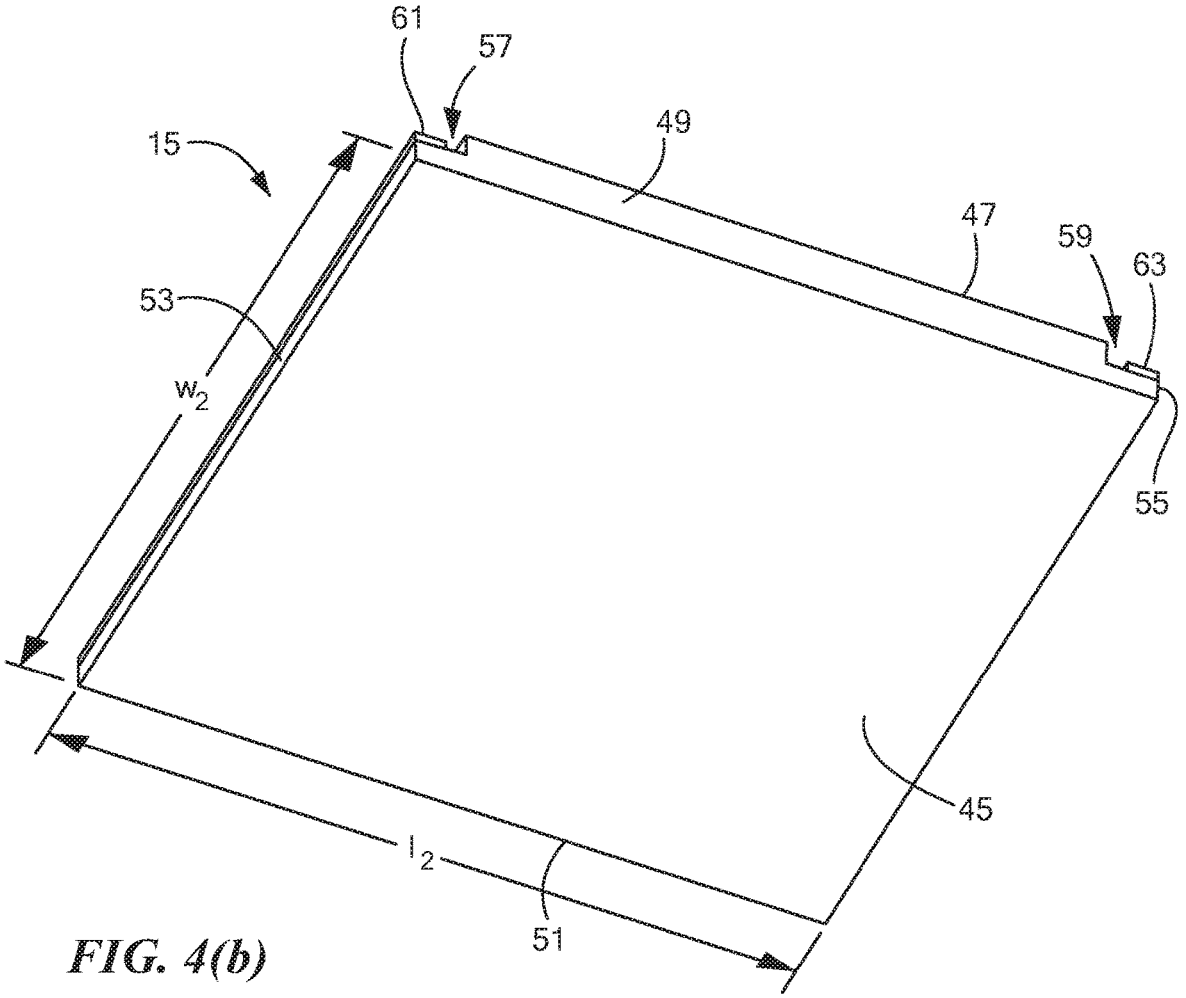
Figure 4C:
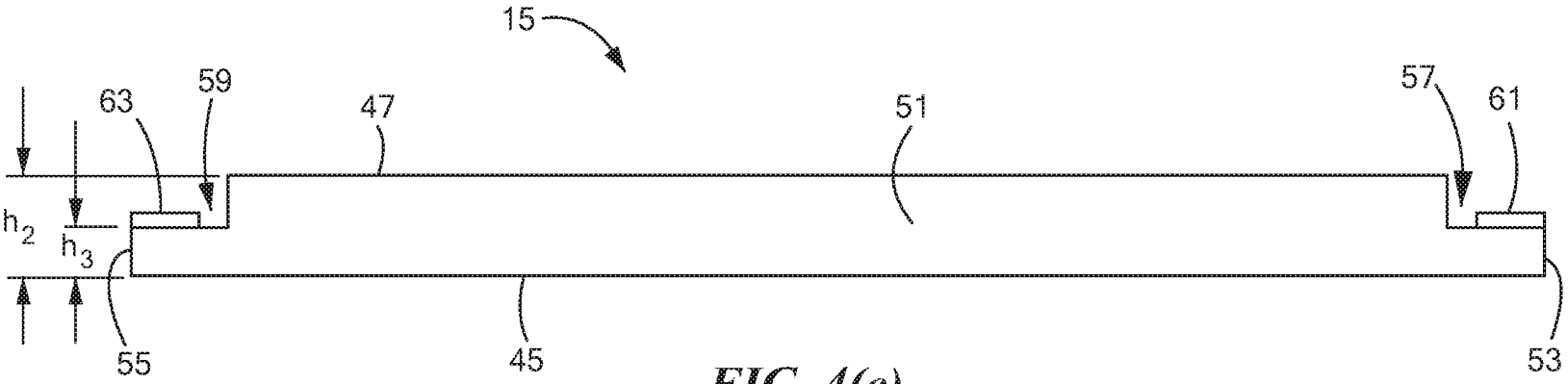
Figure 4D:
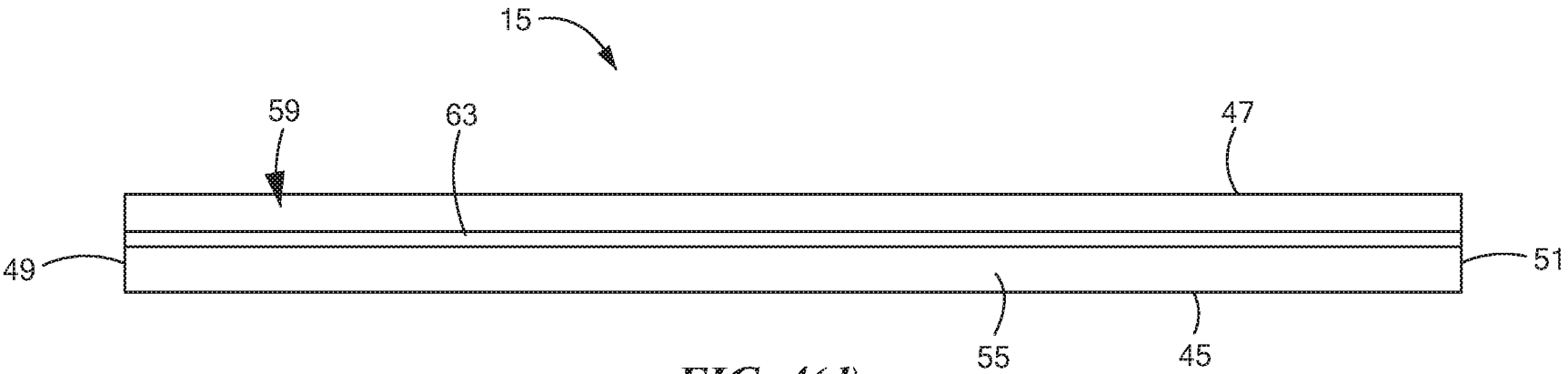

Referring now to FIGS. 1 and 2, there are shown front perspective and partially exploded perspective views, respectively, of a first embodiment of a thermally insulated shipping system that may be used to transport a pallet-sized payload, the thermally insulated shipping system being constructed according to the present invention and being represented generally by reference numeral 11.

System 11, which may be used to maintain a payload within a temperature range of +2° C. to +8° C. for an extended period of time, such as up to five days or longer, may comprise a skid 13, a bottom wall 15, a front wall 17, a rear wall 19, a left wall 21, a right wall 23, a top wall 25, a plurality of inner cassettes 27-1 through 27-5, and a plurality of outer cassettes 29-1 through 29-5.

Skid 13, which is also shown separately in FIGS. 3(*a*) through 3(*e*), may be a unitary (i.e., one-piece) structure preferably made of a molded polymer or another similarly suitable material. Skid 13 may be shaped to include a base portion 31, a plurality of feet 33 extending downwardly from a bottom surface 34 of a base portion 31, and a peripheral wall 35 extending upwardly from a top surface 36 of base portion 31 along the periphery of base portion 31. Feet 33 may be sized and shaped so that skid 13 may be stably positioned on a floor or other similar surface and so that skid 13 may resist sliding along said surface. In addition, feet 33 may be arranged on base portion 31 to facilitate the lifting of skid 13 using a forklift or similar device.

Without wishing to be limited to any particular dimensions, skid 13 may have a length $l_1$ of approximately 70 inches, a width $w_1$ of approximately 60 inches, and a height $h_1$ of approximately 9.50 inches.

Bottom wall 15, which is also shown separately in FIGS. 4(*a*) through 4(*d*), may comprise an insulating panel 41 and a cover 43, with insulating panel 41 preferably being entirely covered or substantially entirely covered by cover 43. Insulating panel 41 may comprise one or more pieces of polyurethane insulation or another similarly suitable material, and cover 43 may comprise one or more pieces of a corrugated cardboard or another similarly suitable material. Bottom wall 15 may be generally rectangular in shape and may include a bottom 45, a top 47, a front 49, a rear 51, a left side 53, and a right side 55. Bottom wall 15 may have areas of decreased thickness forming a first stepped portion 57 and a second stepped portion 59. First stepped portion 57 may extend downwardly from top 47 along left side 53 and may extend from front 49 to rear 51. Second stepped portion 59 may extend downwardly from top 47 along right side 55 and may extend from front 49 to rear 51. A first pad 61 may be positioned across a portion of first stepped portion 57, and a second pad 63 may be positioned across a portion of second stepped portion 57.

Bottom wall 15 may be appropriately dimensioned to be received on top of and across the width of base portion 31 of skid 13, with left side 53 of bottom wall 15 being positioned just inside or in contact with an inside surface of peripheral wall 35 and with right side 55 of bottom wall 15 being positioned just inside or in contact with an inside surface of peripheral wall 35. In this manner, with bottom wall 15 mounted on skid 13, left wall 21 may be positioned on top of first stepped portion 57 of bottom wall 15, right wall 23 may be positioned on top of second stepped portion 59 of bottom wall 15, front wall 17 may be positioned in the space between front 49 of bottom wall 15 and peripheral wall 35 of skid 13, and rear wall 19 may be positioned in the space between rear 51 of bottom wall 15 and peripheral wall 35 of skid 13.

Without wishing to be limited to any particular dimensions, bottom wall 15 may have a length $l_2$ of approximately 58 inches, a width $w_2$ of approximately 58 inches, a maximum height $h_2$ of approximately 4 inches, and a minimum height $h_3$ of approximately 2 inches.

Figure 5A:
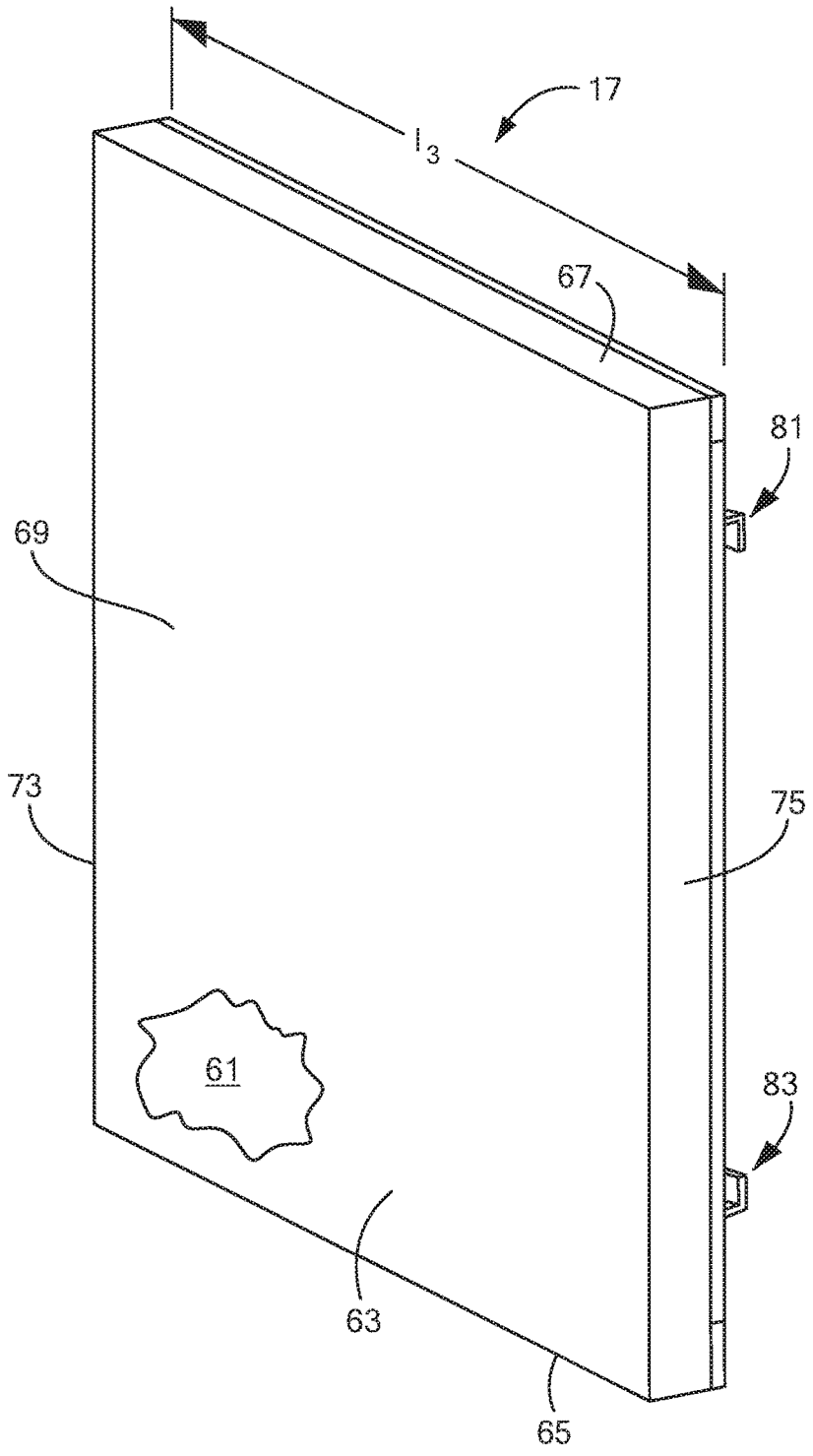
FIGS. 5(*a*) through 5(*c*) are enlarged front perspective, enlarged rear perspective, and enlarged right side views, respectively, of the front wall shown in FIG. 2, with FIG. 5(*a*) being broken away in part to reveal the thermally insulating panel.
Figure 5C:
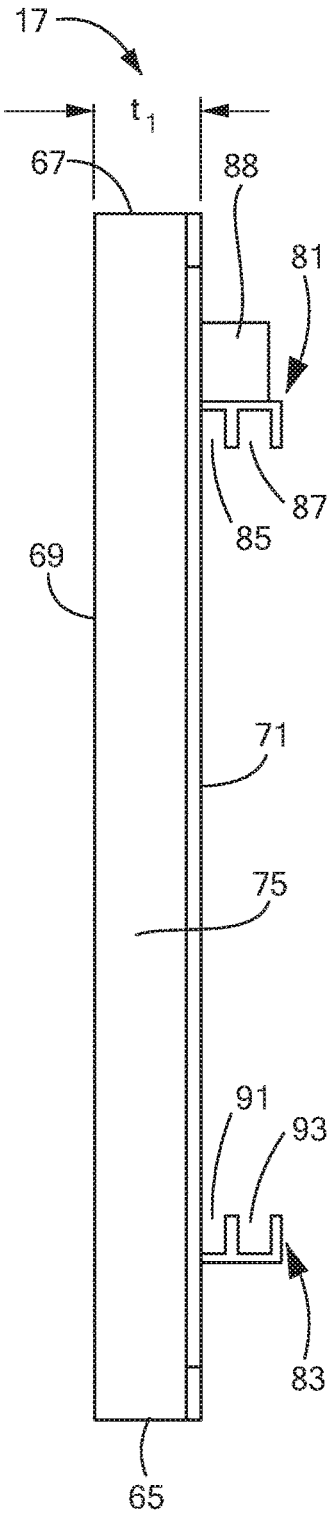
Figure 5B:
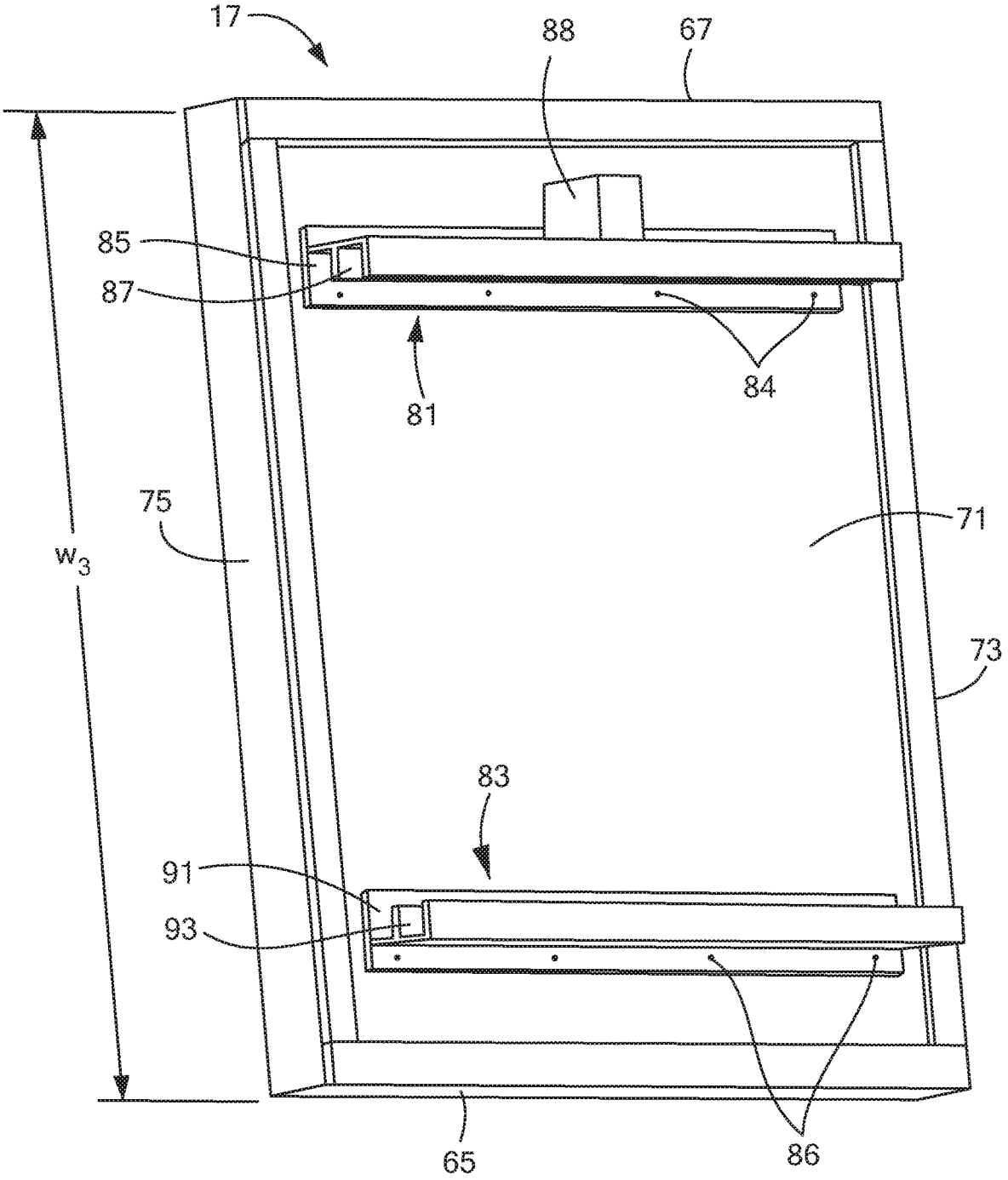

Front wall 17, which is also shown separately in FIGS. 5(*a*) through 5(*c*), may comprise an insulating panel 61 and a cover 63, with insulating panel 61 preferably being entirely covered or substantially entirely covered by cover 63. Insulating panel 61 may comprise one or more pieces of polyurethane insulation or another similarly suitable material, and cover 63 may comprise one or more pieces of a corrugated cardboard or another similarly suitable material. The combination of insulating panel 61 and cover 63 may be generally rectangular in shape and may include a bottom 65, a top 67, a front 69, a rear 71, a left side 73, and a right side 75.

Without wishing to be limited to any particular dimensions, the combination of insulating panel 61 and cover 63 may have a length $l_3$ of approximately 58 inches, a width $w_3$ of approximately 57.75 inches, and a thickness $t_1$ of approximately 4 inches.

Front wall 17 may further comprise a pair of brackets 81 and 83. Each of brackets 81 and 83 may be a unitary (i.e., one-piece) structure preferably made of a molded polymer or another similarly suitable material. Bracket 81, which may be mounted generally horizontally on rear 71 a short distance from top 67 using mechanical fasteners 84 (e.g., studs) and/or other suitable fastening means, may be shaped to define a pair of parallel tracks, namely, an outer track 85 that is proximal to rear 71 and an inner track 87 that is distal to rear 71. Each of outer track 85 and inner track 87 may have a generally inverted U-shape, with the respective ends and bottom of each of outer tracks 85 and 87 being open. Bracket 81 may additionally be shaped to include a stop 88, which may be used to limit forward sliding movement of cassettes 27-5 and 29-5. Bracket 83, which may be mounted generally horizontally on rear 71 a short distance from bottom 65 using mechanical fasteners 86 (e.g., studs) and/or other suitable fastening means, may be shaped to define a pair of parallel tracks, namely, an outer track 91 that is proximal to rear 71 and an inner track 93 that is distal to rear 71. Each of outer track 91 and inner track 93 may be generally U-shaped, with the respective ends and top of each of outer tracks 91 and 93 being open. Brackets 81 and 83 may be appropriately positioned relative to one another to jointly define an inner slot and an outer slot. In this manner, inner cassette 27-1 and outer cassette 29-1 may be removably mounted within the inner slot and the outer slot, respectively, for example, by sliding inner cassette 27-1 into inner track 87 of bracket 81 and into inner track 93 of bracket 83 and by sliding outer cassette 29-1 into outer track 85 of bracket 81 and into outer track 91 of bracket 83. For example, without wishing to be limited to any particular dimensions, brackets 81 and 83 may be spaced apart so as to receive cassettes whose respective top and bottom edges are separated by a distance of approximately 40 inches.

Although not included in the present embodiment, it is to be understood that a mounting plate may be inserted into panel 61 or between panel 61 and cover 63 to facilitate the mounting of brackets 81 and 83 to cover 63.

Figure 6A:
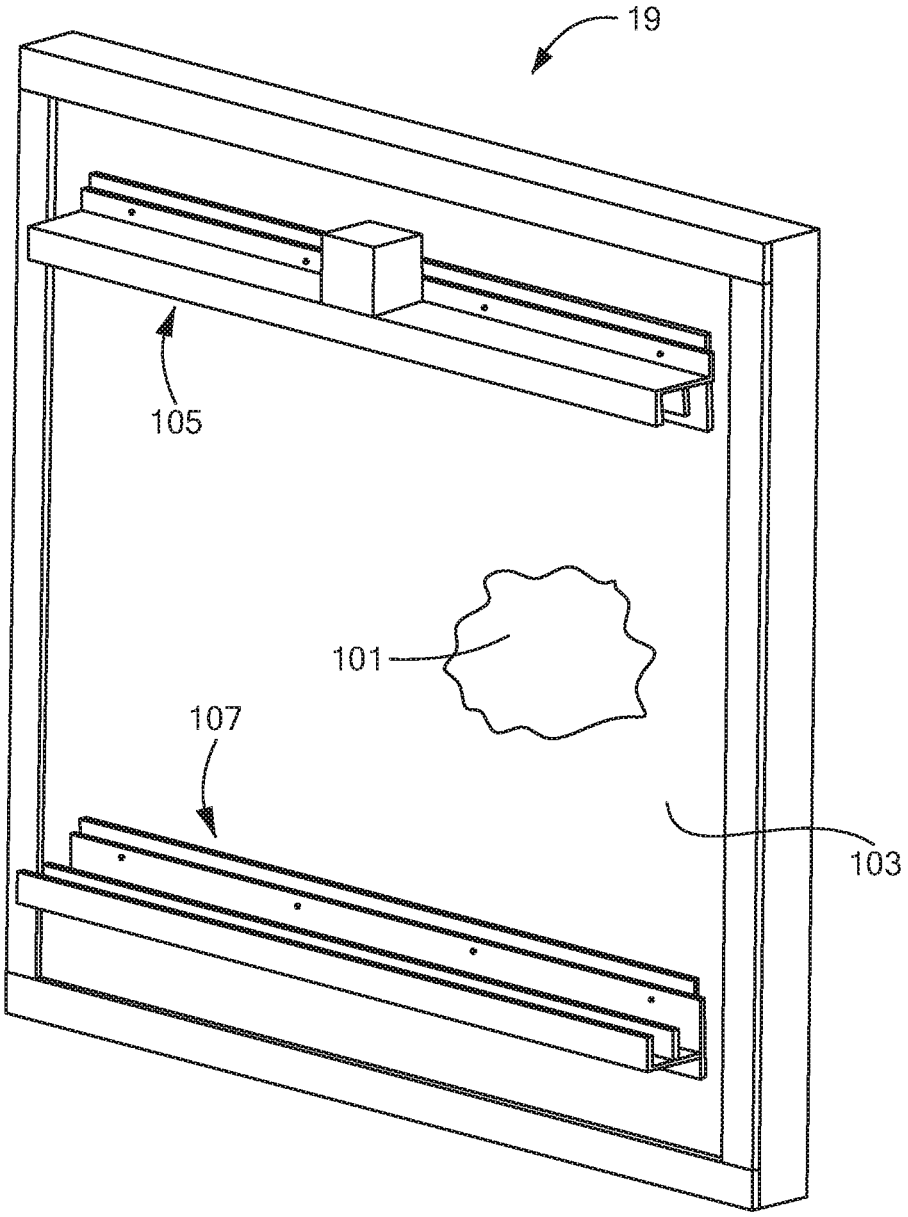
FIGS. 6(*a*) through 6(*c*) are enlarged front perspective, enlarged rear perspective, and enlarged right side views, respectively, of the rear wall shown in FIG. 2, with FIG. 6(*a*) being broken away in part to reveal the thermally insulating panel.
Figure 6C:
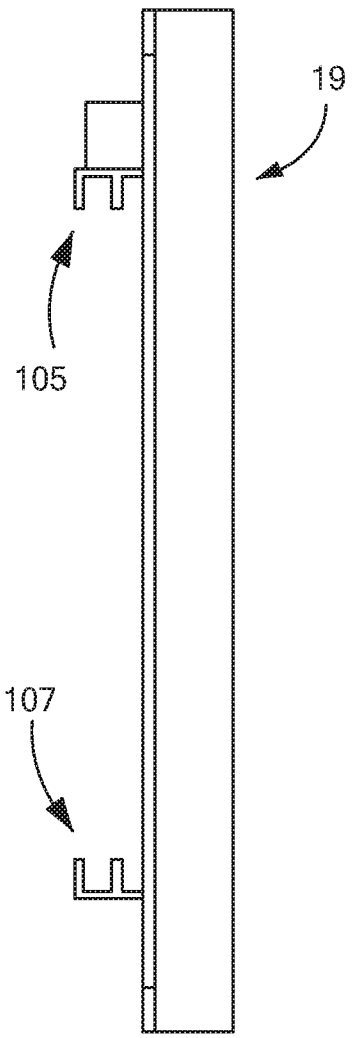
Figure 6B:
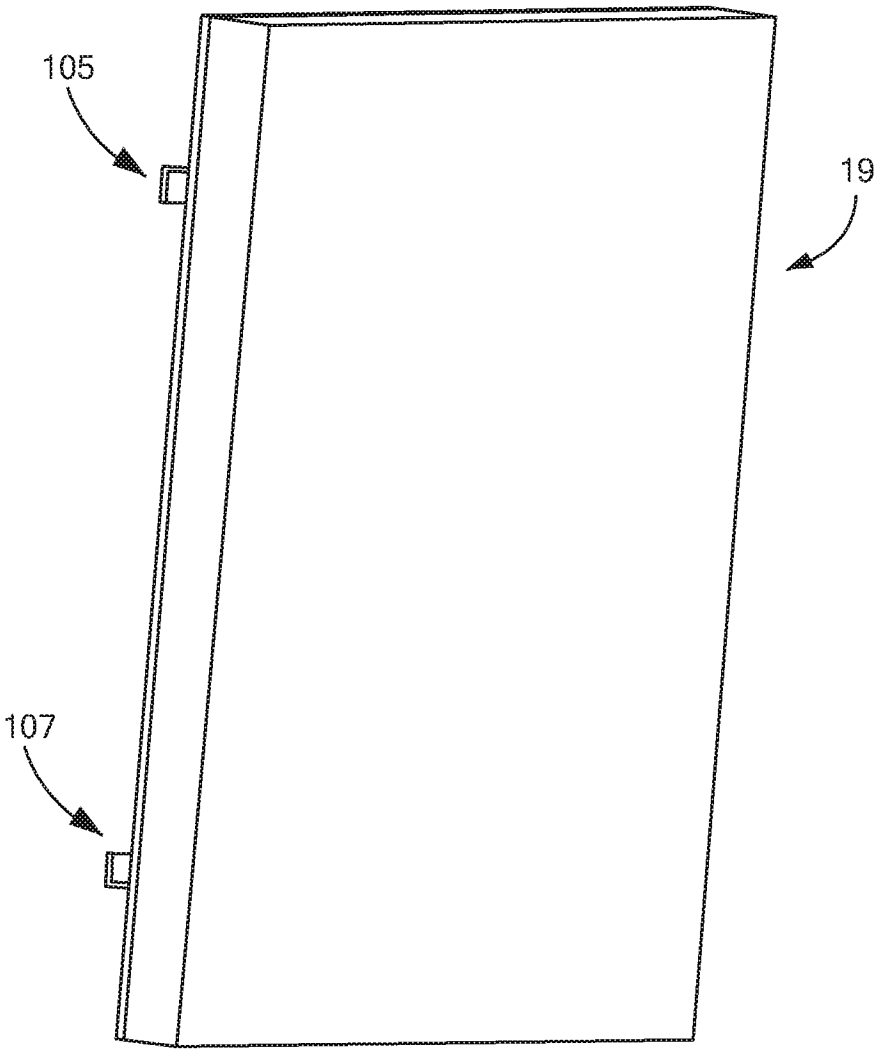

Rear wall 19, which is also shown separately in FIGS. 6(*a*) through 6(*c*), may be identical in size, shape, construction and composition to front wall 17. As such, rear wall 19 may comprise an insulating panel 101, which may be identical to insulating panel 61 of front wall 17, a cover 103, which may be identical to cover 63 of front wall 17, a bracket 105, which may be identical to bracket 81 of front wall 17, and a bracket 107, which may be identical to bracket 83 of front wall 17.

Although not included in the present embodiment, a mounting plate may be inserted into panel 101 or between panel 101 and cover 103 to facilitate the mounting of brackets 105 and 107 to cover 103.

Figure 7A:
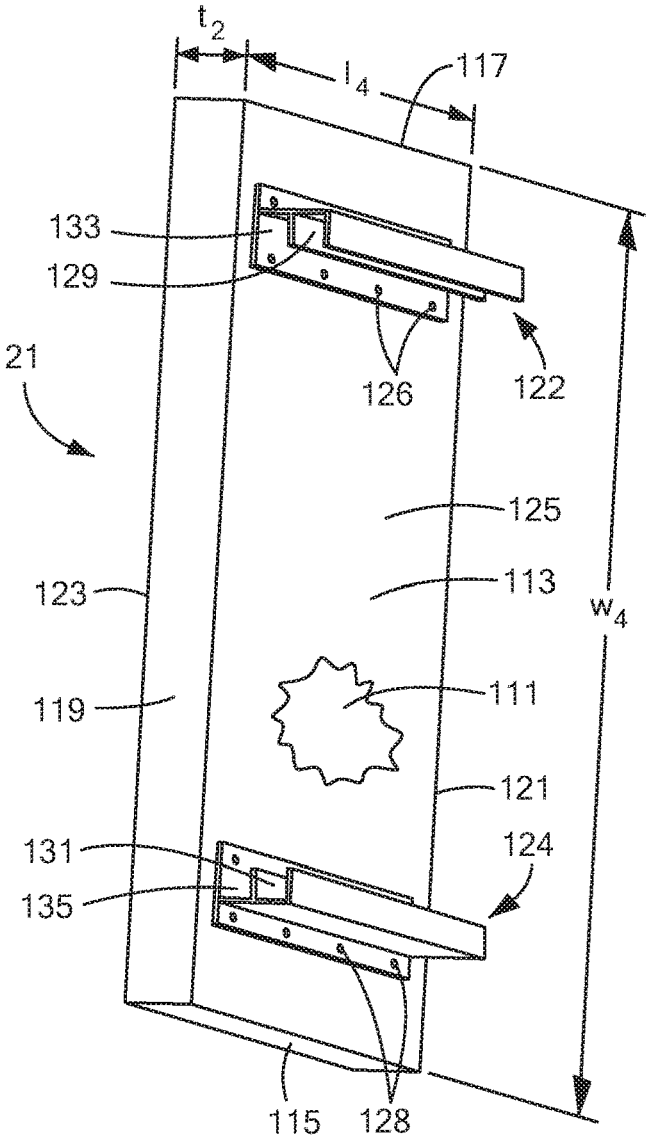
FIGS. 7(*a*) and 7(*b*) are enlarged front perspective and enlarged rear perspective views, respectively, of the left side wall shown in FIG. 2, with FIG. 7(*a*) being broken away in part to reveal the thermally insulating panel.
Figure 7B:
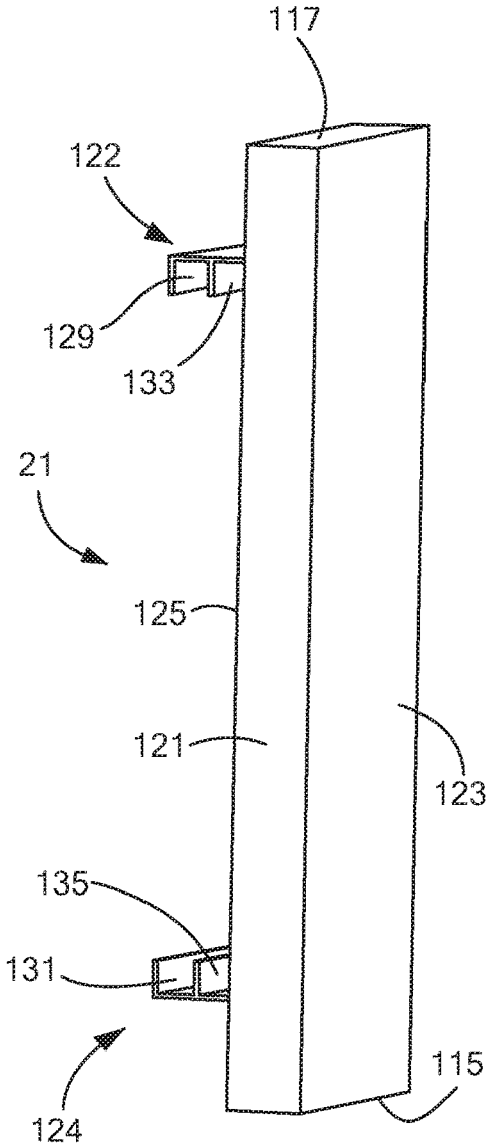

Left wall 21, which is also shown separately in FIGS. 7(*a*) and 7(*b*), may comprise an insulating panel 111 and a cover 113, with insulating panel 111 preferably being entirely covered or substantially entirely covered by cover 113. Insulating panel 111 may comprise one or more pieces of polyurethane insulation or another similarly suitable material, and cover 113 may comprise one or more pieces of a corrugated cardboard or another similarly suitable material. The combination of insulating panel 111 and cover 113 may be generally rectangular in shape and may include a bottom 115, a top 117, a front 119, a rear 121, a left side 123, and a right side 125.

Without wishing to be limited to any particular dimensions, the combination of insulating panel 111 and cover 113 may have a length $l_4$ of approximately 58 inches, a width $w_4$ of approximately 53.25 inches, and a thickness $t_2$ of approximately 4 inches.

Left wall 21 may further comprise a pair of brackets 122 and 124. Bracket 122 may be identical to bracket 81, except that bracket 122 need not include structure corresponding to stop 88, and bracket 124 may be identical to bracket 83. Bracket 122 may be mounted generally horizontally on right side 125 a short distance from top 117 using mechanical fasteners 126 (e.g., studs) and/or other suitable fastening means. Bracket 124 may be mounted generally horizontally on right side 125 a short distance from bottom 115 using mechanical fasteners 128 (e.g., studs) and/or other suitable fastening means. Brackets 122 and 124 may be appropriately positioned relative to one another to jointly define an inner slot and an outer slot. In this manner, inner cassette 27-3 and outer cassette 29-3 may be removably mounted within the inner slot and the outer slot, respectively, for example, by sliding inner cassette 27-3 into an inner track 129 of bracket 122 and into an inner track 131 of bracket 124 and by sliding outer cassette 29-3 into an outer track 133 of bracket 122 and into an outer track 135 of bracket 124. For example, without wishing to be limited to any particular dimensions, brackets 122 and 124 may be spaced apart so as to receive cassettes whose respective top and bottom edges are separated by a distance of approximately 40 inches. Preferably, brackets 122 and 124 are appropriately positioned on right side 125 so that, when system 11 is assembled, bracket 122 may be substantially aligned with brackets 81 and 105 and bracket 124 may be substantially aligned with brackets 83 and 107.

Although not included in the present embodiment, a mounting plate may be inserted into panel 111 or between panel 111 and cover 113 to facilitate the mounting of brackets 122 and 124 to cover 113.

Figure 8A:
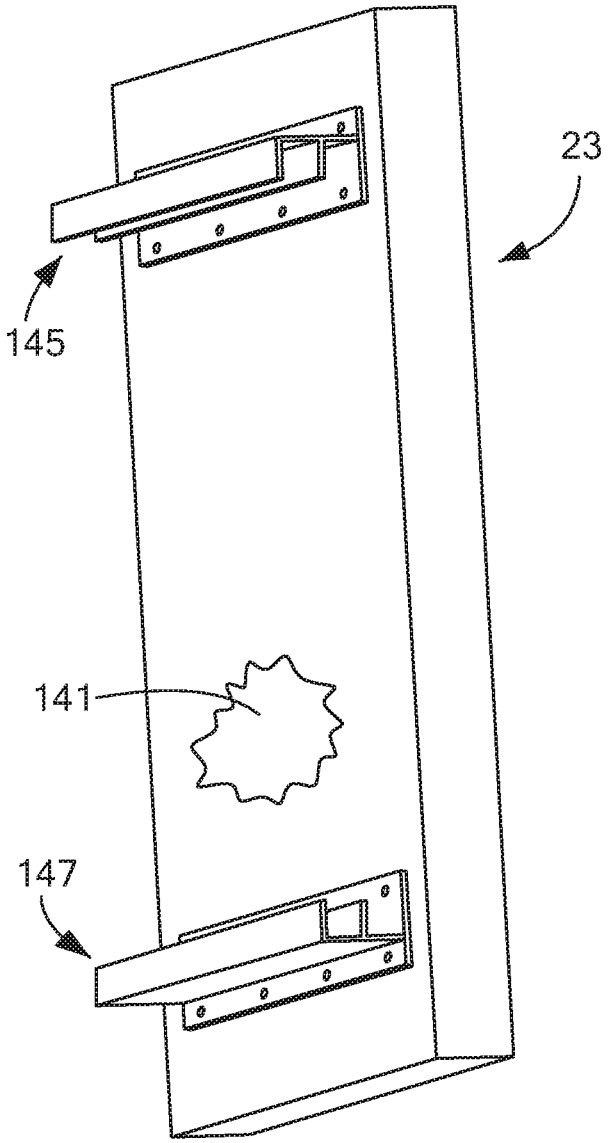
FIGS. 8(*a*) and 8(*b*) are enlarged front perspective and enlarged rear perspective views, respectively, of the right side wall shown in FIG. 2, with FIG. 8(*a*) being broken away in part to reveal the insulating panel.
Figure 8B:
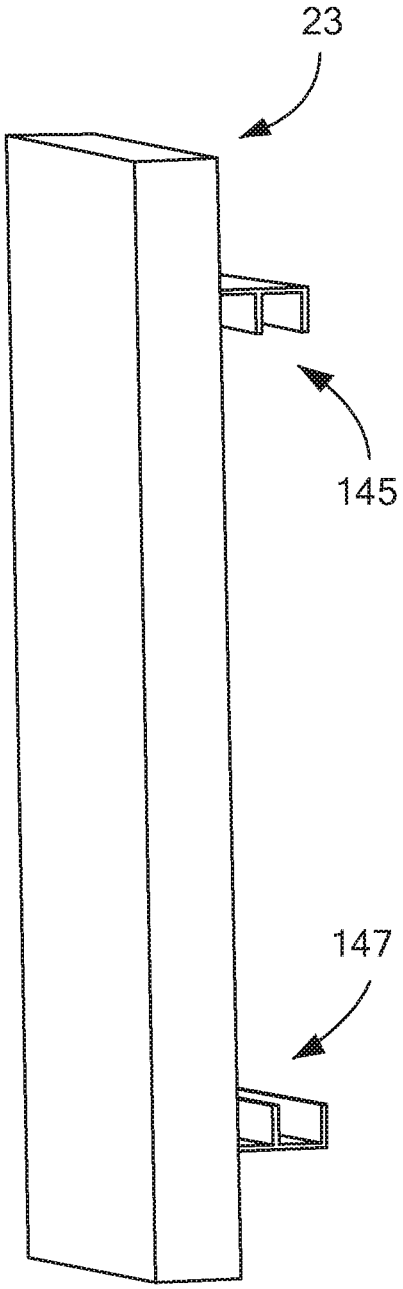

Right wall 23, which is also shown separately in FIGS. 8(*a*) and 8(*b*), may be identical in size, shape, construction and composition to left wall 21. As such, right wall 23 may comprise an insulating panel 141, which may be identical to insulating panel 111 of left wall 21, a cover 143, which may be identical to cover 113 of left wall 21, a bracket 145, which may be identical to bracket 122 of left wall 21, and a bracket 147, which may be identical to bracket 124 of left wall 21.

Although not included in the present embodiment, a mounting plate may be inserted into panel 141 or between panel 141 and cover 143 to facilitate the mounting of brackets 145 and 147 to cover 143.

Figure 9A:
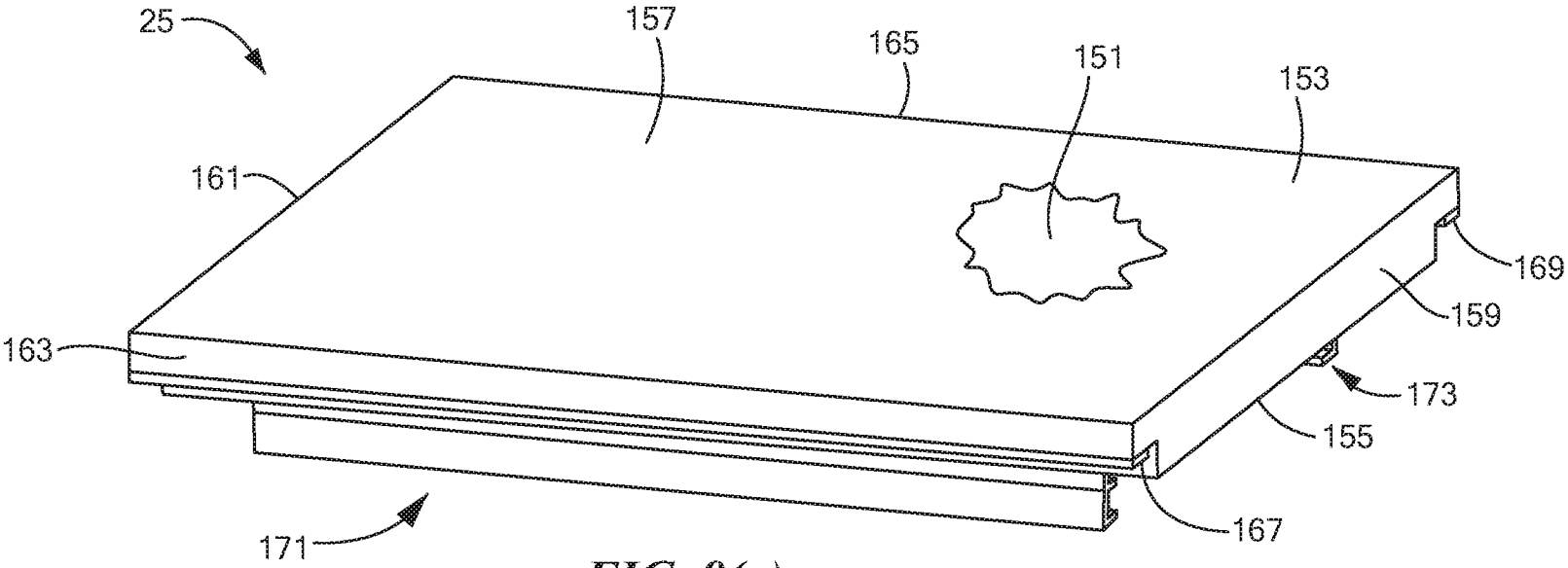
FIGS. 9(*a*) through 9(*c*) are enlarged top perspective, enlarged bottom perspective, and enlarged front views, respectively, of the top wall shown in FIG. 2, with FIG. 9(*a*) being broken away in part to reveal the thermally insulating panel.
Figure 9C:
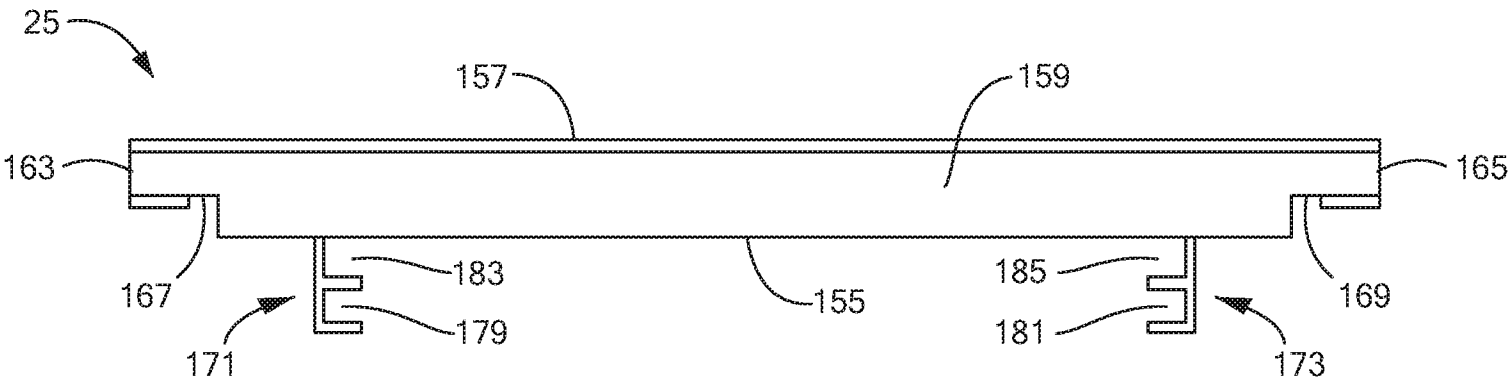
Figure 9B:
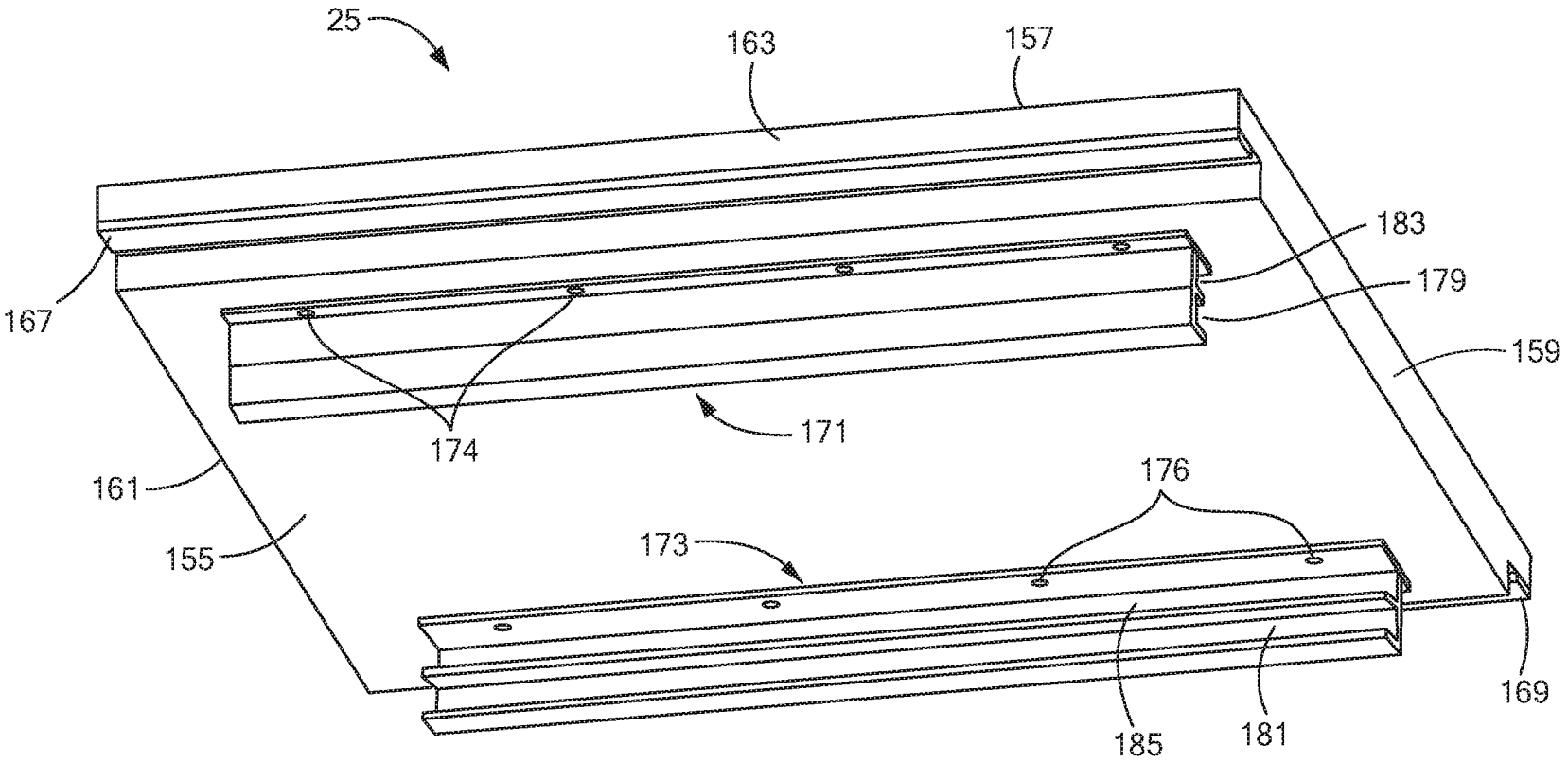

Top wall 25, which is also shown separately in FIGS. 9(*a*) through 9(*c*), may be similar in certain respects to bottom wall 15. In particular, top wall 25 may comprise an insulating panel 151, which may be identical in size, shape, construction and composition to insulating panel 41 of bottom wall 15, and may comprise a cover 153, which may be identical in size, shape, construction and composition to cover 43 of bottom wall 15. The combination of insulating panel 151 and cover 153 may be generally rectangular in shape and may include a bottom 155, a top 157, a front 159, a rear 161, a left side 163, and a right side 165. A first stepped portion 167 may extend upwardly from bottom 155 along left side 163 and may extend from front 159 to rear 161. A second stepped portion 169 may extend upwardly from bottom 155 along right side 165 and may extend from front 159 to rear 161.

Top wall 25 may differ from bottom wall 15 in that top wall 25 may further comprise a pair of brackets 171 and 173. Bracket 171 may be identical to bracket 81, except that bracket 171 need not include structure corresponding to stop 88, and bracket 173 may be identical to bracket 83. Bracket 171 may be mounted on bottom 155 a short distance from first stepped portion 167 using mechanical fasteners 174 (e.g., studs) and/or other suitable fastening means. Bracket 173 may be mounted on bottom 155 a short distance from second stepped bottom 169 using mechanical fasteners 176 (e.g., studs) and/or other suitable fastening means. Brackets 171 and 173 may be appropriately positioned relative to one another to jointly define an inner slot and an outer slot. In this manner, inner cassette 27-5 and outer cassette 29-5 may be removably mounted within the inner slot and the outer slot, respectively, for example, by sliding inner cassette 27-5 into an inner track 179 of bracket 171 and into an inner track 181 of bracket 173 and by sliding outer cassette 29-5 into an outer track 183 of bracket 171 and into an outer track 185 of bracket 173. For example, without wishing to be limited to any particular dimensions, brackets 171 and 173 may be spaced apart so as to receive cassettes whose opposite edges are separated by a distance of approximately 40 inches.

Although not included in the present embodiment, a mounting plate may be inserted into panel 151 or between panel 151 and cover 153 to facilitate the mounting of brackets 171 and 173 to cover 153.

Figure 10A:
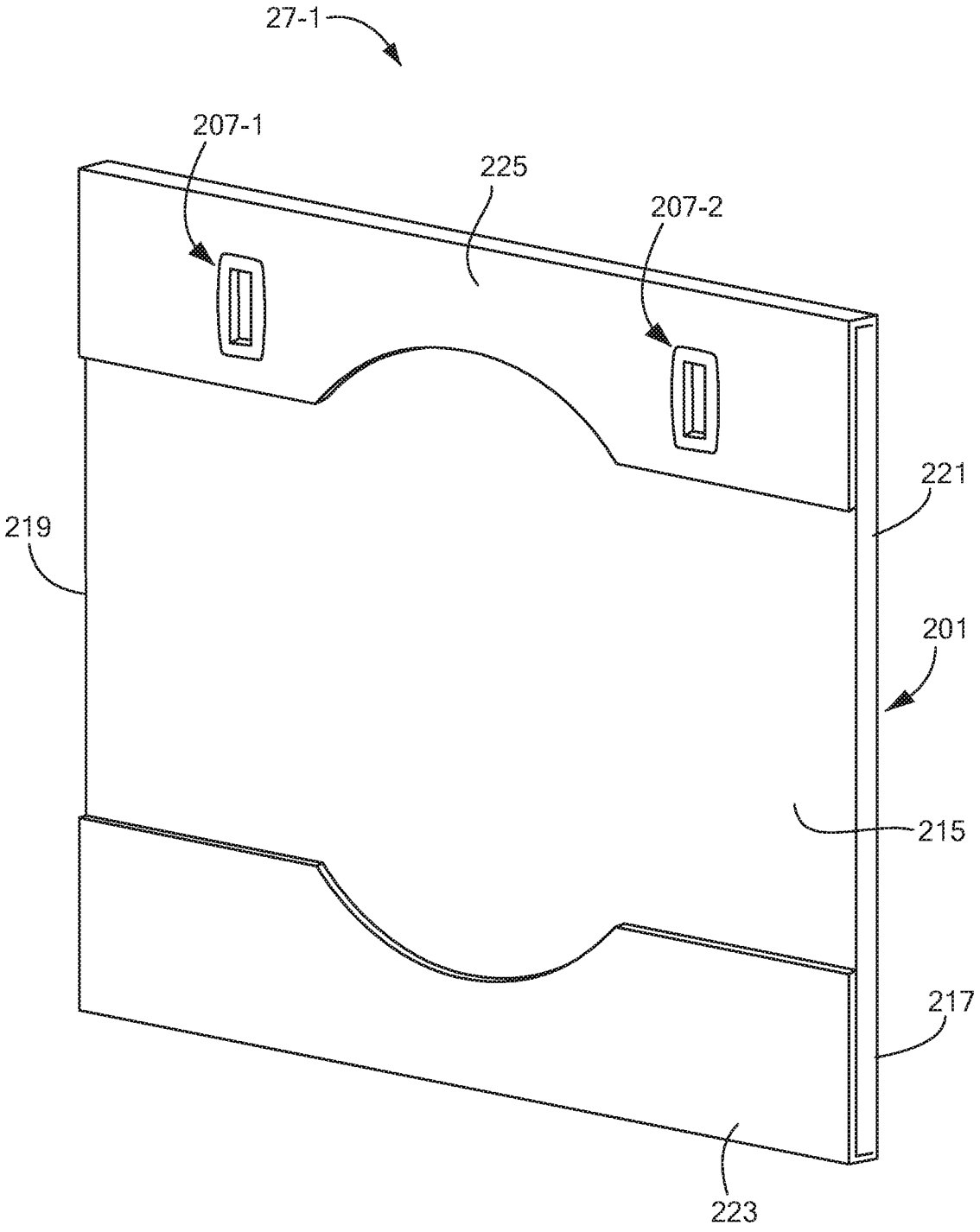
FIGS. 10(*a*) through 10(*c*) are enlarged front perspective, enlarged rear perspective and enlarged partially exploded front perspective views, respectively, of one of the plurality of inner cassettes shown in FIG. 2.
Figure 10B:
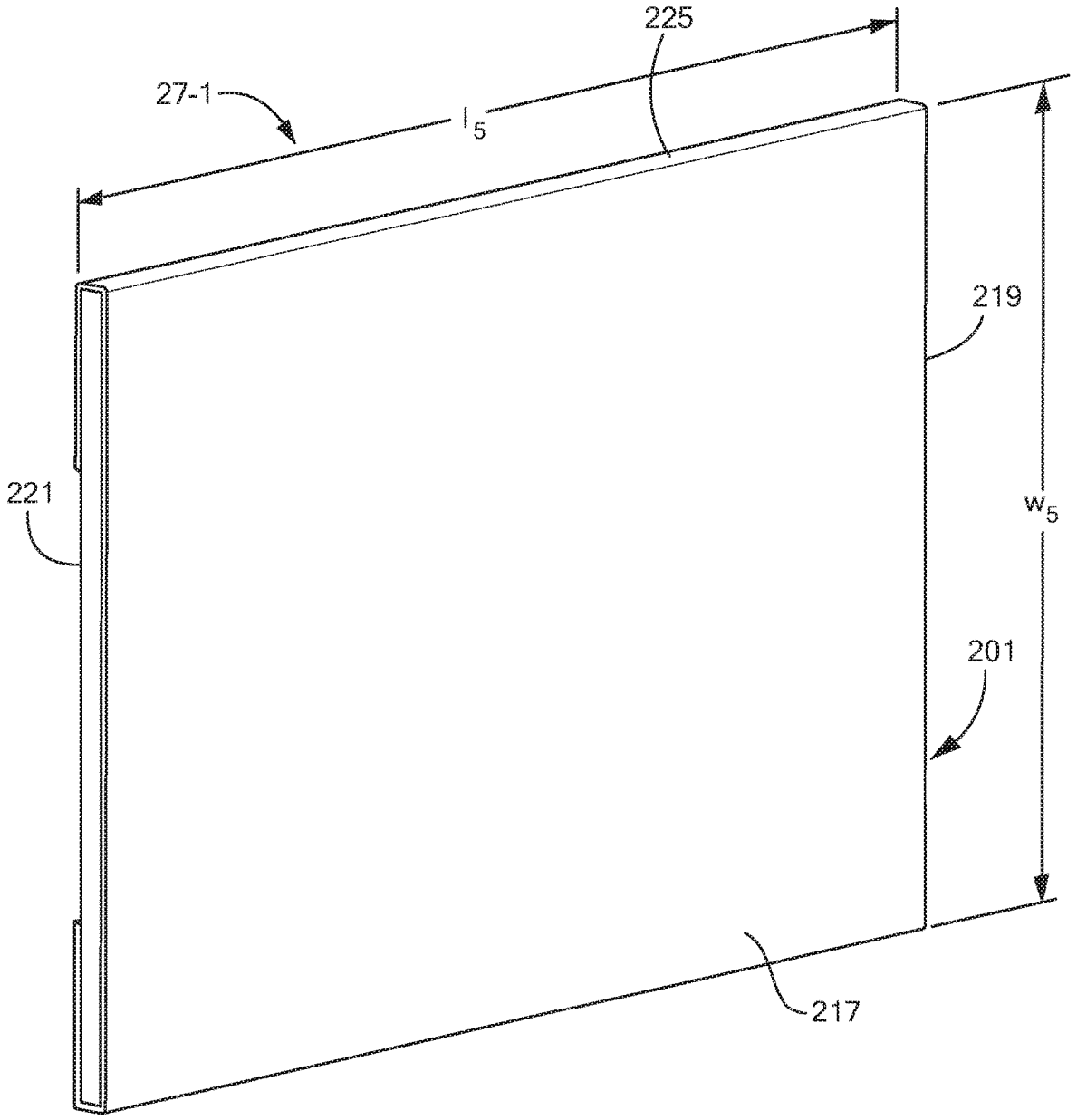
Figure 10C:
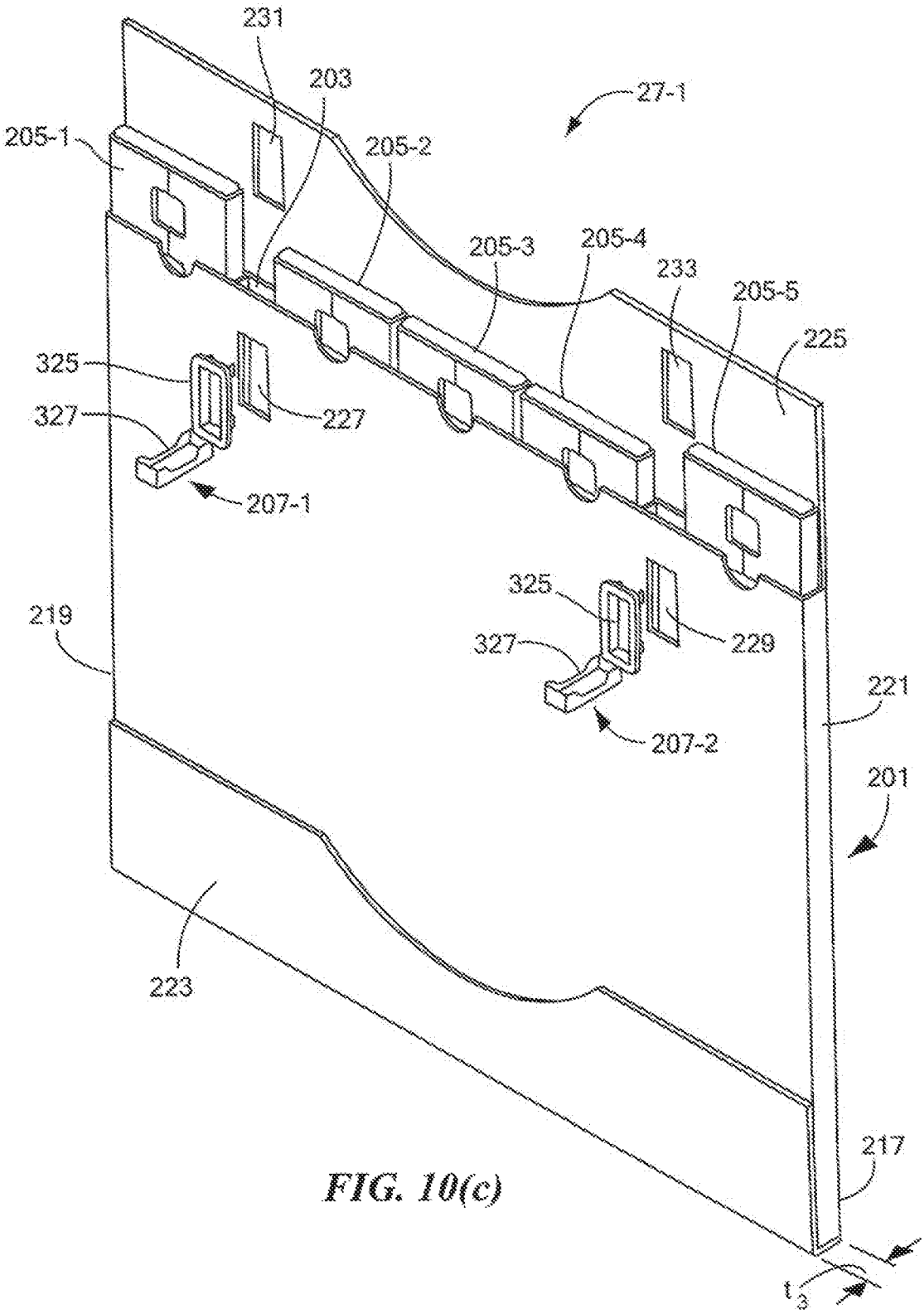
Figure 11A:
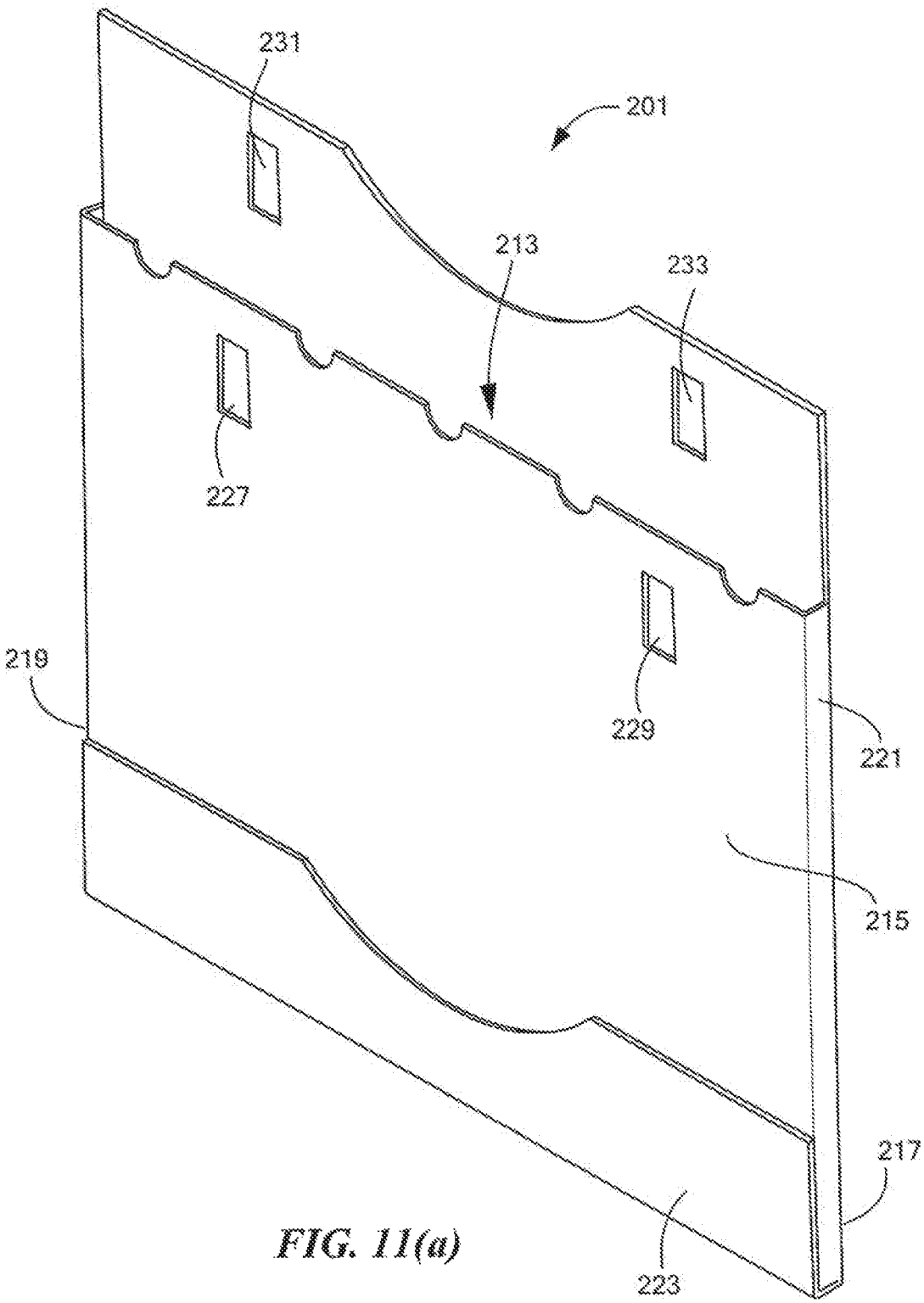
FIGS. 11(*a*) through 11(*d*) are enlarged front perspective, enlarged rear perspective, enlarged top, and enlarged right side views, respectively, of the container for the inner cassette shown in FIGS. 10(*a*) through 10(*c*), the container being shown with its top end open.
Figure 11D:
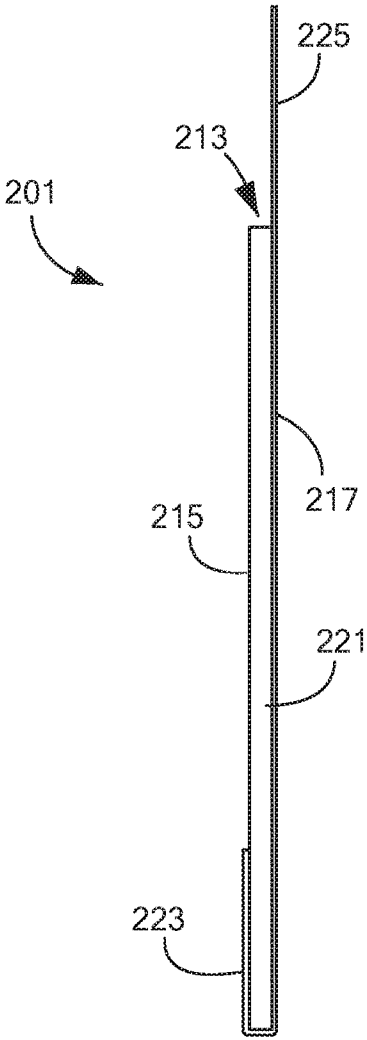
Figure 11B:
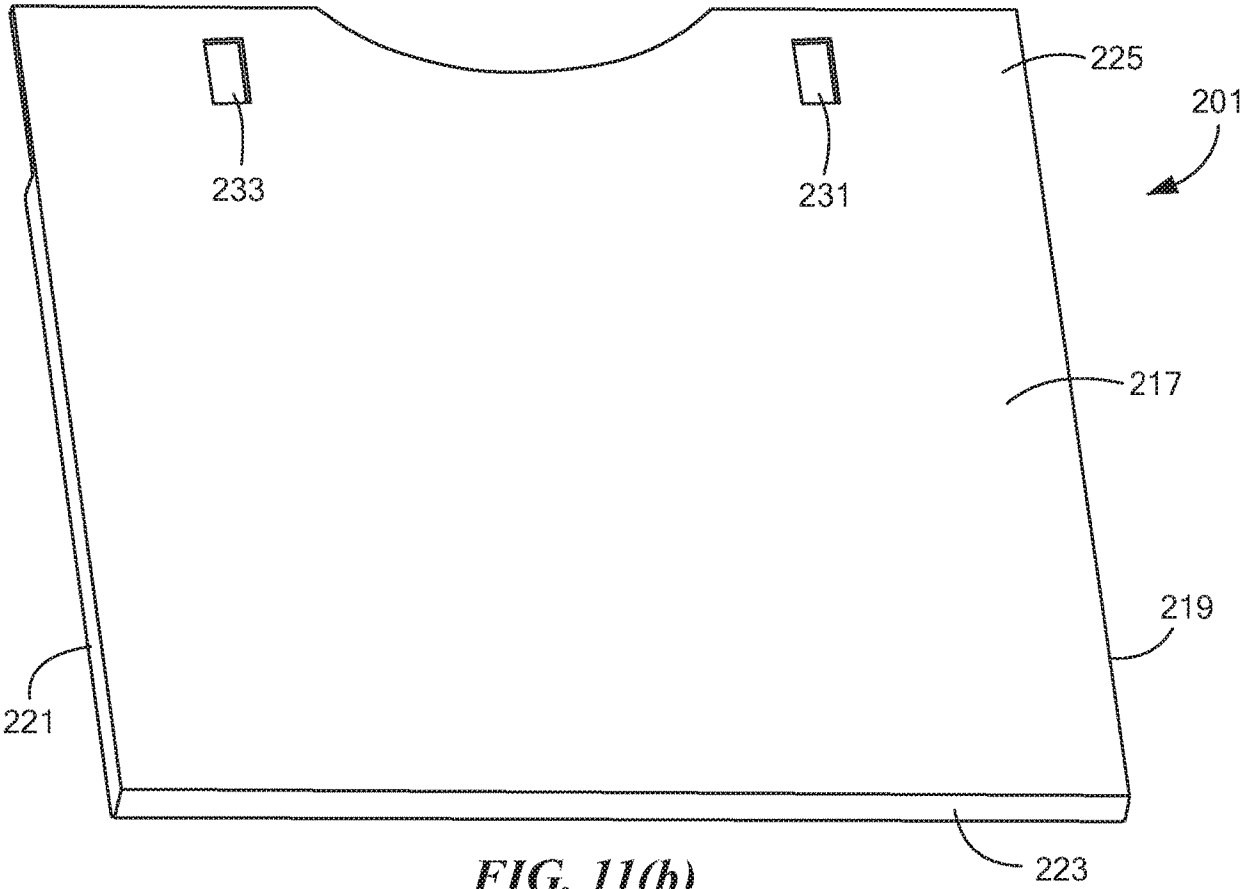
Figure 11C:
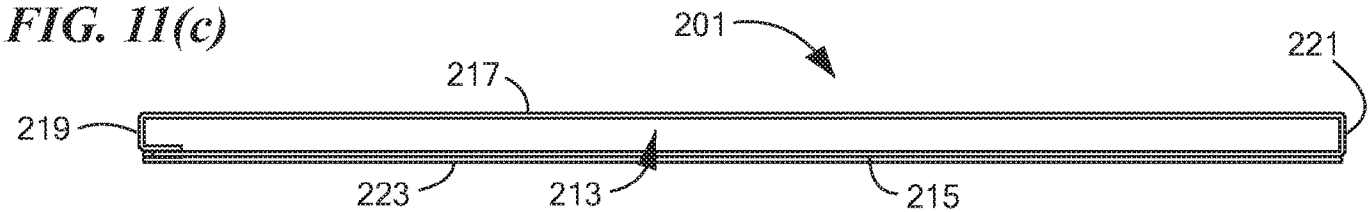

Inner cassettes 27-1 through 27-5 may be identical to one another and, in the present embodiment, are, in fact, identical to one another. Referring now to FIGS. 10(*a*) through 10(*c*), inner cassette 27-1 is shown in greater detail. As can be seen, inner cassette 27-1 may comprise a container 201, a divider 203, a plurality of sleeves 205-1 through 205-5, and a pair of combination container closure and handle assemblies 207-1 and 207-2.

Without wishing to be limited to any particular dimensions, inner cassette 27-1 may have a length $l_5$ of approximately 48 inches, a width $w_5$ of approximately 40 inches, and a thickness $t_3$ of approximately 1.75 inches.

Container 201, which is also shown separately in FIGS. 11(*a*) through 11(*d*), may be made from one or more sheets of cut, scored, folded, and adhered corrugated cardboard or another similarly suitable material. Container 201 may be shaped to include a generally rectangular prismatic cavity 213 bounded by a front wall 215, a rear wall 217, a left wall 219, a right wall 221, a bottom closure member 223, and a top closure member 225. Front wall 215 may be shaped to include a pair of openings 227 and 229 for receiving portions of assemblies 207-1 and 207-2, and top closure member 225 may be shaped to include corresponding openings 231 and 233 for a similar purpose.

Figure 12A:
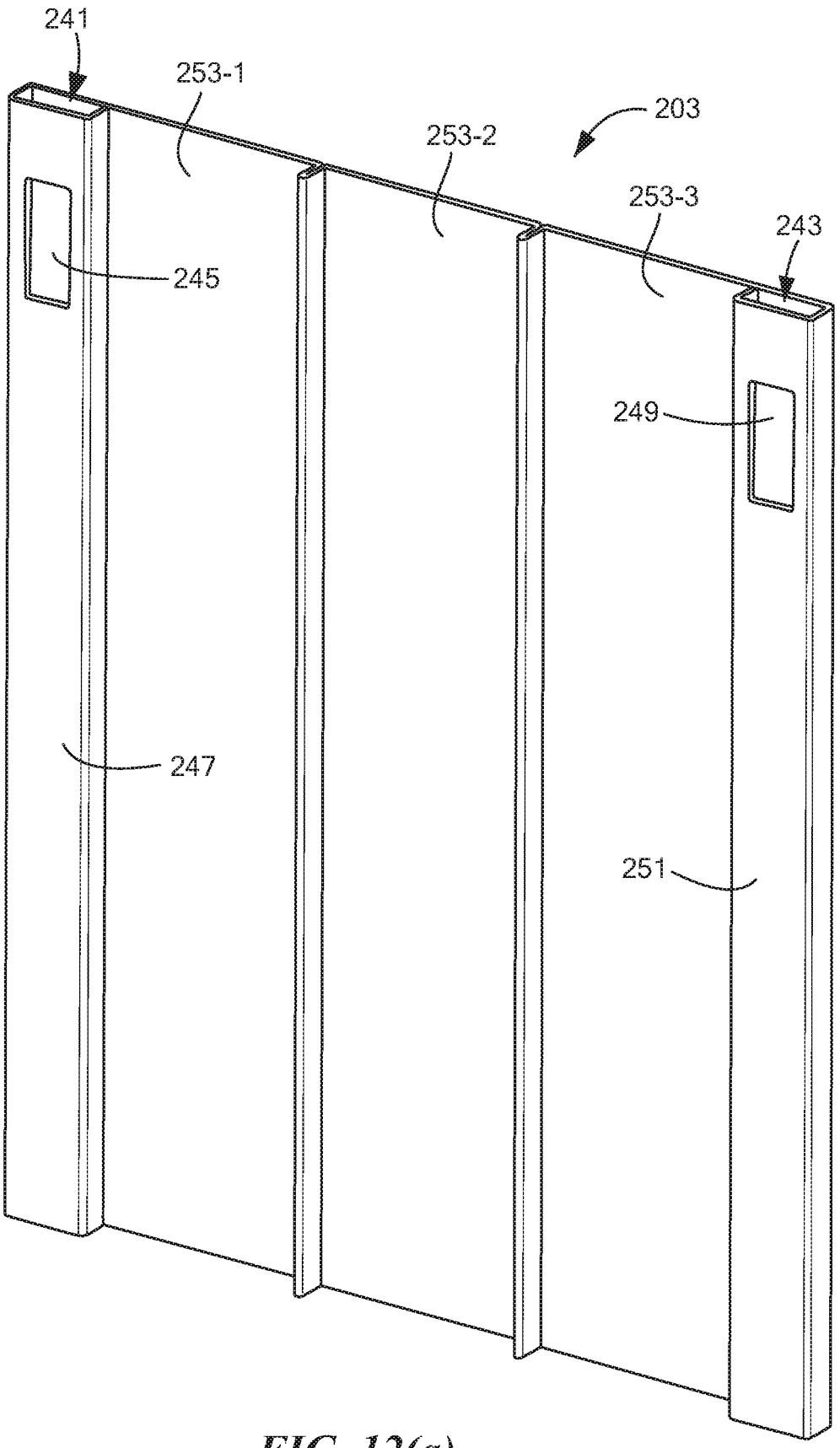
FIGS. 12(*a*) and 12(*b*) are enlarged front perspective and enlarged rear perspective views, respectively, of the divider for the inner cassette shown in FIGS. 10(*a*) through 10(*c*)
Figure 12B:
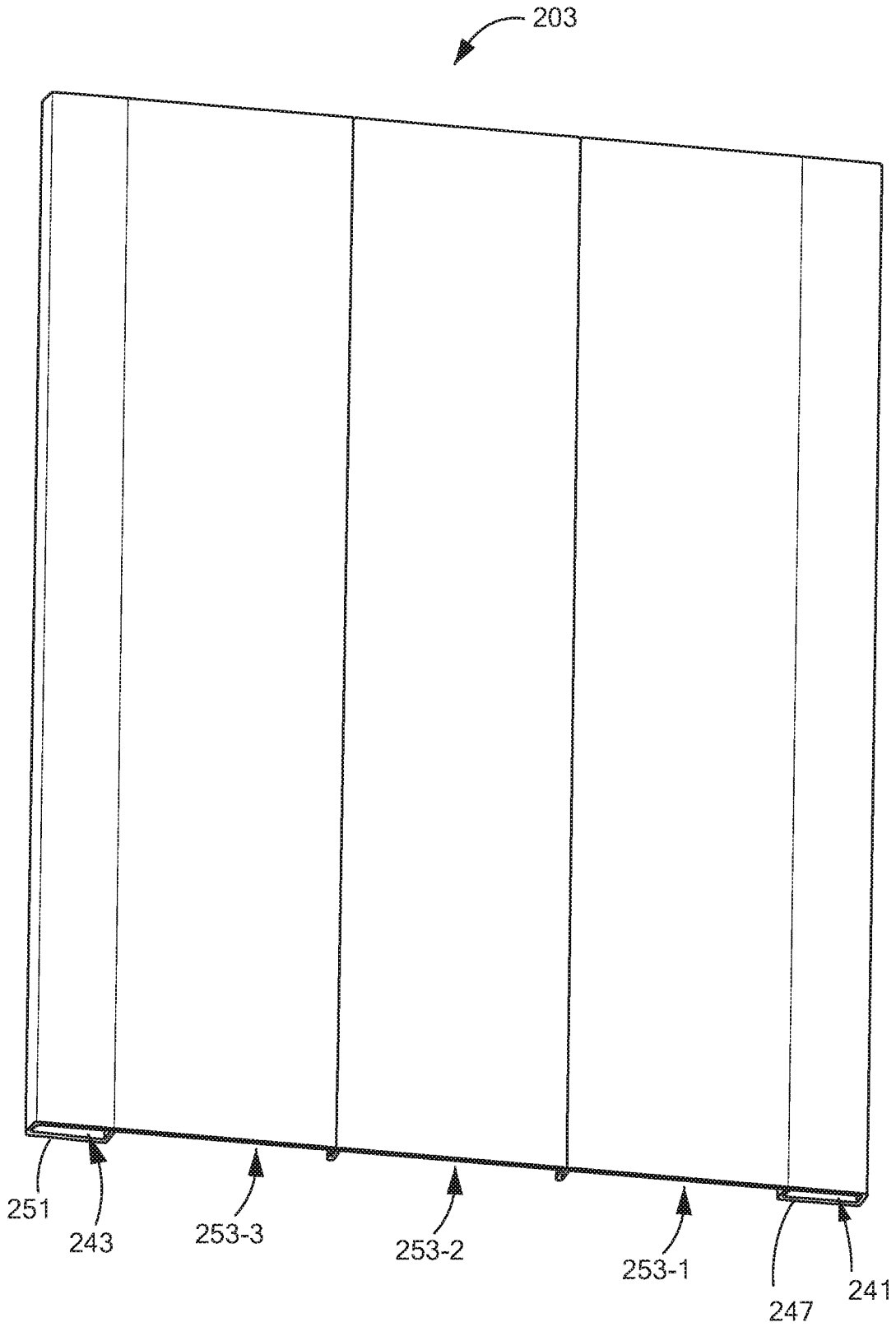

Divider 203, which is also shown separately in FIGS. 12(*a*) and 12(*b*), may be made from one or more sheets of cut, scored, folded, and adhered corrugated cardboard or another similarly suitable material. Divider 203, which may be disposed within cavity 213 of container 201, may be shaped to include a pair of hollow, generally rectangular prismatic compartments 241 and 243. An opening 245 may be provided on a front wall 247 of compartment 241 for receiving a portion of assembly 207-1, and an opening 249 may be provided on a front wall 251 of compartment 243 for receiving a portion of assembly 207-2. Divider 203 may be shaped to further include a plurality of tracks 253-1, 253-2 and 253-3 positioned between compartments 241 and 243. In this manner, with divider 203 positioned within cavity 213 of container 201, sleeves 205-2, 205-3 and 205-4 may be received in tracks 253-1, 253-2 and 253-3, respectively, sleeve 205-1 may be received in the remaining space between compartment 241 and left wall 217 of container 201, and sleeve 205-5 may be received in the remaining space between compartment 243 and right wall 219 of container 201.

Figures 13A, 13B:
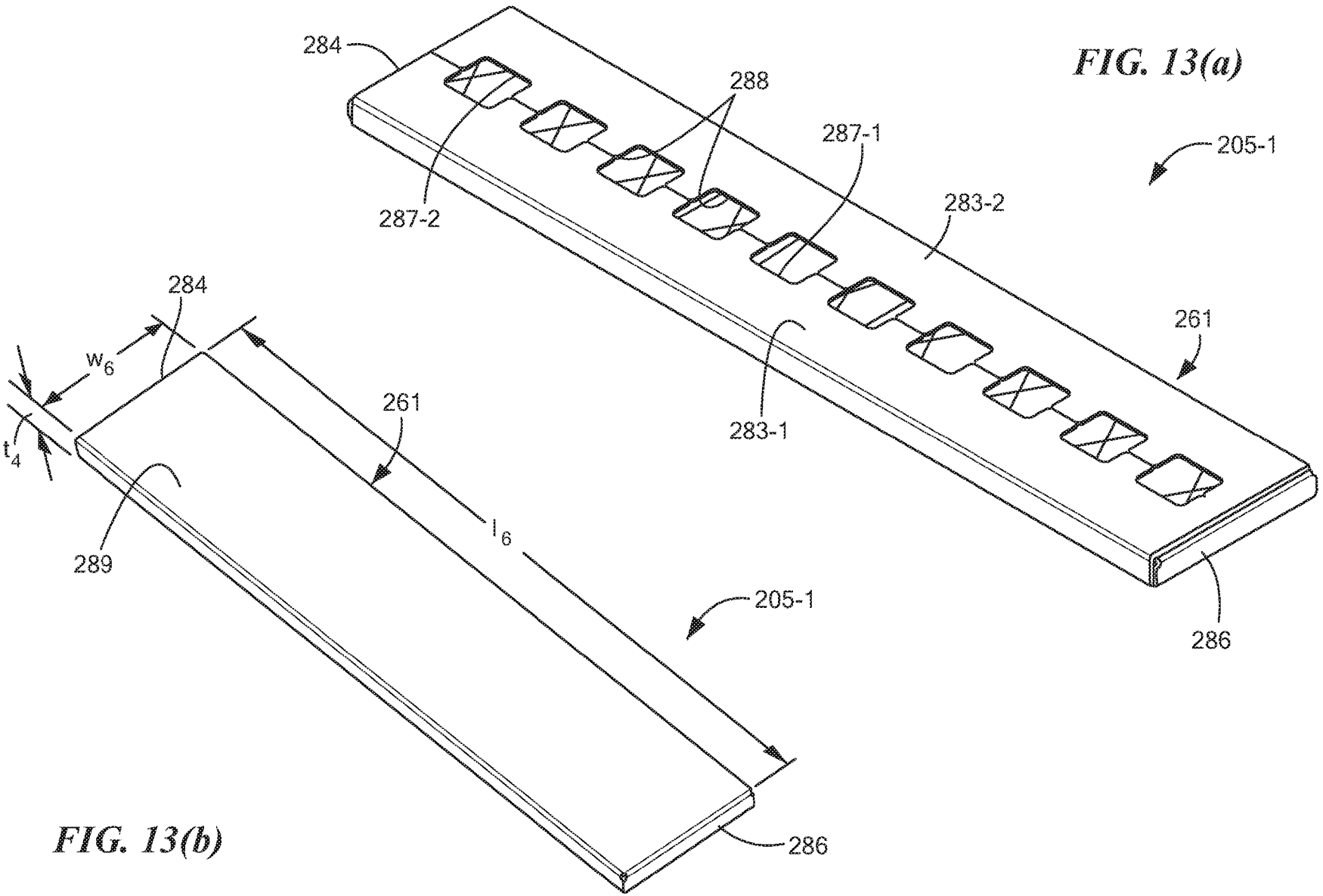
FIGS. 13(*a*) through 13(*c*) are enlarged front perspective, enlarged rear perspective, and enlarged partially exploded perspective views, respectively, of one of the temperature-control sleeves for the inner cassette shown in FIGS. 10(*a*) through 10(*c*)
Figure 13C:
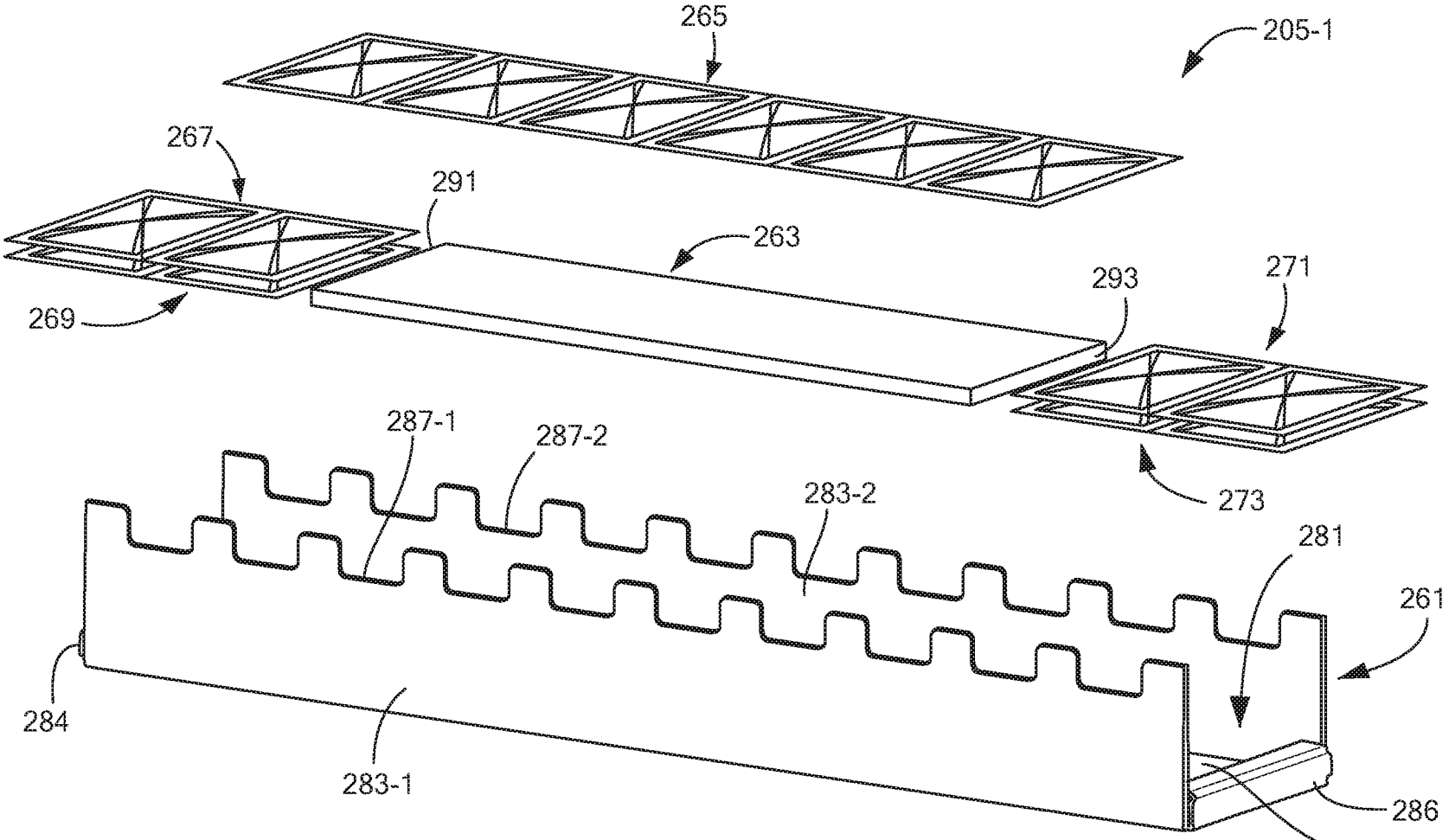

Sleeves 205-1 and 205-5 may be identical to one another and, in the present embodiment, are, in fact, identical to one another. Sleeve 205-1, which is also shown separately in FIGS. 13(*a*) through 13(*c*), may comprise a container 261, an insulating member 263, a first temperature-control member 265, a second temperature-control member 267, a third temperature-control member 269, a fourth temperature-control member 271, and a fifth temperature-control member 273.

Container 261, which may comprise a box of corrugated cardboard or another similarly suitable material, may be shaped to include a generally rectangular prismatic cavity 281 that may be accessible through a pair of front closure flaps 283-1 and 283-2 extending between a first closed end 284 of container 261 and a second closed end 286 of container 261. Flaps 283-1 and 283-2 may have opposing edges 287-1 and 287-2, respectively, with matching stepped shapes so as to jointly define a plurality of windows 288, the purpose of which will be discussed below.

Insulating member 263, which may be a block of expanded polystyrene or another similarly suitable material, may be disposed within cavity 281 of container 261. Insulating member 263 may be appropriately dimensioned to have a length that is substantially shorter than the length of cavity 281. In addition, insulating member 263 may be positioned against a back wall 289 of container 261 and may be centered between first end 284 of container 261 and second end 286 of container 261. (Insulating member 263 may be secured in the above-mentioned position by an adhesive or other suitable means.) In this manner, a first end 291 of insulating member 263 and first end 284 of container 261 may jointly define a space that may be used to receive a stacked arrangement of second temperature-control member 267 and third temperature-control member 269, and a second end 293 of insulating member 263 and second end 286 of container 261 may jointly define a space that may be used to receive a stacked arrangement of fourth temperature-control member 271 and fifth temperature-control member 273.

First temperature-control member 265 may comprise a quantity of a phase-change material positioned within a suitable container. For example, the phase-change material may comprise any phase-change material including any water-based phase-change material or organic phase-change material. In a preferred embodiment, the phase-change material may be a gelled organic phase-change material of the type disclosed in U.S. Patent Application Publication No. US 2014/0290285 A1, inventors Formato et al., published Oct. 2, 2014, the disclosure of which is incorporated herein by reference. More specifically, such a phase-change material may be formed by mixing one or more n-alkanes, such as n-tetradecane (C14), n-pentadecane (C15), n-hexadecane (C16), and n-octadecane (C18), with a gelling agent in the form of a styrene-ethylene-butylene-styrene triblock copolymer or a styrene-ethylene-propylene-styrene triblock copolymer. Examples of the aforementioned gelling agent may include one or more of Kraton™ G1651 copolymer (a high molecular weight SEBS tri-block copolymer with a styrene:rubber ratio of 30:70% by weight), Kraton™ G1654 copolymer (a high molecular weight SEBS tri-block copolymer with a styrene:rubber ratio of 33:67% by weight), or Kraton™ G1660 copolymer (an SEBS tri-block copolymer with a styrene:rubber ratio of 31:69% by weight), or an SEPS copolymer, such as, but not limited to, SEPTON™ S2005 copolymer (a high molecular weight SEPS tri-block copolymer with a styrene:rubber ratio of 20:80% by weight). The mixing of the above-described one or more n-alkanes and the above-described gelling agent may take place at a first temperature at which the at least one n-alkane is in a liquid state and which is below the flashpoint of the at least one n-alkane and at which the mixture is not a viscoelastic liquid, whereby a non-homogeneous mixture is produced; then, heating the non-homogenous mixture to a second temperature that is below the flashpoint of the at least one n-alkane and at which a viscoelastic liquid is formed; and, then, cooling the viscoelastic liquid to room temperature.

Examples of gelled organic phase-change materials that may be suitable for use as phase-change material may include the following (the phase-change temperatures reported below being approximate and, in some cases, spanning a range of 1.5° C. to 2.0° C.):

| Example No. | Phase-Change Temperature | % N-Alkane | Composition of N-Alkane(s) | % Gelling Agent | Composition of Gelling Agent |
|---|---|---|---|---|---|
| 1 | 3° C. | 92.6% | 96.5% C14 and 3.5% C16 | 7.4% | Kraton ™ G1654 powder |
| 2 | 3° C. | 92.6% | 98.5% C14 and 1.5% C16 | 7.4% | Kraton ™ G1654 powder |
| 3 | 5° C. | 92.6% | 100% C14 | 7.4% | Kraton ™ G1654 powder |
| 4 | 7° C. | 92.6% | 38.2% C14 and 61.8% C16 | 7.4% | Kraton ™ G1654 powder |
| 5 | 7° C. | 92.6% | 16% C14 and 84% C15 | 7.4% | Kraton ™ G1654 powder |
| 6 | 17° C. | 92.6% | 100% C16 | 7.4% | Kraton ™ G1654 powder |
| 7 | 24° C. | 92.6% | 10.5% C16 and 89.5% C18 | 7.4% | Kraton ™ G1654 powder |

The gelled organic phase-change materials of the above-identified Examples were prepared by placing the above-described mixtures into a pre-heated oven operating at 50° C. for a period of 2.5 hours and then removing the mixtures from the oven and allowing the mixtures to cool to room temperature. Some of the properties of temperature-control members including the resulting mixtures are presented below.

| Example No. | Avg. Thickness (inches) | Measured THAW Phase-Change Temp (Deg C.) | Measured FREEZE Phase-Change Temp (Deg C.) | 12 Freeze/Thaw Cycle Syneresis (% weight) | Compressive Modulus (psi) |
|---|---|---|---|---|---|
| 1 | 0.466 | 4.18 | 1.89 | 0.0 | Not tested |
| 2 | 0.473 | 4.26 | 3.28 | 0.0 | Not tested |
| 3 | 0.508 | 5.27 | 4.27 | <0.5 (8 cycles) | 4.09 |
| 4 | 0.479 | 7.78 | 7.79 | 0.0 | Not tested |
| 5 | 0.502 | 7.42 | 7.03 | 0.0 | Not tested |
| 6 | 0.475 | 17.46 | 16.95 | 0.0 | Not tested |
| 7 | Not tested | Not tested | Not tested | Not tested | Not tested |

Gelled organic phase-change materials of the type described above possess many desirable attributes. For example, such gelled materials are capable of conforming to virtually any shaped pouch or other receptacle therefor while, at the same time, being less susceptible to leaking than liquid phase-change materials. In addition, such gelled materials possess good shock absorption and, therefore, provide physical protection to a payload covered thereby. Additionally, such gelled materials are capable of surviving many freeze/thaw cycles while maintaining good performance as a phase-change material. Moreover, such gelled materials possess excellent compression strength—even when placed under a payload (as in certain embodiments discussed below). Furthermore, the above-described gelled phase-change materials tend to cover more surface area of a product load than do an equivalent amount of a liquid phase-change material, especially when the phase-change material is oriented vertically. This is because liquid phase-change materials tend to flow to the bottom of the receptacle containing the liquid phase-change material. Consequently, orienting the receptacle vertically tends to cause a significant portion of the liquid phase-change material to pool at the bottom of the receptacle. (This problem may persist, albeit to a lesser extent, even if the receptacle is oriented horizontally.) By contrast, the subject gelled materials tend not to flow much, if at all, to the bottom of a receptacle therefor.

The container used to hold the phase-change material may be, for example, a flexible or rigid pouch or a series of interconnected flexible or rigid pouches whose contents are sealed from one another and the environment. In the present embodiment, the container is in the form of six interconnected flexible pouches whose contents are sealed from one another. The container may be formed by thermoforming a polymer film to define a plurality of troughs and then sealing the thermoformed film to a flat polymer film around their respective peripheries and in the spaces between the troughs of the thermoformed film. The sealing together of the two polymer films is preferably performed after phase-change material has been loaded into the troughs. As can be appreciated, the thermoforming, loading, and sealing steps may be performed as part of a continuous manufacturing process or may be performed batch-wise.

Preferably, each pouch of the six interconnected pouches of first temperature-control member 265 contains approximately the same quantity of the same type of phase-change material. In the present embodiment, the phase-change material preferably has a phase-change temperature of approximately +3° C. and may have, for example, the composition of Example 2 above.

Second temperature-control member 267, third temperature-control member 269, fourth temperature-control member 271, and fifth temperature-control member 273 may be identical to one another and may differ from first temperature-control member 265 only in that each of second temperature-control member 267, third temperature-control member 269, fourth temperature-control member 271, and fifth temperature-control member 273 may comprise two interconnected, yet sealed, pouches, as opposed to the six interconnected, yet sealed, pouches of first temperature-control member 265, and in that the type of phase-change material in temperature-control members 267, 269, 271 and 273 may differ from that of temperature-control member 265. More specifically, whereas temperature-control member 265 may comprise a first gelled organic phase-change material having a comparatively lesser latent heat, temperature-control members 267, 269, 271 and 273 may comprise a second gelled organic phase-change material having a comparatively greater latent heat. In the present embodiment, the phase-change material of temperature-control members 267, 269, 271 and 273 may have a phase-change temperature of approximately +5° C. and may have, for example, the composition of Example 3 above.

Preferably, the combined thickness of insulating member 263 and first temperature-control member 265 is approximately equal to the combined thickness of second temperature-control member 267 and third temperature-control member 269 and is approximately equal to the combined thickness of fourth temperature-control member 271 and fifth temperature-control member 273. In this manner, sleeve 205-1 may position more phase-change material at the respective ends of sleeve 205-1 than at the intermediate portion of sleeve 205-1. This may be desirable as the corners of the payload volume tend to be the locations where undesired thermal incursions are most likely; consequently, positioning more phase-change material at these locations may counter this effect.

To keep first temperature-control member 265, second temperature-control member 267 and fourth temperature-control member 271 from moving when sleeve 205-1 is positioned vertically, one may secure the foregoing temperature-control members to container 201 by applying one or more strips of adhesive tape (not shown) across windows 288.

Without wishing to be limited to any particular dimensions, sleeve 205-1 may have a length $l_6$ of approximately 39.375 inches, a width $w_6$ of approximately 8 inches, and a thickness $t_4$ of approximately 1.375 inches.

Figure 14:
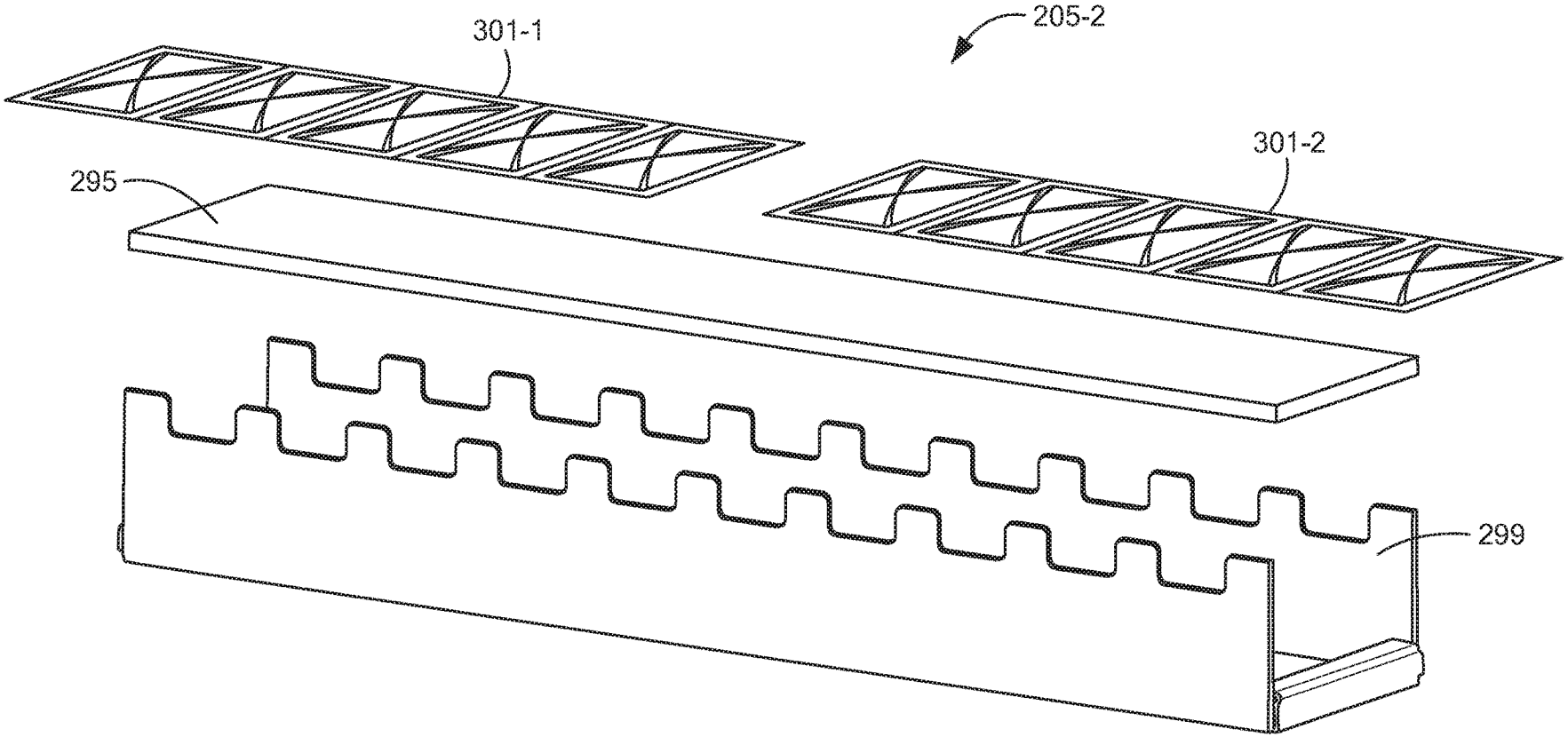
FIG. 14 is an enlarged partially exploded perspective views, respectively, of another one of the temperature-control sleeves for the inner cassette shown in FIGS. 10(*a*) through 10(*c*)

Sleeves 205-2 through 205-4 may be identical to one another and, in the present embodiment, are, in fact, identical to one another. Sleeve 205-2, which is also shown separately in FIG. 14, may be similar in many respects to sleeve 205-1. Notwithstanding the above, one significant difference between the two sleeves may be that, whereas sleeve 205-1 may comprise an insulating member 263 that is substantially shorter in length than cavity 281 of container 261, sleeve 205-2 may comprise an insulating member 295 that is approximately equal in length to the cavity of its container 299. Another significant difference between the two sleeves may be that, whereas sleeve 205-1 may comprise temperature-control members 265, 267, 269, 271 and 273 that collectively provide two layers of phase-change material beyond the ends of insulating member 263 and a single layer of phase-change material over insulating member 263, sleeve 205-2 may comprise temperature control members 301-1 and 301-2 that collectively provide a single layer of phase-change material over substantially the entire length of insulating member 295. More specifically, each of temperature control members 301-1 and 301-2 may comprise five interconnected, yet sealed, pouches, each of the pouches containing the same type and quantity of phase-change material present in each of the pouches of temperature-control member 265.

Sleeves 205-2 through 205-4 may have overall dimensions substantially the same as sleeves 205-1 and 205-5.

As can readily be appreciated, because of the construction of sleeves 205-1 through 205-2, inner cassette 27-1 provides greater thermal protection at its four corners than elsewhere. This is by design as the greatest thermal weakness for the six walls is typically at their corners.

It is to be understood that the number of sleeves in inner cassette 27-1 is merely illustrative. As such, one could increase or decrease the number of sleeves in inner cassette 27-1 without departing from the teachings of the present invention. In addition, it should be understood that, although each of sleeves 205-1 and 205-5 is described above as having a greater quantity of phase-change material than is present in each of sleeves 205-2, 205-3 and 205-4, all of sleeves 205-1, 205-2, 205-3, 205-4 and 205-5 may be identical. Moreover, although each of sleeves 205-1 through 205-5 is described above as having a certain type of phase-change material or as having certain types of phase-change material, the type(s) of phase-change material may be changed.

Figure 15:
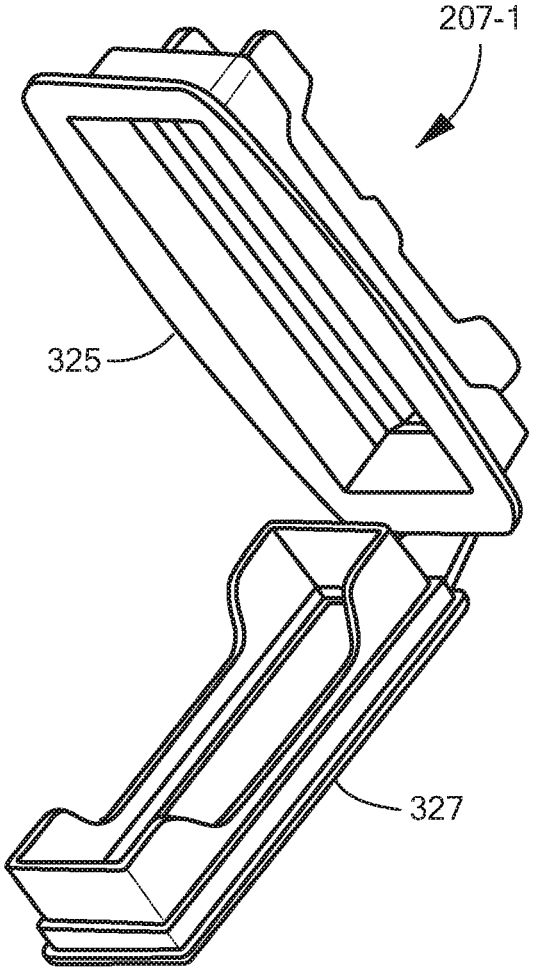
FIG. 15 is an enlarged front perspective view of one of the combination container closure and handle assemblies shown in FIG. 10(*c*), the assembly being shown in an open state.
Figure 16:
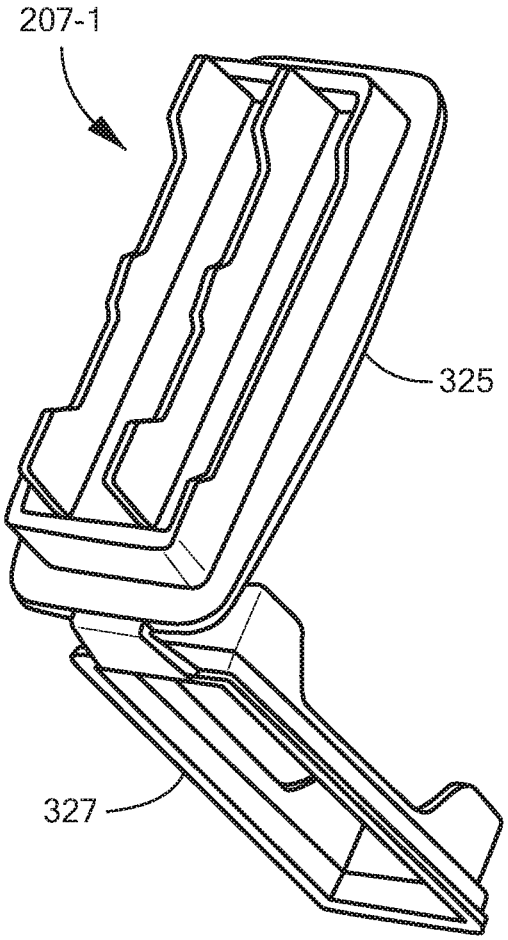
FIG. 16 is an enlarged rear perspective view of the combination container closure and handle assembly shown in FIG. 15, the assembly being shown in an open state.

Assemblies 207-1 and 207-2 may be identical to one another and, in the present embodiment, are, in fact, identical to one another. Assembly 207-1, which is shown separately in FIGS. 15 and 16, may comprise a first portion 325 that may be mounted both in opening 227 of wall 215 of container 201 and in opening 245 of front wall 247 of divider 203 and that, in so doing, may be used to secure container 201 to divider 203. Assembly 207-1 may further comprise a second portion 327 that is pivotally connected to first portion 325, that may be mounted in opening 231 of top closure member 225, and that may be received in first portion 325. Assembly 207-1 may also serve as a handle to facilitate the carrying and manipulation of cassette 27-1.

To prepare inner cassette 27-1 for use, sleeves 205-1 through 205-5 may be loaded into container 201, container 201 may be closed using assemblies 207-1 and 207-2, and inner cassette 27-1 may be pre-conditioned, as a unit, at a desired temperature, for example, at about 5° C. (Preferably, the pre-conditioning temperature and the phase-change temperature of the phase-change material in inner cassette 27-1 are within the temperature range that one wishes to maintain the payload.) Depending on the application to which system 11 is to be put and depending on the composition of the sleeves to be used as a part of inner cassette 27-1, one may pre-condition different sleeves of inner cassette 27-1 at different temperatures and then load the differently pre-conditioned sleeves into container 201. (Alternatively, if desired, inner cassette 27-1 may be sealed shut to prevent sleeves 205-1 through 205-5 from being removed therefrom.) Inner cassettes 27-2 through 27-5 may be prepared similarly to inner cassette 27-1.

Figure 17A:
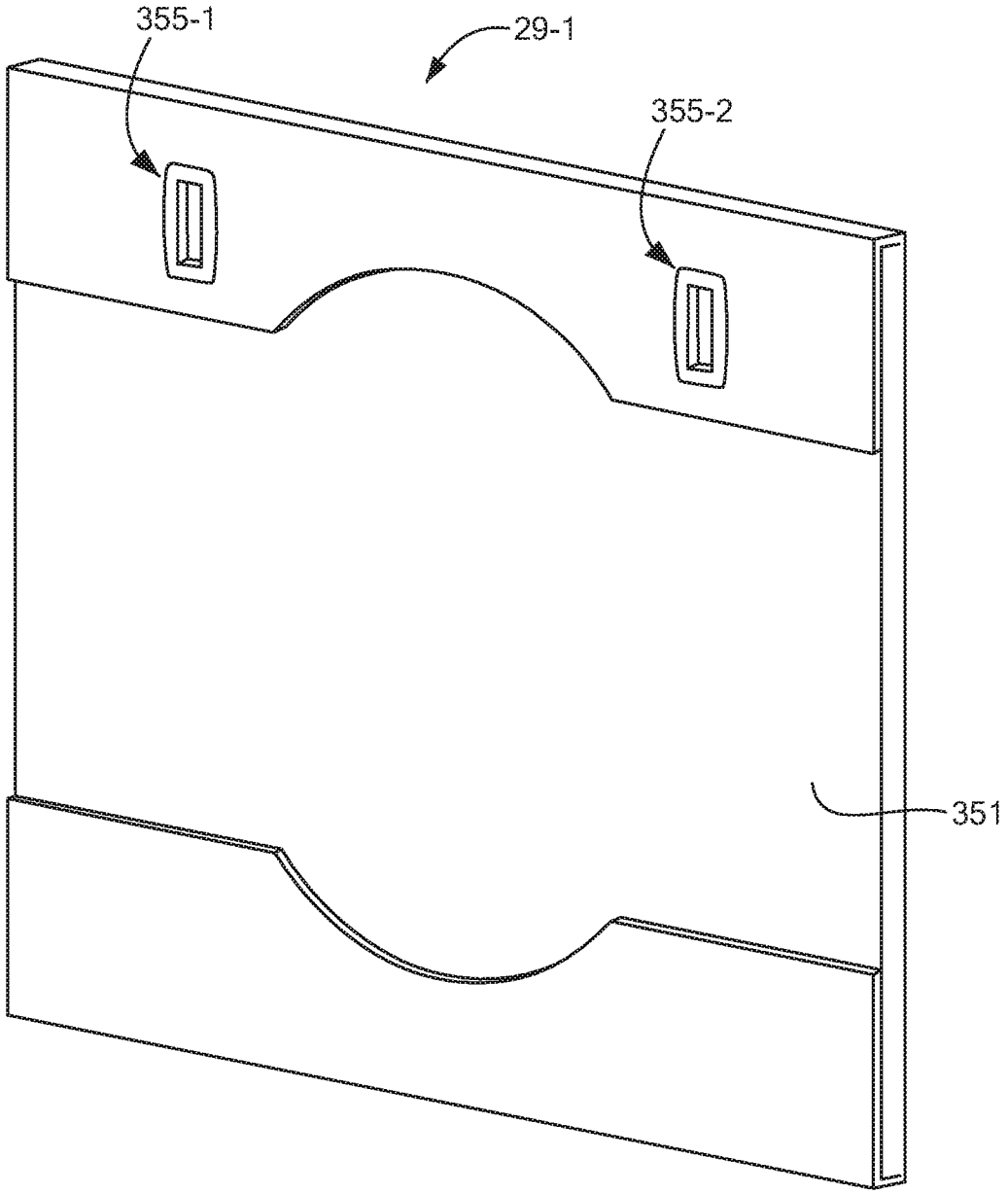
FIGS. 17(*a*) through 17(*c*) are enlarged front perspective, enlarged rear perspective, and enlarged partially exploded front perspective views, respectively, of one of the plurality of outer cassettes shown in FIG. 2.
Figure 17B:
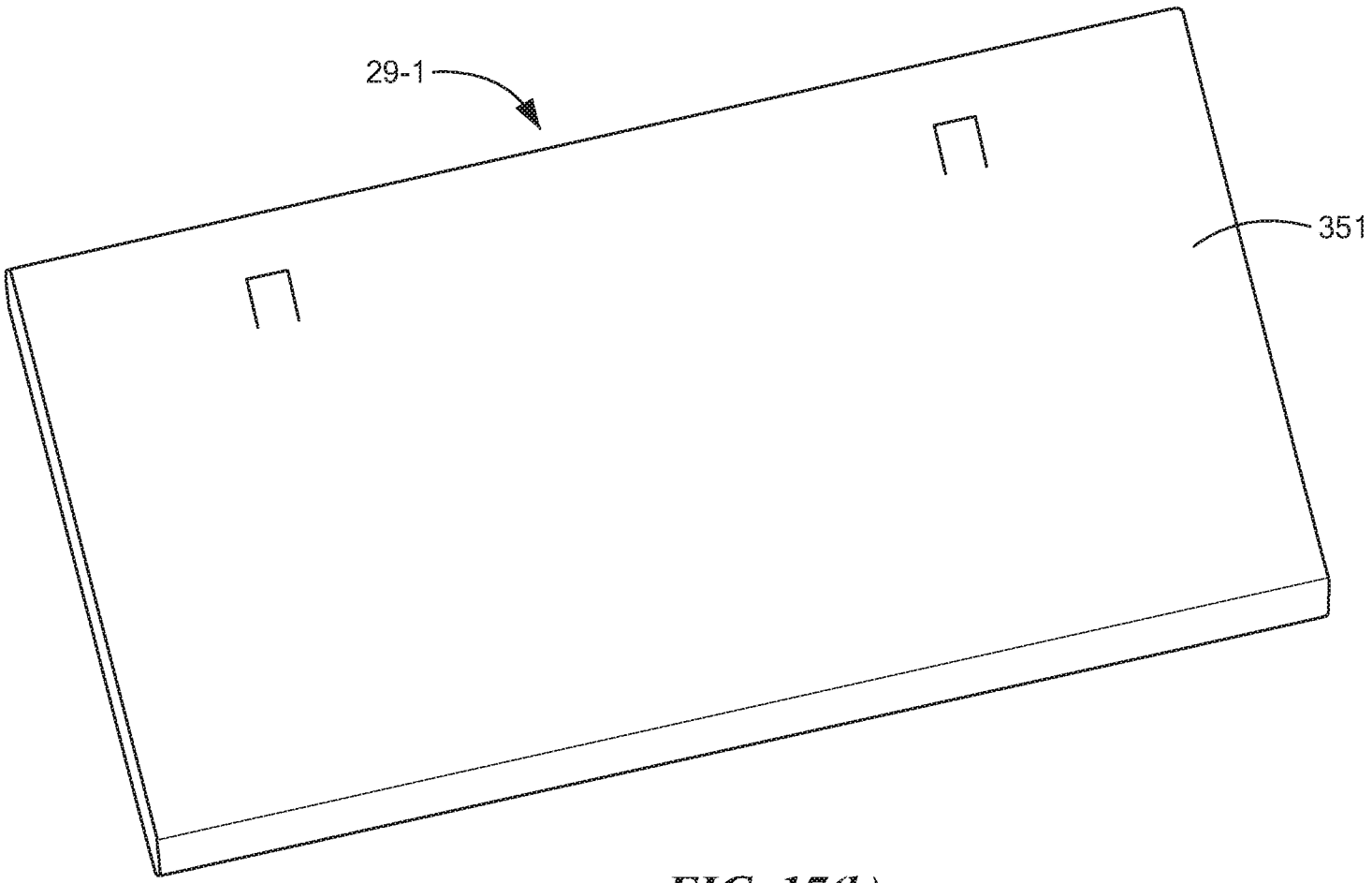
Figure 17C:
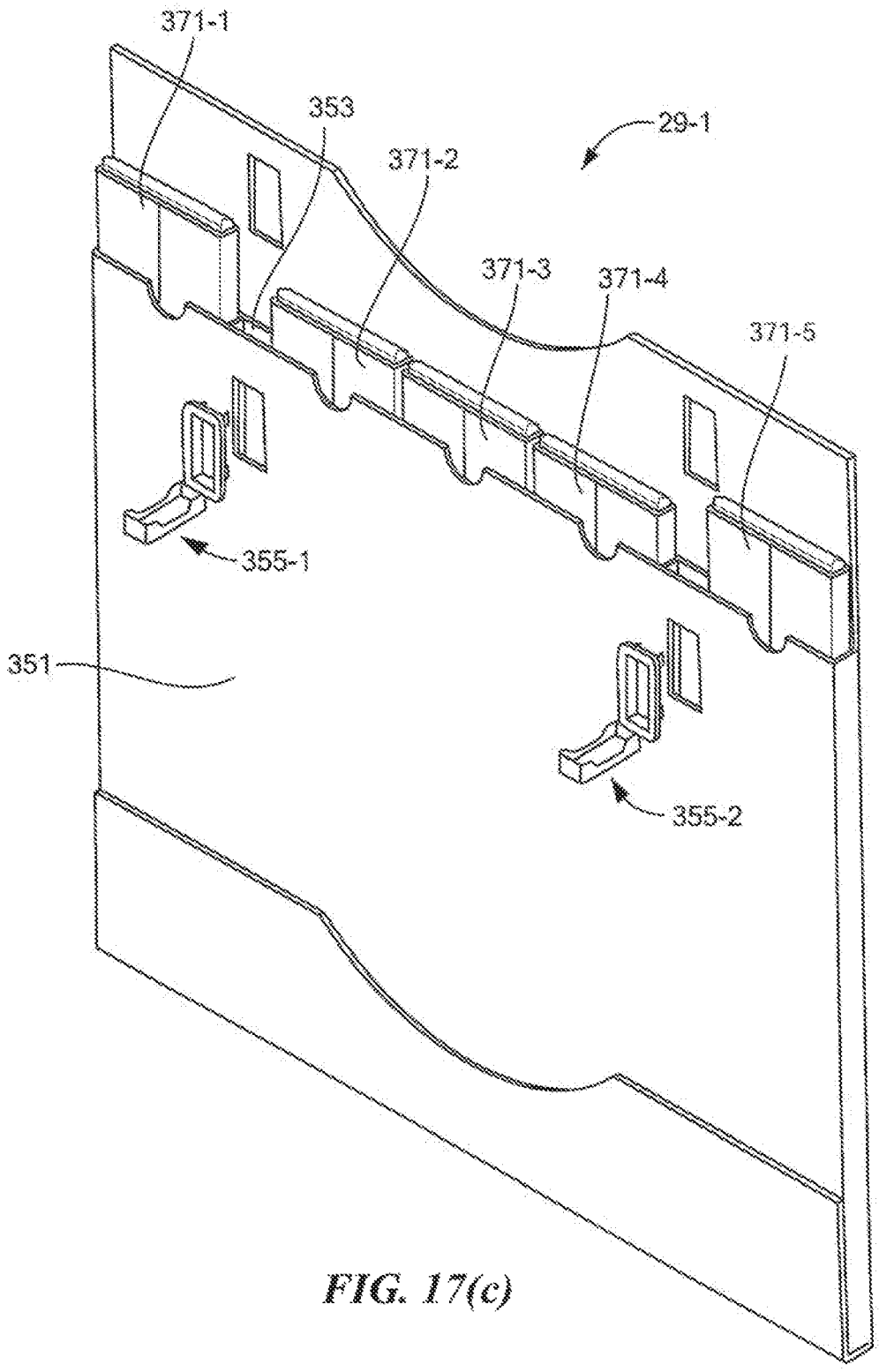

Outer cassettes 29-1 through 29-5 may be identical to one another and, in the present embodiment, are, in fact, identical to one another. Referring now to FIGS. 17(*a*) through 17(*c*), outer cassette 29-1 is shown in greater detail. Outer cassette 29-1 may be similar in many respects to inner cassette 27-1 and may have similar or identical overall dimensions thereto. In particular, outer cassette 29-1 may comprise a container 351 that may be identical to container 201 of inner cassette 27-1, may comprise a divider 353 that may be identical to divider 203 of container 201, and may comprise a pair of combination container closure and handle assemblies 355-1 and 355-2 that may be identical to assemblies 207-1 and 207-2, respectively, of container 201. Outer cassette 29-1 may differ principally from inner cassette 27-1 in that, whereas inner cassette 27-1 may comprise sleeves 205-1 through 205-5, outer cassette 29-1 may comprise sleeves 371-1 through 371-5. Sleeves 371-1 through 371-5 may have overall dimensions that are generally similar to one another and that are generally similar to those of sleeves 205-1 through 205-5.

Figure 18A:
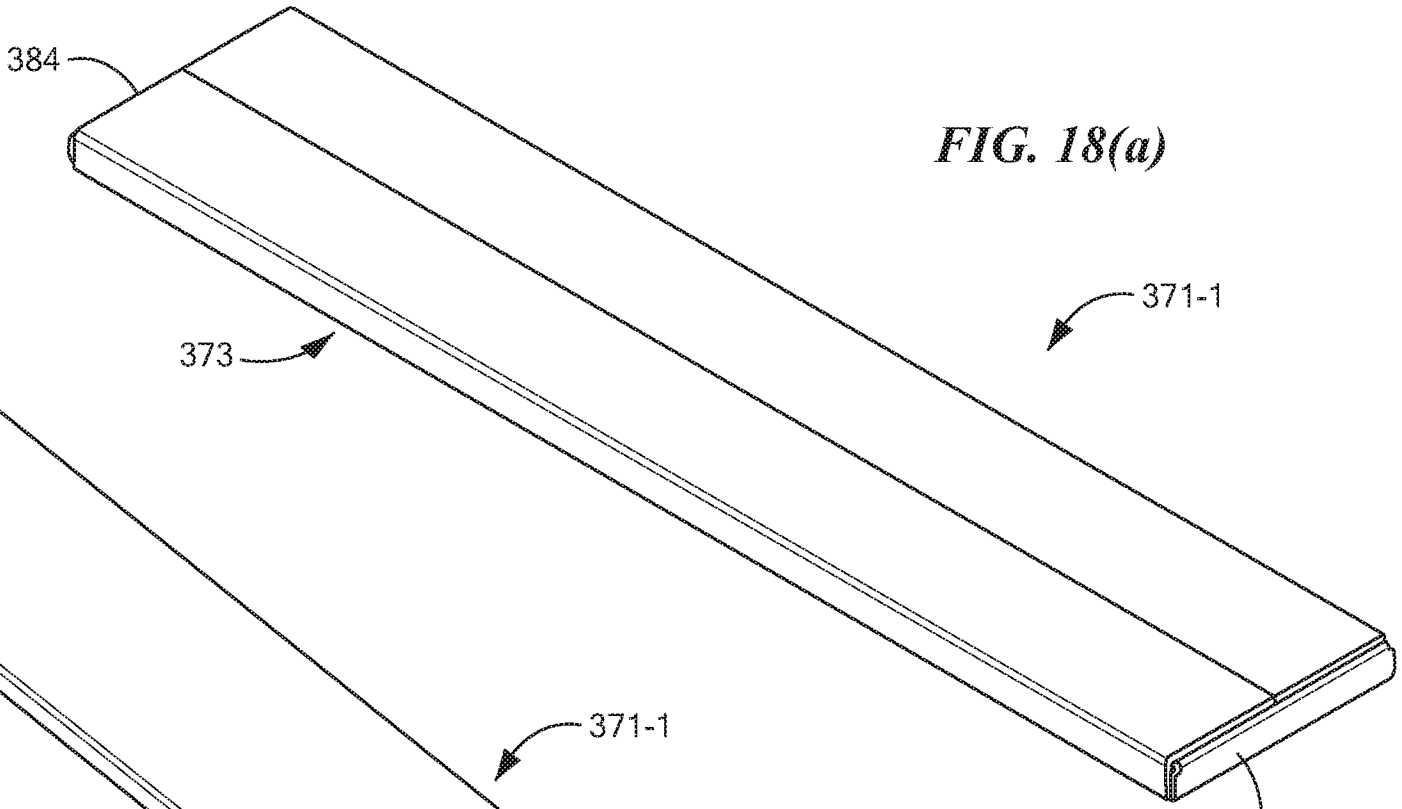
FIGS. 18(*a*) through 18(*c*) are enlarged front perspective, enlarged rear perspective, and enlarged partially exploded perspective views, respectively, of one of the temperature-control sleeves for the outer cassette shown in FIGS. 17(*a*) through 17(*c*)
Figure 18B:
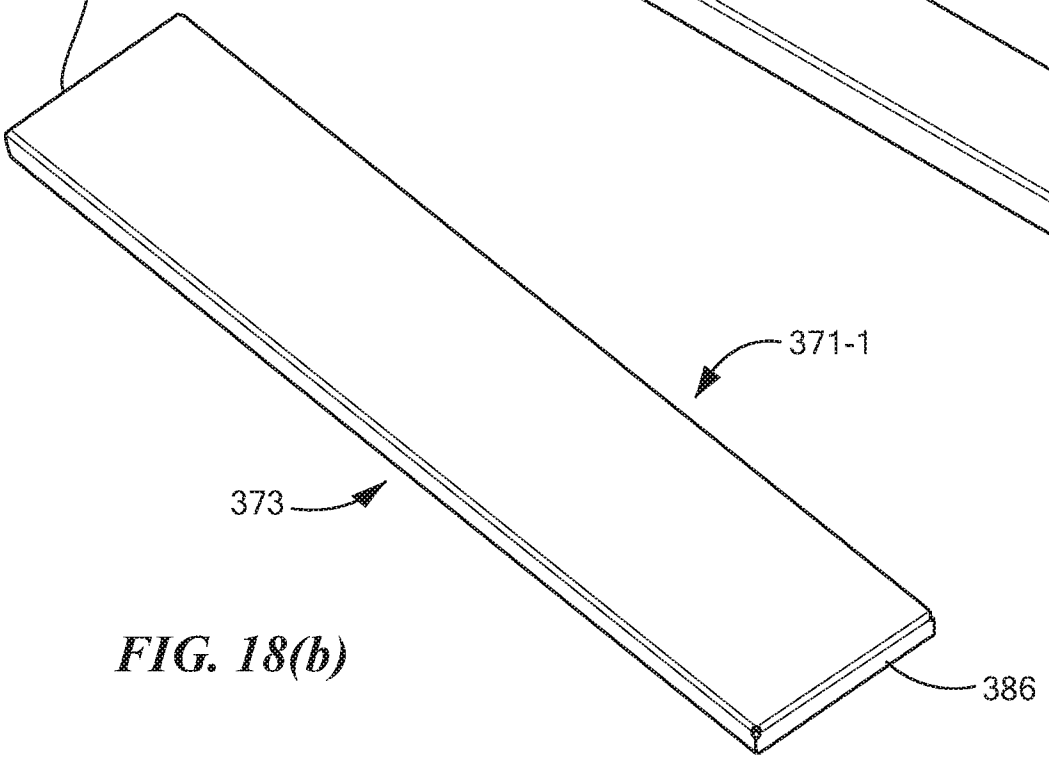
Figure 18C:
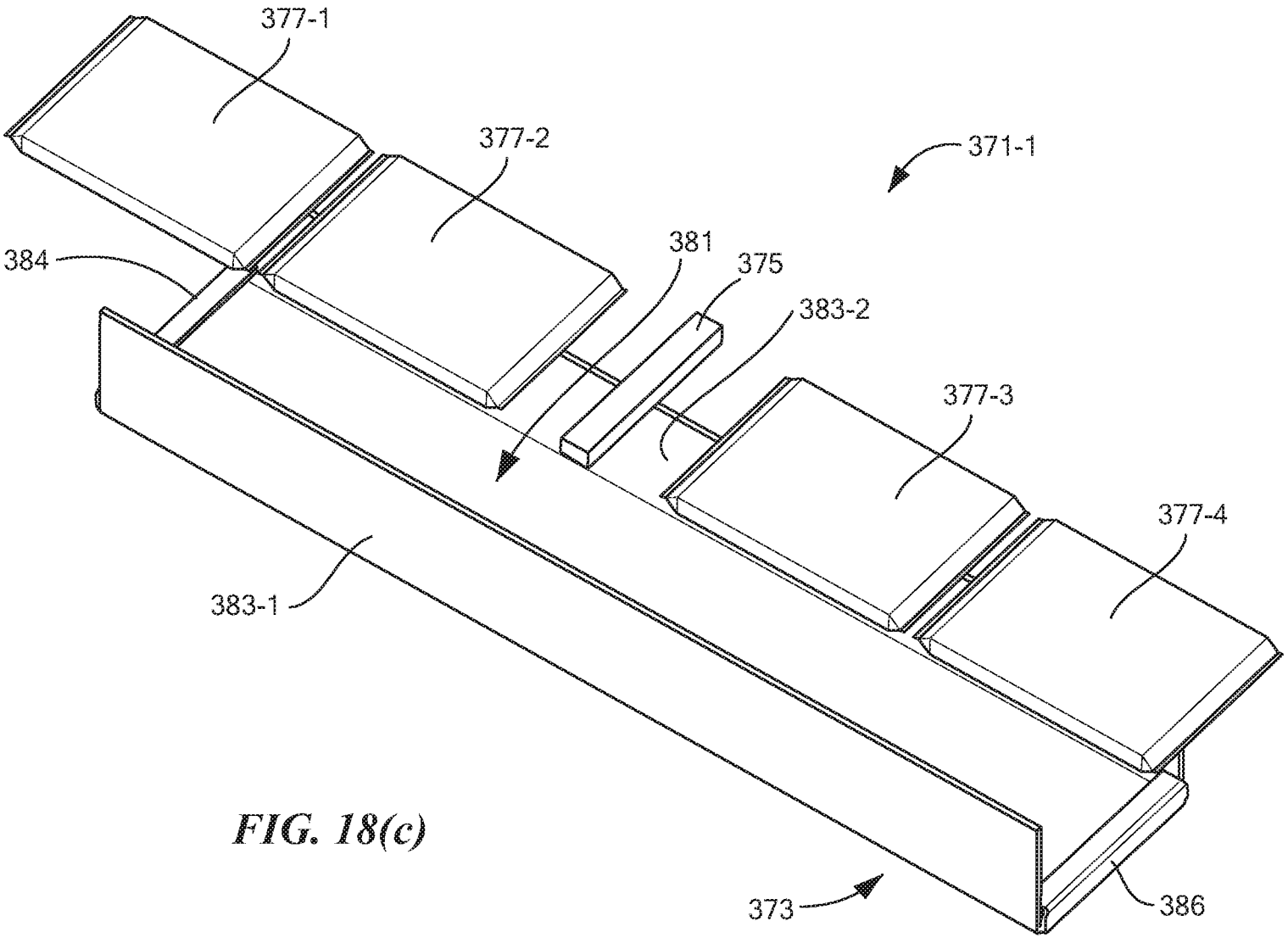

Sleeves 371-1 and 371-5 may be identical to one another and, in the present embodiment, are, in fact, identical to one another. Sleeve 371-1, which is also shown separately in FIGS. 18(*a*) through 18(*c*), may comprise a container 373, an insulating member 375, and a plurality of temperature-control members 377-1 through 377-4.

Container 373, which may comprise a box of corrugated cardboard or another similarly suitable material, may be shaped to include a generally rectangular prismatic cavity 381 that may be accessible through a pair of front closure flaps 383-1 and 383-2 extending between a first closed end 384 of container 373 and a second closed end 386 of container 373.

Insulating member 375, which may be a block of expanded polystyrene or another similarly suitable material, may be disposed within cavity 381 of container 373. More specifically, insulating member 375 may be positioned at appropriately the midpoint of cavity 381 and may be oriented transversely to the length of cavity 381, with temperature-control members 377-1 and 377-2 being positioned in cavity 381 on one side of insulating member 375 and with members 377-3 and 377-4 being positioned in cavity 381 on the opposite side of insulating member 375.

Temperature-control members 377-1 through 377-4 may be identical to one another and, in the present embodiment, are, in fact, identical to one another. Each of temperature-control members 377-1 through 377-4 may comprise a foam block impregnated with a quantity of water or a water-based phase-change material, the impregnated block being positioned within a suitable container, such as a pair of sealed polymer films. Members 377-1 through 377-4 may have a phase-change temperature of approximately 0° C. Also, it should be understood that, although members 377-1 through 377-4 are shown herein as four discrete members, one may join together members 377-1 and 377-2 and may join together members 377-3 and 377-4.

Figure 19A:
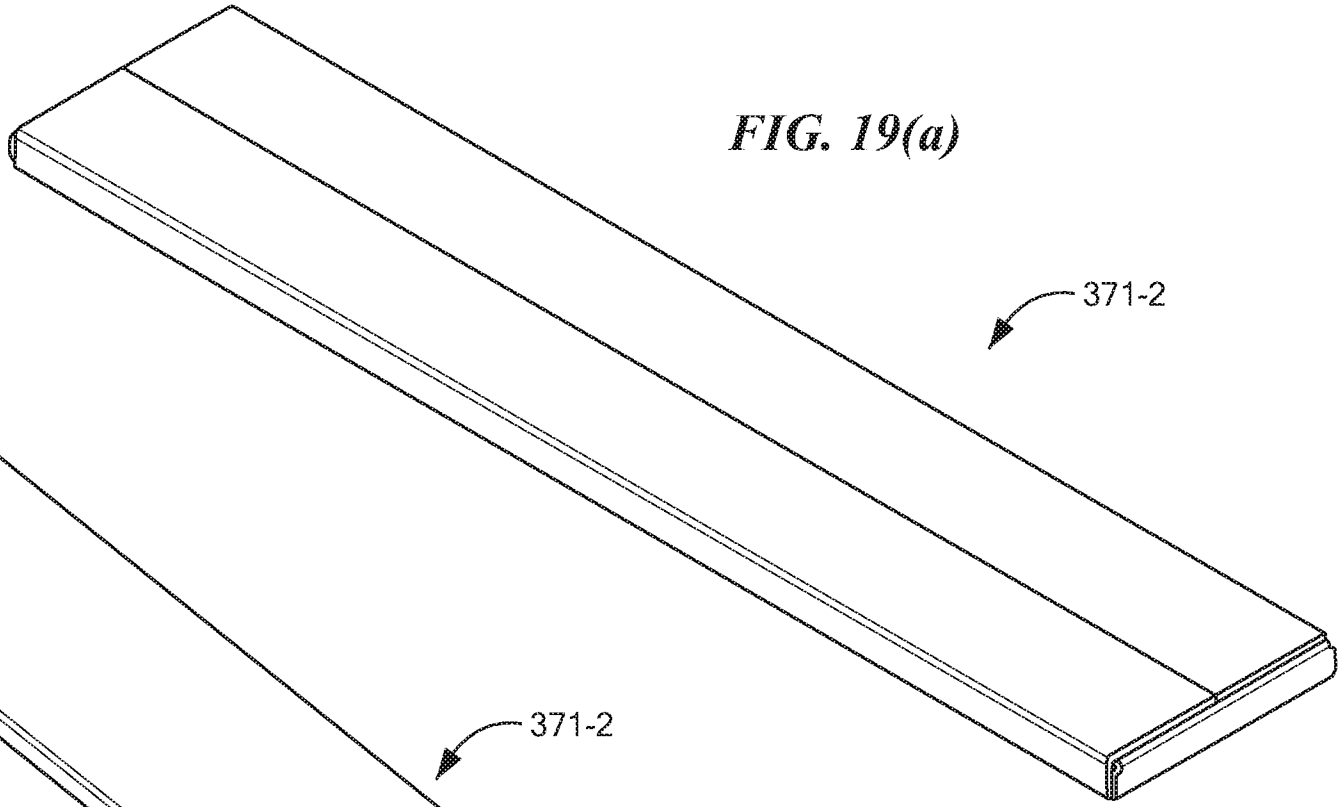
FIGS. 19(*a*) through 19(*c*) are enlarged front perspective, enlarged rear perspective, and enlarged partially exploded perspective views, respectively, of another one of the temperature-control sleeves for the outer cassette shown in FIGS. 17(*a*) through 17(*c*)
Figure 19B:
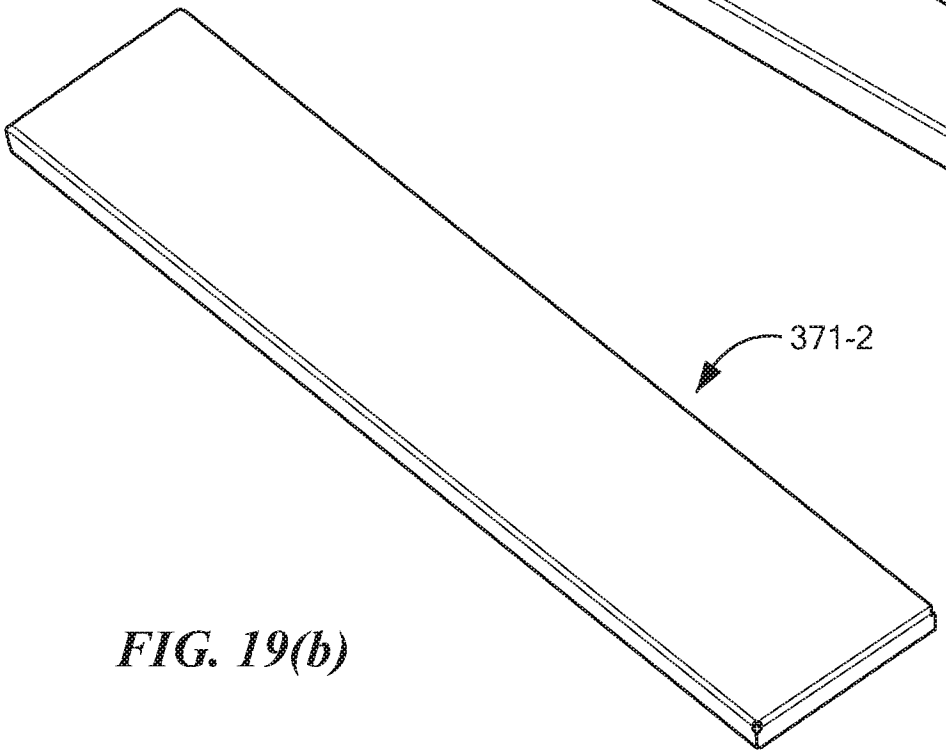
Figure 19C:
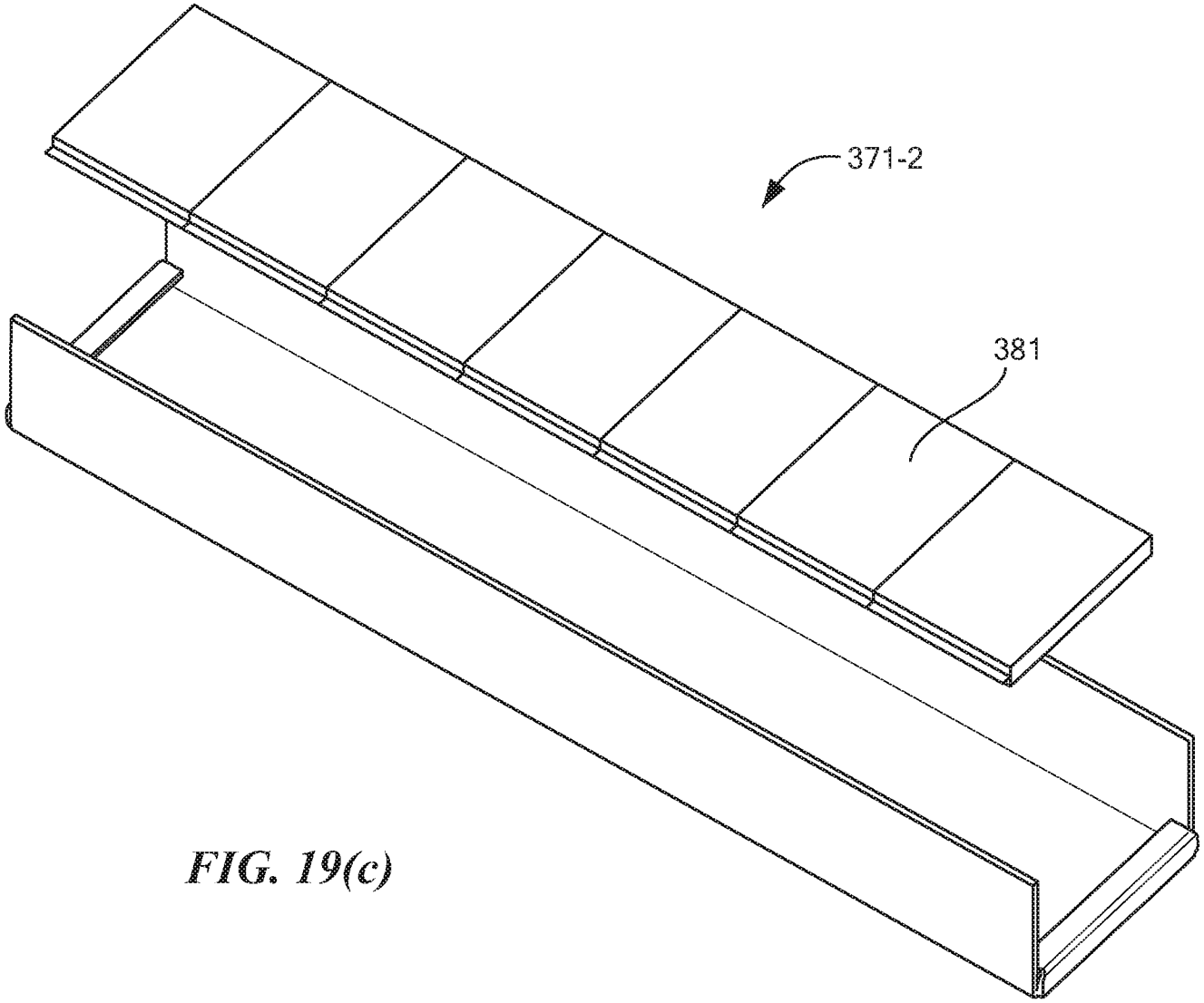
Figure 20A:
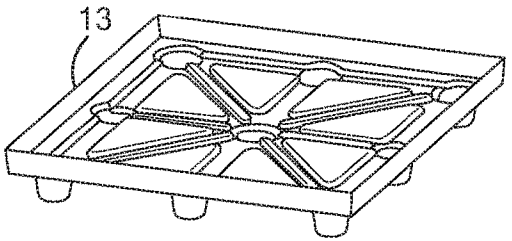
FIGS. 20(*a*) through 20(*l*) show a method by which the insulated shipping system of FIG. 1 may be assembled in accordance with the present invention.
Figure 20B:
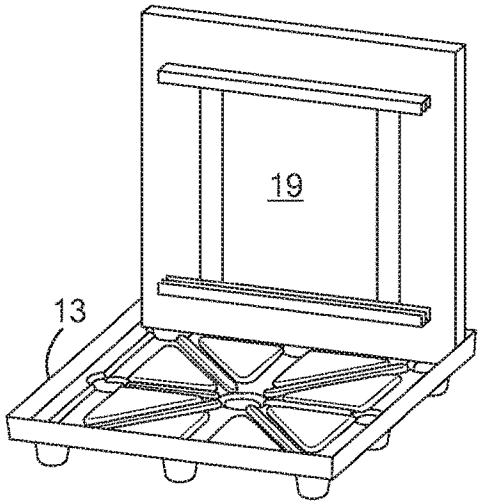
Figure 20C:
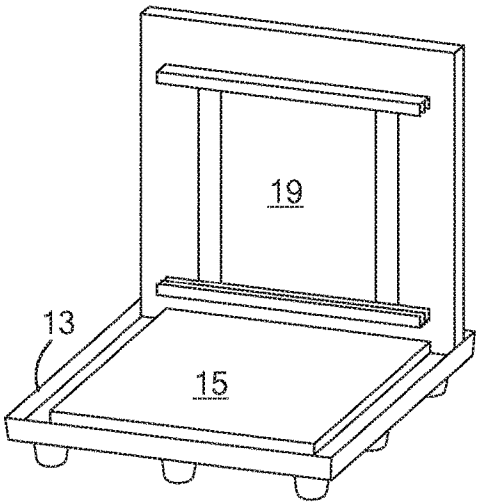
Figure 20D:
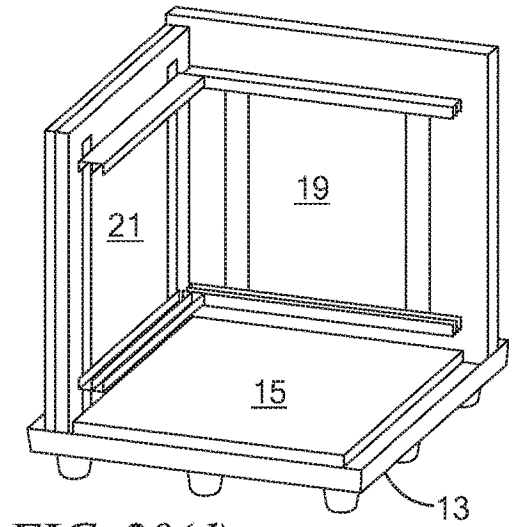
Figure 20E:
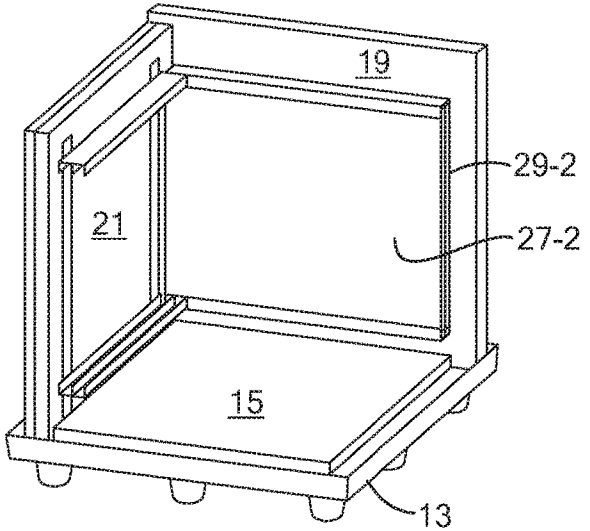
Figure 20F:
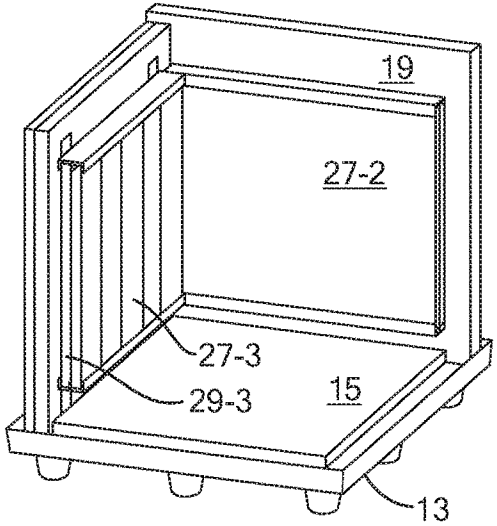
Figure 20I:
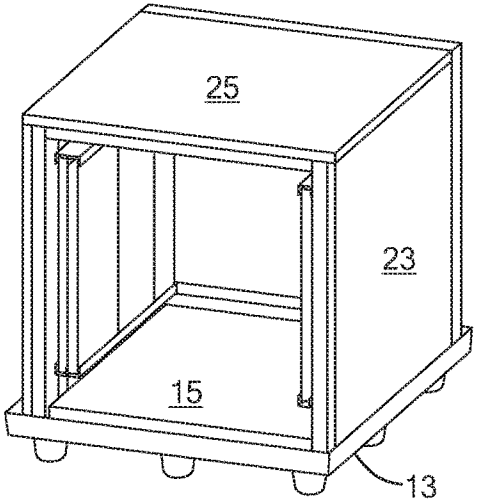
Figure 20H:
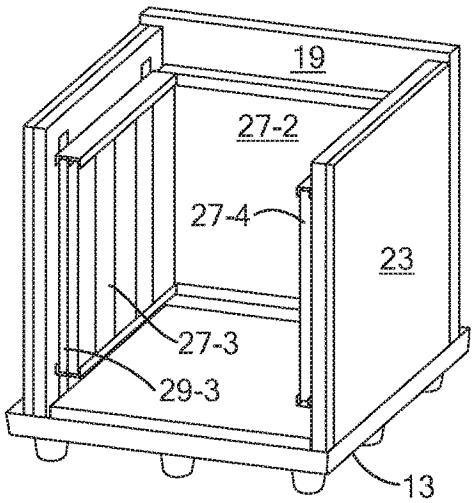
Figure 20G:
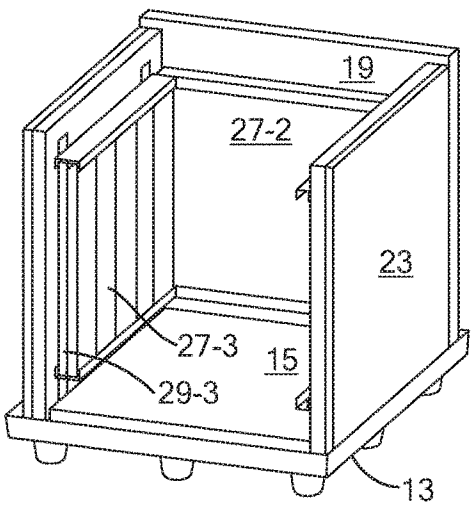
Figure 20L:
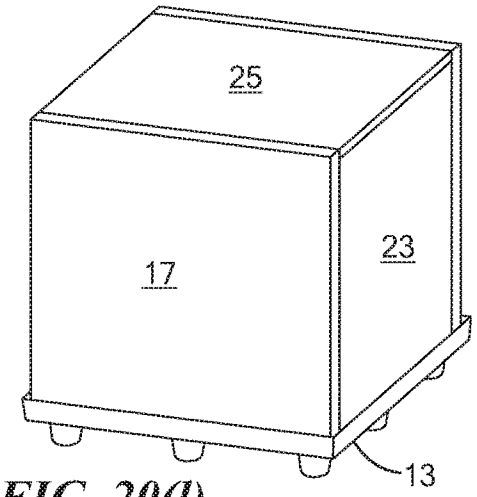
Figure 20K:
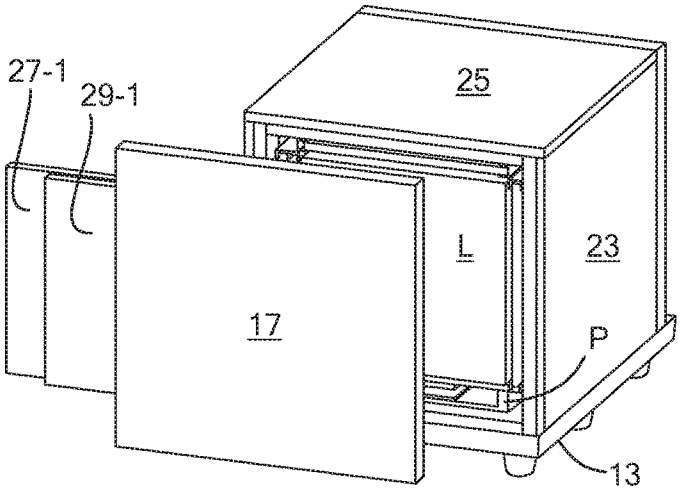
Figure 20J:
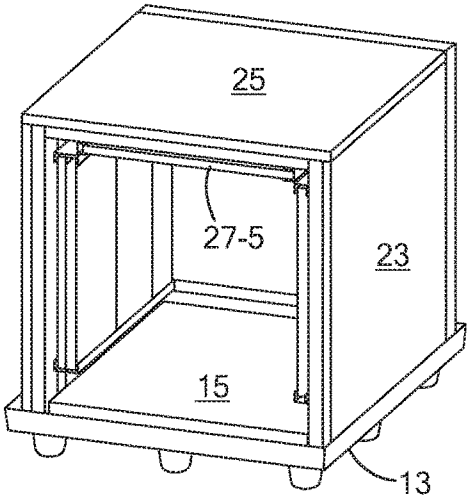

Sleeves 371-2 through 371-4 may be identical to one another and, in the present embodiment, are, in fact, identical to one another. Sleeve 371-2, which is also shown separately in FIGS. 19(*a*) through 19(*c*), may be similar in certain respects to sleeve 371-1, one difference between the two types of sleeves being that, whereas sleeve 371-1 may comprise an insulating member 375, sleeve 371-2 does not comprise such an insulating member. In addition, sleeve 371-2 may differ from sleeve 371-1 in that, whereas sleeve 371-1 may comprise temperature-control members 377-1 through 377-4, sleeve 371-2 may comprise a temperature-control member 381. Temperature-control member 381 may comprise a string of foam bricks, i.e., a saddle bag comprising a multi-compartmented container, wherein each compartment may be sealed from the other compartments and the environment and wherein each compartment may contain a foam block impregnated with a quantity of water or a water-based phase-change material. The phase-change material of temperature-control member 381 may have a phase-change temperature of approximately 0° C.

Each of the compartments of temperature-control member 381 may be thinner than each of temperature-control members 377-1 through 377-4. As such, there is more water or water-based phase-change material in each of sleeves 371-1 and 371-5 (for example, approximately 7 pounds of water per sleeve) than in each of sleeves 371-2 through 371-4 (for example, approximately 4 pounds of water per sleeve).

As can readily be appreciated, because of the construction of sleeves 371-1 through 371-2, outer cassette 29-1 provides greater thermal protection at its four corners than elsewhere. This is by design as the greatest thermal weakness for the six walls is typically at their corners.

It is to be understood that the number of sleeves in outer cassette 29-1 is merely illustrative. As such, one could increase or decrease the number of sleeves in outer cassette 29-1 without departing from the teachings of the present invention. In addition, it should be understood that, although each of sleeves 371-1 and 371-5 is described above as having a greater quantity of water or a water-based phase-change material than is present in each of sleeves 371-2, 371-3 and 371-4, all of sleeves 371-1 through 371-5 may be identical. Moreover, it should be understood that, although all of sleeves 371-1 through 371-5 are described above as having the same type of phase-change material, i.e., water, one could put different types of phase-change materials in different sleeves or in different portions of the same sleeve and could use a phase-change material having a different phase-change temperature.

To prepare outer cassette 29-1 for use, sleeves 371-1 through 371-5 may be loaded into container 351, container 351 may be closed using assemblies 355-1 and 355-2, and outer cassette 29-1 may be pre-conditioned, as a unit, at a desired temperature, for example, at about −20° C. (Preferably, the pre-conditioning temperature for outer cassette 29-1 is below the temperature range that one wishes to maintain the payload.) However, depending on the application to which system 11 is to be put and depending on the composition of the sleeves to be used as a part of outer cassette 29-1, one may pre-condition different sleeves of outer cassette 29-1 at different temperatures and then load the differently pre-conditioned sleeves into container 351. (Alternatively, outer cassette 29-1 may be sealed shut to prevent sleeves 371-1 through 371-5 from being removed therefrom.) Outer cassettes 29-2 through 29-5 may be prepared in a similar fashion to outer cassette 29-1.

Referring now to FIGS. 20(*a*) through 20(*l*), there is shown a method by which system 11 may be assembled in accordance with the present invention. (Certain components of system 11, such as stop 88, are not shown for the sake of simplicity.) As seen in FIG. 20(*a*), the method may begin with the positioning of skid 13 on a floor or similar surface. Next, as seen in FIG. 20(*b*), the method may continue with the positioning of rear wall 19 on top of skid 13. Next, as seen in FIG. 20(*c*), the method may continue with the positioning of bottom wall 15 on top of skid 13. Next, as seen in FIG. 20(*d*), the method may continue with the positioning of left wall 21 on top of first stepped portion 57 of bottom wall 15. One advantageous feature of system 11 is that, because brackets 105 and 107 of rear wall 19 and brackets 122 and 124 of left wall 21 are placed on the respective inwardly-facing surfaces thereof, the centers of gravity for rear wall 19 and left wall 21 are moved inwardly sufficiently to enable rear wall 19 and left wall 21 to keep each other upright without requiring external intervention. Next, as seen in FIG. 20(*e*), the method may continue with the loading of cassettes 27-2 and 29-2 on to rear wall 19. Next, as seen in FIG. 20(*f*), the method may continue with the loading of cassettes 27-3 and 29-3 on to left wall 21. Next, as seen in FIG. 20(*g*), the method may continue with the positioning of right wall 23 on top of second stepped portion 59 of bottom wall 15. Once again, because of the placement of brackets 145 and 147 on right wall 23, right wall 23 is kept upright by rear wall 19 and vice versa. Next, as seen in FIG. 20(*h*), the method may continue with the loading of cassettes 27-4 and 29-4 on to right wall 23 (cassette 29-4 being obscured from view). Next, as seen in FIG. 20(*i*), the method may continue with the positioning of top wall 25 on top of left wall 21 and right wall 23. Next, as seen in FIG. 20(*j*), the method may continue with the loading of cassettes 27-5 and 29-5 on to top wall 25 (cassette 29-5 being obscured from view). Next, as seen in FIG. 20(*k*), the method may continue with the loading of a pallet-sized load L of temperature-sensitive materials into the space defined by walls 15, 19, 21, 23, and 25 and may also continue with the loading of cassettes 27-1 and 29-1 on to front wall 17. (Pallet-sized payload L is preferably positioned on top of a pallet P, which pallet P may or may not be included in system 11. Pallet P may be a conventional wooden or plastic pallet or may be an insulated pallet, such as an AIRDEX pallet, which is commercially available from Foam Fabricators, Modesto, Calif.). An advantageous feature of system 11 is that the various brackets on the respective walls may help to constrain movement of payload L, particularly where payload L has a footprint of 40 inches by 48 inches. Finally, as seen in FIG. 20(*l*), the method may conclude with the positioning of front wall 17 on skid 13.

Although system 11 is particularly well-suited for use with a pallet-sized payload L, such as a 48"×40"×45" payload, system 11 may nevertheless be used with a payload that is less than a full pallet-sized payload L.

One may modify system 11 by eliminating inner cassettes 27-1 through 27-5 and/or by eliminating outer cassettes 29-1 through 29-5 or by eliminating one or more of inner cassettes 27-1 through 27-5 and/or by eliminating one or more outer cassettes 29-1 through 29-5 so that less than the full complement of inner cassettes 27 and outer cassettes 29 is used. Alternatively, one may also modify system 11 by replacing one or more of inner cassettes 27 with additional outer cassettes 29 or vice versa. Furthermore, one may also modify system 11 by positioning additional phase-change material, either in a cassette or otherwise, under the payload L, for example, between pallet P and bottom wall 15. As noted above, the above-described gelled organic phase-change material possess excellent compression strength and other attributes that make it particularly well-suited for being used in such a manner.

One may also modify system 11 by providing one or more transverse openings in the top surfaces of the tracks of the top brackets and/or in the bottom surfaces of the tracks of the bottom brackets to promote the convection of air around the payload L. In addition, one may provide handles, whether integrally-formed or otherwise, on one or more of walls 15, 17, 19, 21, 23 and 25 to facilitate handling, particularly during assembly.

It is presently envisioned that system 11 may be delivered to a customer as an unassembled kit comprising skid 13, bottom wall 15, front wall 17, rear wall 19, left wall 21, right wall 23, top wall 25, inner cassettes 27-1 through 27-5, and outer cassettes 29-1 through 29-5, that the customer will pre-condition the inner cassettes 27 and outer cassettes 29, and that the customer will then assemble system 11 and load its product into system 11. However, it is not beyond the realm of the present invention for inner cassettes 27 and outer cassettes 29 to be delivered to a customer in a disassembled state, with a variety of different types of sleeves provided to the customer that may be loaded into the inner and outer cassettes in different permutations. Moreover, it is not beyond the realm of the present invention for inner cassettes 27 and outer cassettes 29, whether delivered to a customer in an assembled state or disassembled state, to be used in combinations other than those disclosed above.

Figure 21:
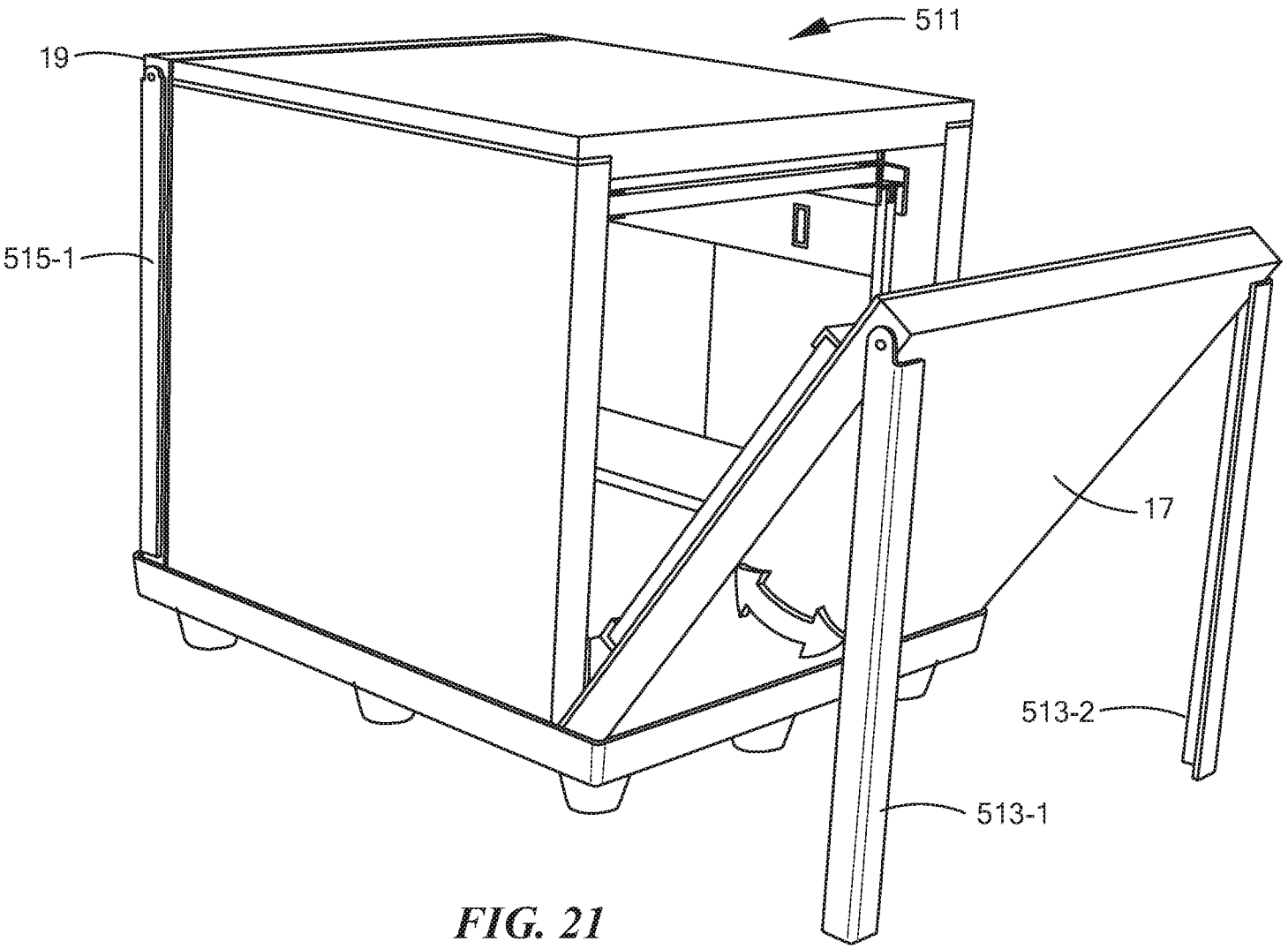
FIG. 21 is a front perspective view of a second embodiment of a thermally insulated shipping system that may be used to transport a pallet-sized payload, the thermally insulated shipping system being constructed according to the teachings of the present invention.

Referring now to FIG. 21, there is shown a perspective view of a second embodiment of an insulated shipping system that may be used to transport a pallet-sized load, the insulated shipping system being constructed according to the present invention and being represented generally by reference numeral 511.

System 511 may be similar in most respects to system 11, the principal difference between the two systems being that system 511 may further comprise a pair of corner brackets 513-1 and 513-2 pivotally mounted on front wall 17 and/or may further comprise a corresponding pair of corner brackets (of which only corner bracket 515-1 is shown) pivotally mounted on rear wall 19. Corner brackets 513-1 and 513-2 (and the corresponding corner brackets on rear wall 19) may be appropriately constructed so that they may support the weight of its respective wall when the wall is pivoted outwardly, thereby enabling cassettes 27 and 29 to be loaded into the respective wall without requiring human intervention.

Alternatively, in another embodiment (not shown), one may maintain front wall 17 and/or rear wall 19 in a pivoted state, for example, to permit the loading of cassettes 27 and 29 thereon, by fixedly attaching one end of a strap to the upper bracket of front wall 17 (or to rear wall 19) and by attaching a hook or similar device to the free end of the strap. Such a hook may then be inserted into an opening provided in the upper bracket of the left wall 21 or right wall 23.

Figure 22:
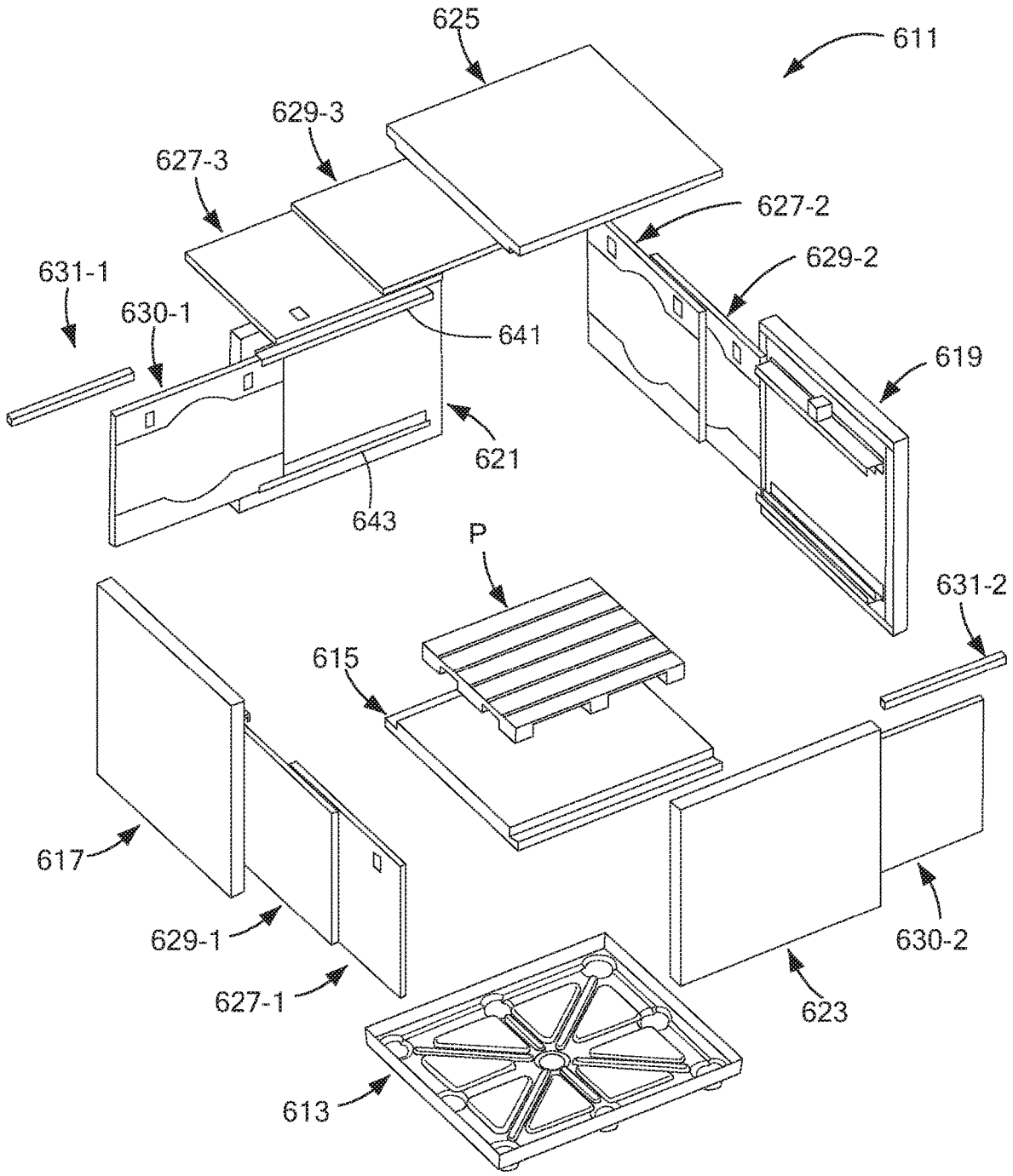
FIG. 22 is a partly exploded perspective view of a third embodiment of a thermally insulated shipping system that may be used to transport a pallet-sized payload, the thermally insulated shipping system being constructed according to the teachings of the present invention.

Referring now to FIG. 22, there is shown a partly exploded perspective view of a third embodiment of a thermally insulated shipping system that may be used to transport a pallet-sized payload, the thermally insulated shipping system being represented generally by reference numeral 611. System 611 is shown together with a pallet P.

System 611, which may be used to maintain a 48"×42"×45" payload within a temperature range of +2° C. to +8° C. for an extended period of time, may comprise a skid 613, a bottom wall 615, a front wall 617, a rear wall 619, a left wall 621, a right wall 623, a top wall 625, a plurality of inner cassettes 627-1 through 627-3, a plurality of outer cassettes 629-1 through 629-3, a pair of side cassettes 630-1 and 630-2, and a pair of sleeves 631-1 and 631-2.

Skid 613, bottom wall 615, front wall 617, rear wall 619, and top wall 625 may be identical to skid 13, bottom wall 15, front wall 17, rear wall 19, and top wall 25, respectively, of system 11. Left wall 621 and right wall 623 may be similar to left wall 21 and right wall 23, respectively, of system 11, except that each of left wall 621 and right wall 623 may comprise an upper bracket 641 and a lower bracket 643, wherein each of upper bracket 641 and lower bracket 643 may be shaped to define a single channel, as opposed to inner and outer channels. The aforementioned single channel is preferably located distal to the payload. In other words, brackets 641 and 643 effectively eliminate the inner cassette slot (used to receive an inner cassette) while retaining the outer cassette slot (used to receive an outer cassette).

Inner cassettes 627-1 through 627-3, which may be removably mounted in the inner (i.e., more proximal to payload) slot of front wall 617, rear wall 619, and top wall 625, respectively, may be identical to one another and may be identical to inner cassettes 27-1 through 27-5 of system 11.

Outer cassettes 629-1 through 629-3, which may be removably mounted in the outer slots (i.e., cassette-receiving spaces more distal to payload) of front wall 617, rear wall 619, and top wall 625, respectively, may be identical to one another and may be identical to outer cassettes 29-1 through 29-5 of system 11.

Side cassettes 630-1 and 630-2, which may be removably mounted in the slots of left wall 621 and right wall 623, respectively, may be identical to one another and may be identical to outer cassettes 629-1 through 629-3 (although, as will be discussed further below, side cassettes 630-1 and 630-2 are typically preconditioned at a different temperature than are outer cassettes 629-1 through 629-3).

Sleeves 631-1 and 631-2, which may be seated on top of upper brackets 641 of left wall 621 and right wall 623, respectively, may be identical to one another and may be similar to sleeve 205-2 of system 11, except that sleeves 631-1 and 631-2 may comprise a phase-change material having a phase-change temperature of approximately +5° C., instead of a phase-change material having a phase-change temperature of approximately +3° C. The phase-change material having a phase-change temperature of approximately +5° C. may be a gelled organic phase-change material of the type described above.

System 611 may be assembled and used in a fashion similar to that described above for system 11, except that inner cassettes 627-1 through 627-3 may be preconditioned at about +5° C., outer cassettes 629-1 through 629-3 may be preconditioned at about −20° C., side cassettes 630-1 and 630-2 may be preconditioned at about +5° C., and sleeves 631-1 and 631-2 may be preconditioned at about −20° C.

It is to be understood that system 611 may be modified by replacing left wall 621 and right wall 623 with left wall 21 and right wall 23, respectively, and by mounting side cassettes 630-1 and 630-2 in the outer slots (i.e., slots more distal to payload) of left wall 21 and right wall 23. However, modifying system 611 in the manner described above may reduce the size of a payload that may be accommodated by the system. It is also to be understood that, if desired, one may place additional phase-change material on bottom wall 615 under the pallet.

Figure 23:
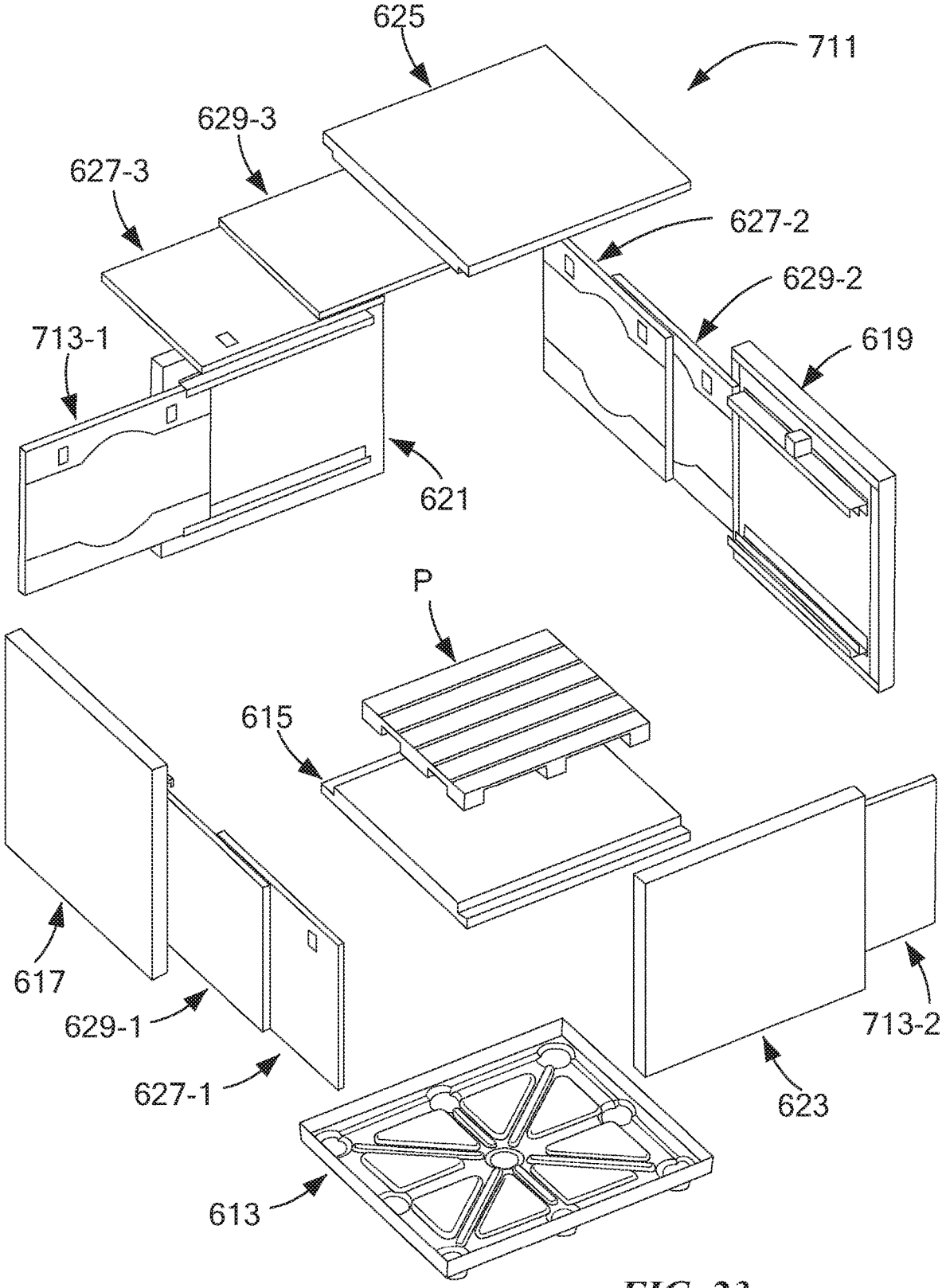
FIG. 23 is a partly exploded perspective view of a fourth embodiment of a thermally insulated shipping system that may be used to transport a pallet-sized payload, the thermally insulated shipping system being constructed according to the teachings of the present invention.

Referring now to FIG. 23, there is shown a partly exploded perspective view of a fourth embodiment of a thermally insulated shipping system that may be used to transport a pallet-sized payload, the thermally insulated shipping system being represented generally by reference numeral 711. System 711 is shown together with a pallet P.

Figure 24:
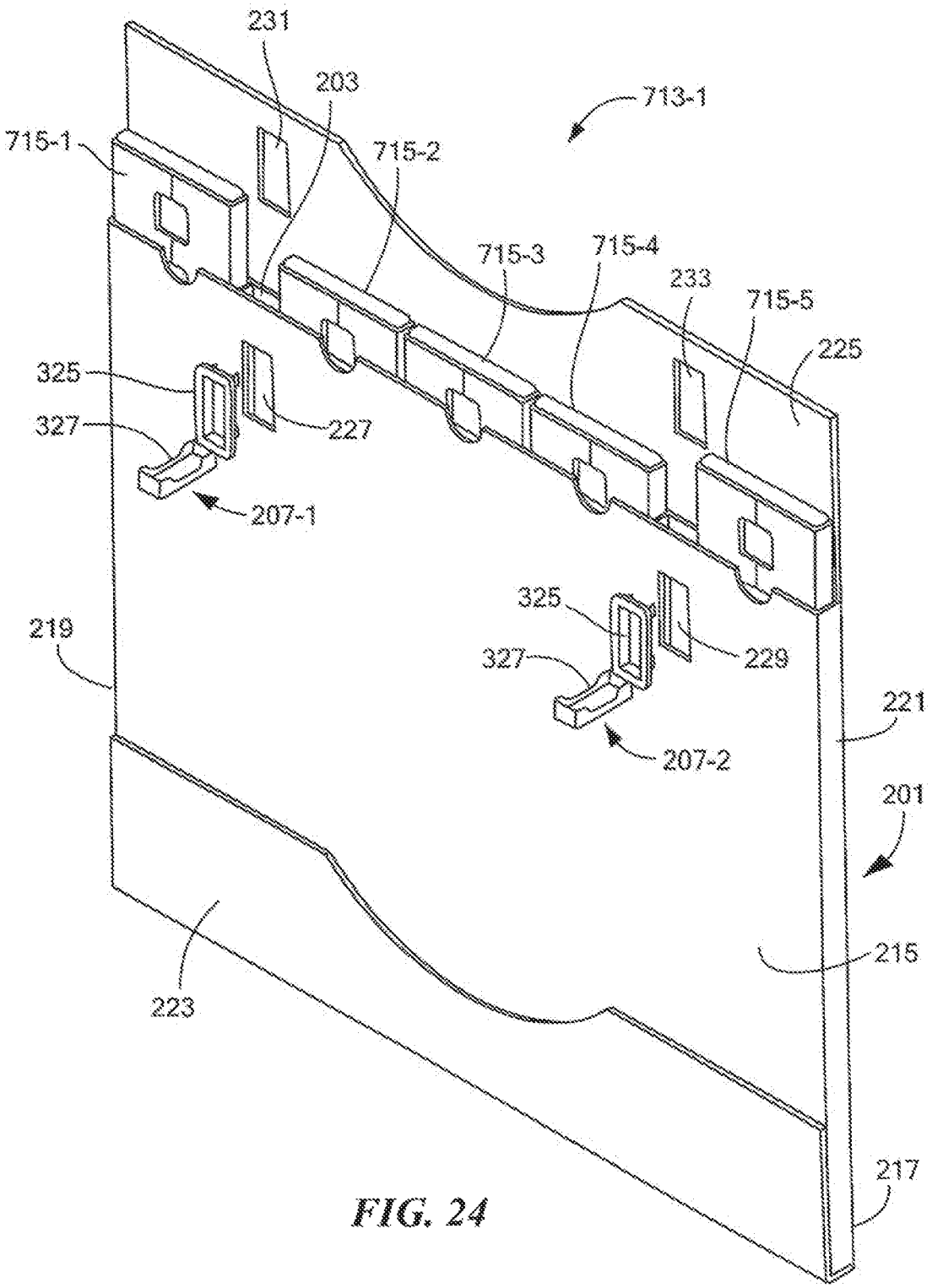
FIG. 24 is a partly exploded perspective view of one of the side cassettes of the system of FIG. 23.

System 711, which may be used to maintain a 48"×42"×46" payload within a temperature range of +2° C. to +8° C. for an extended period of time, may be similar in many respects to system 611. One difference between system 711 and system 611 may be that, whereas system 611 may comprise side cassettes 630-1 and 630-2, system 711 may comprise side cassettes 713-1 and 713-2, which may be identical to one another. Side cassette 713-1 is shown separately in FIG. 24. Side cassette 713-1 may differ from side cassettes 630-1 and 630-2 in that side cassette 713-1 may comprise five identical sleeves 715-1 through 715-5, each of which may comprise a phase-change material having a phase-change temperature of approximately +5° C. Preferably, the aforementioned phase-change material is a gelled organic phase-change material of the type described above, and preferably each of sleeves 715-1 through 715-5 comprises two layers of said phase-change material. Another difference between system 711 and system 611 may be that system 711 may omit sleeves 631-1 and 631-2.

System 711 may be assembled and used in a fashion similar to that described above for system 611, except that side cassettes 713-1 and 713-2 may be preconditioned at about −20° C.

Figure 25:
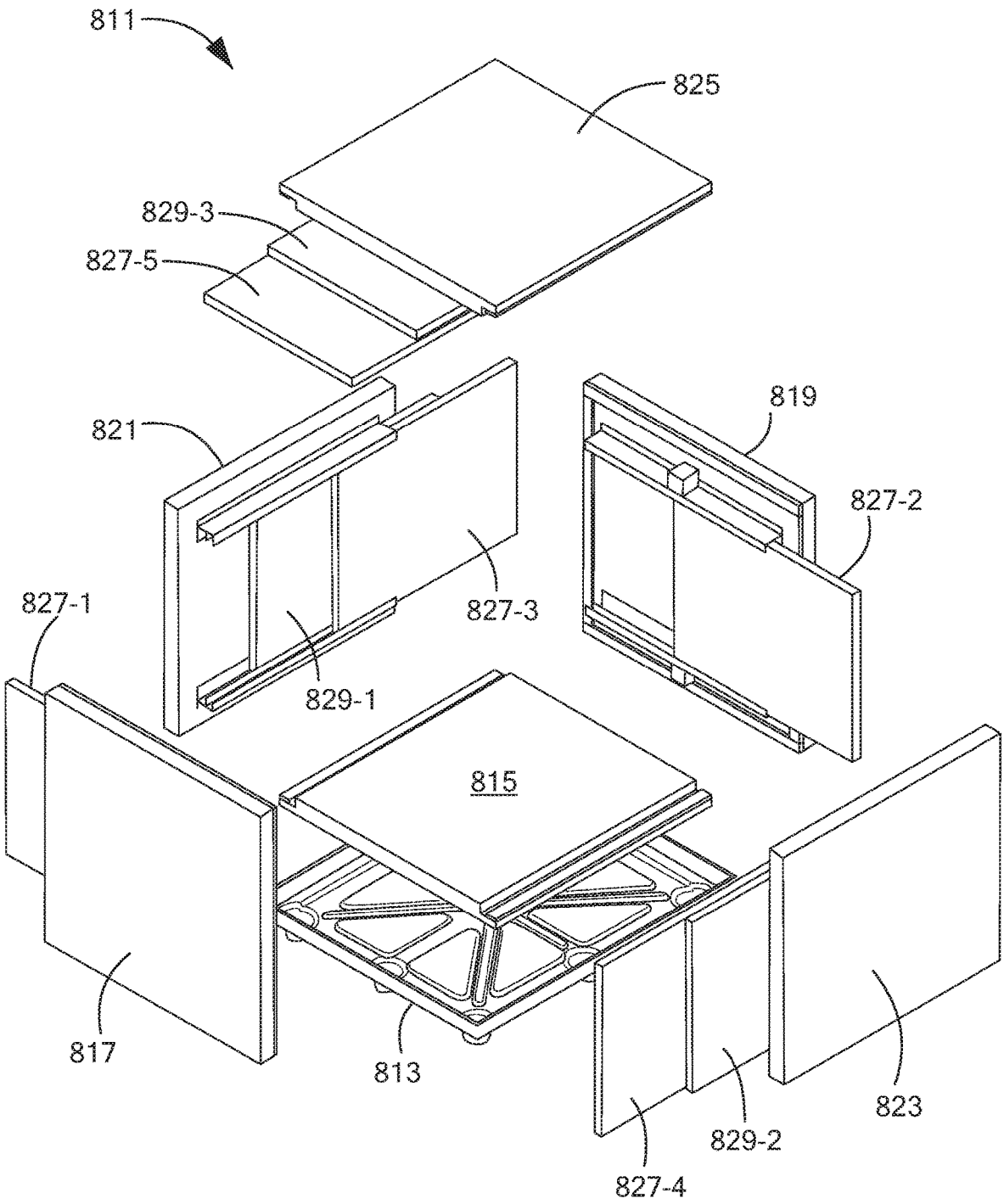
FIG. 25 is a partly exploded perspective view of a fifth embodiment of a thermally insulated shipping system that may be used to transport a pallet-sized payload, the thermally insulated shipping system being constructed according to the teachings of the present invention.

Referring now to FIG. 25, there is shown a partly exploded perspective view of a fifth embodiment of a thermally insulated shipping system that may be used to transport a pallet-sized payload, the thermally insulated shipping system being represented generally by reference numeral 811.

System 811, which may be used to maintain a 48"×40"×45" payload within a temperature range of +15° C. to +25° C. for an extended period of time, may comprise a skid 813, a bottom wall 815, a front wall 817, a rear wall 819, a left wall 821, a right wall 823, a top wall 825, a plurality of inner cassettes 827-1 through 827-5, and a plurality of outer cassettes 829-1 through 829-3.

Skid 813, bottom wall 815, front wall 817, rear wall 819, left wall 821, right wall 823, and top wall 825 may be identical to skid 13, bottom wall 15, front wall 17, rear wall 19, left wall 21, right wall 23, and top wall 25, respectively, of system 11.

Figure 26:
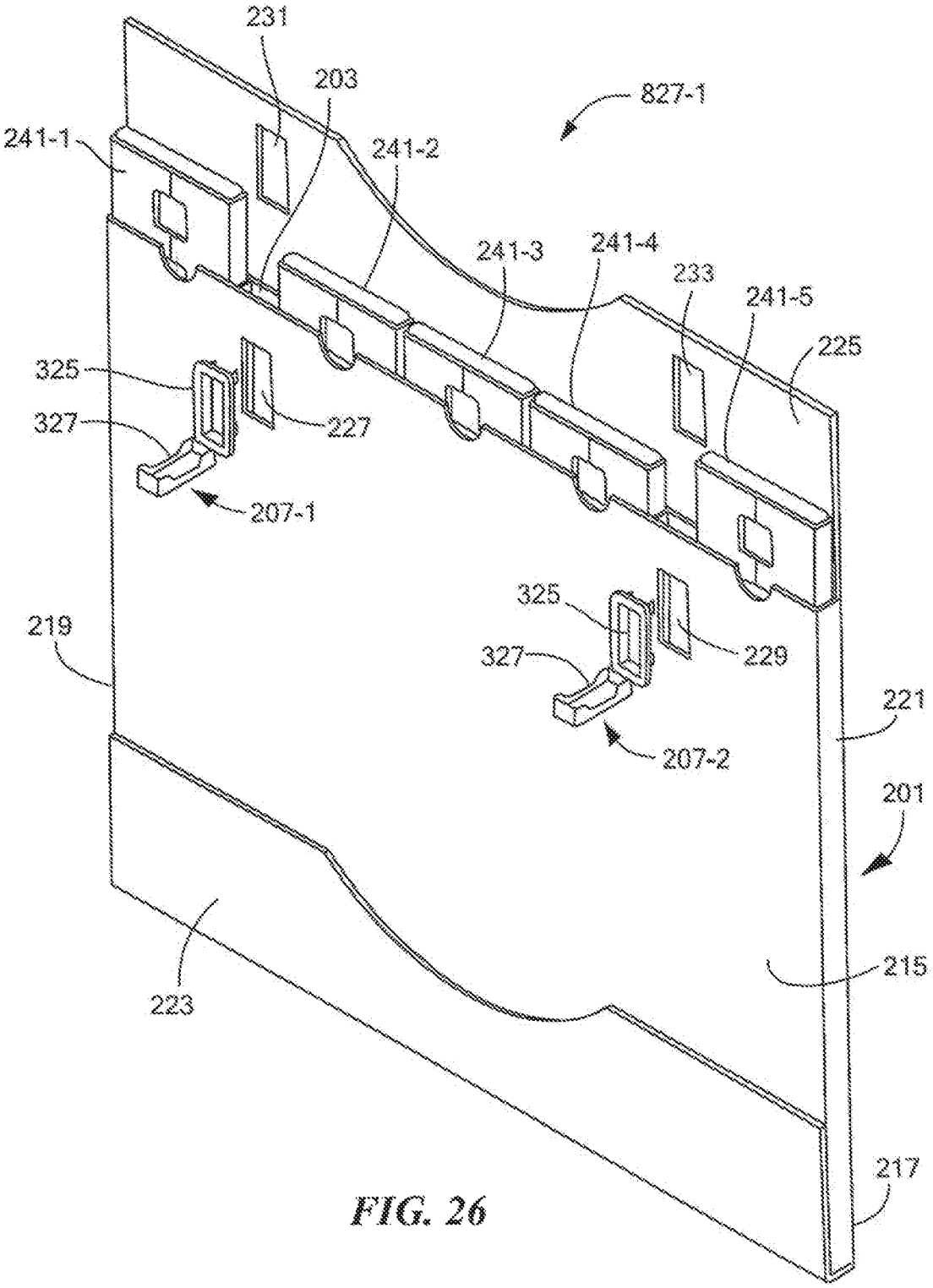
FIG. 26 is a partly exploded perspective view of one of the inner cassettes of the system of FIG. 25.

Inner cassettes 827-1 through 827-5, which may be removably mounted in the inner slots (i.e., slots more proximal to payload) of front wall 817, rear wall 819, left wall 821, right wall 823 and top wall 825, respectively, may be identical to one another. Referring now to FIG. 26, there is shown a partly exploded perspective view of inner cassette 827-1. Inner cassette 827-1 may be similar to inner cassette 27-1 of system 11, except that, whereas inner cassette 27-1 may comprise sleeves 205-1 through 205-5, inner cassette 827-1 may comprise sleeves 241-1 through 241-5. Sleeves 241-1 and 241-5 may be identical to one another and may be similar to sleeve 205-2 of system 11, except that, whereas sleeve 205-2 may comprise a phase-change material having a phase-change temperature of approximately +3° C., sleeves 241-1 and 241-5 may comprise a phase-change material having a phase-change temperature of approximately +17° C. Preferably, the aforementioned phase-change material is a gelled organic phase-change material of the type described above. Sleeves 241-2 through 241-4 may be identical to one another and may be identical to sleeve 371-1 of system 11.

Referring back now to FIG. 25, outer cassettes 829-1 through 829-3, which may be removably mounted in the outer slots (i.e., slots more distal to payload) of left wall 821, right wall 823, and top wall 825, respectively, may be identical to one another and may be identical to outer cassettes 29-1 through 29-5 of system 11.

System 811 may be assembled and used in a fashion similar to that described above for system 11, except that inner cassettes 827-1 through 827-5 may be preconditioned at about +22° C. and outer cassettes 829-1 through 829-3 may be preconditioned at about +5° C. It is to be understood that, if desired, one may place additional phase-change material on bottom wall 815 under the pallet.

Figure 27:
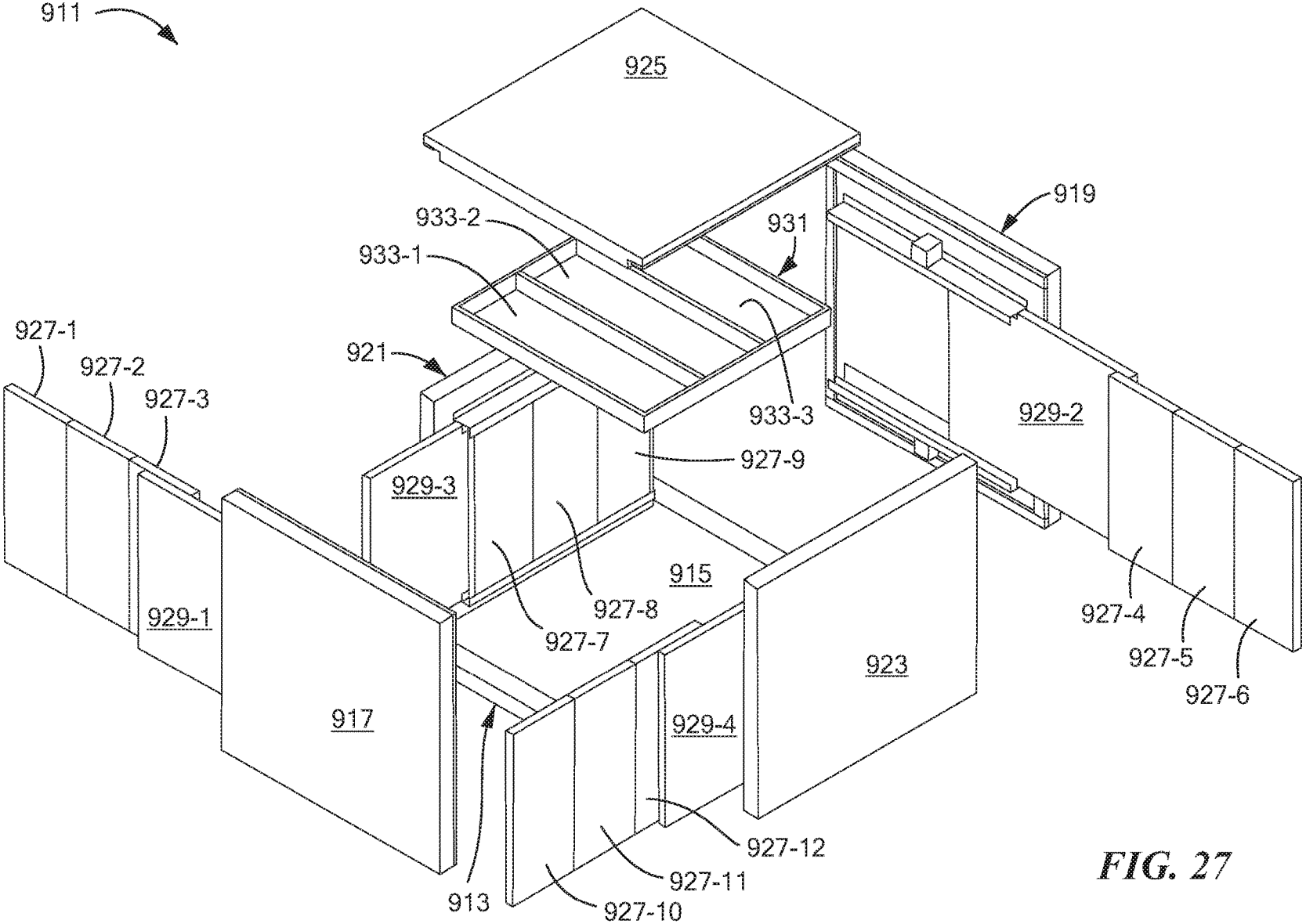
FIG. 27 is a partly exploded perspective view of a sixth embodiment of a thermally insulated shipping system that may be used to transport a pallet-sized payload, the thermally insulated shipping system being constructed according to the teachings of the present invention.

Referring now to FIG. 27, there is shown a partly exploded perspective view of a sixth embodiment of a thermally insulated shipping system that may be used to transport a pallet-sized payload, the thermally insulated shipping system being represented generally by reference numeral 911.

System 911, which may be used to maintain a 48"×40"×45" payload at a temperature below −20° C. for an extended period of time, may comprise a skid 913, a bottom wall 915, a front wall 917, a rear wall 919, a left wall 921, a right wall 923, a top wall 925, a plurality of inner sleeves 927-1 through 927-12, a plurality of outer cassettes 929-1 through 929-4, and a tray 931.

Skid 913, bottom wall 915, front wall 917, rear wall 919, left wall 921, right wall 923, and top wall 925 may be identical to skid 13, bottom wall 15, front wall 17, rear wall 19, left wall 21, right wall 23, and top wall 25, respectively, of system 11. (Top wall 925 may include alternative brackets to brackets 171 and 173 to facilitate the holding of tray 931. For example, such alternative brackets may jointly define a single slot.)

Figure 28:
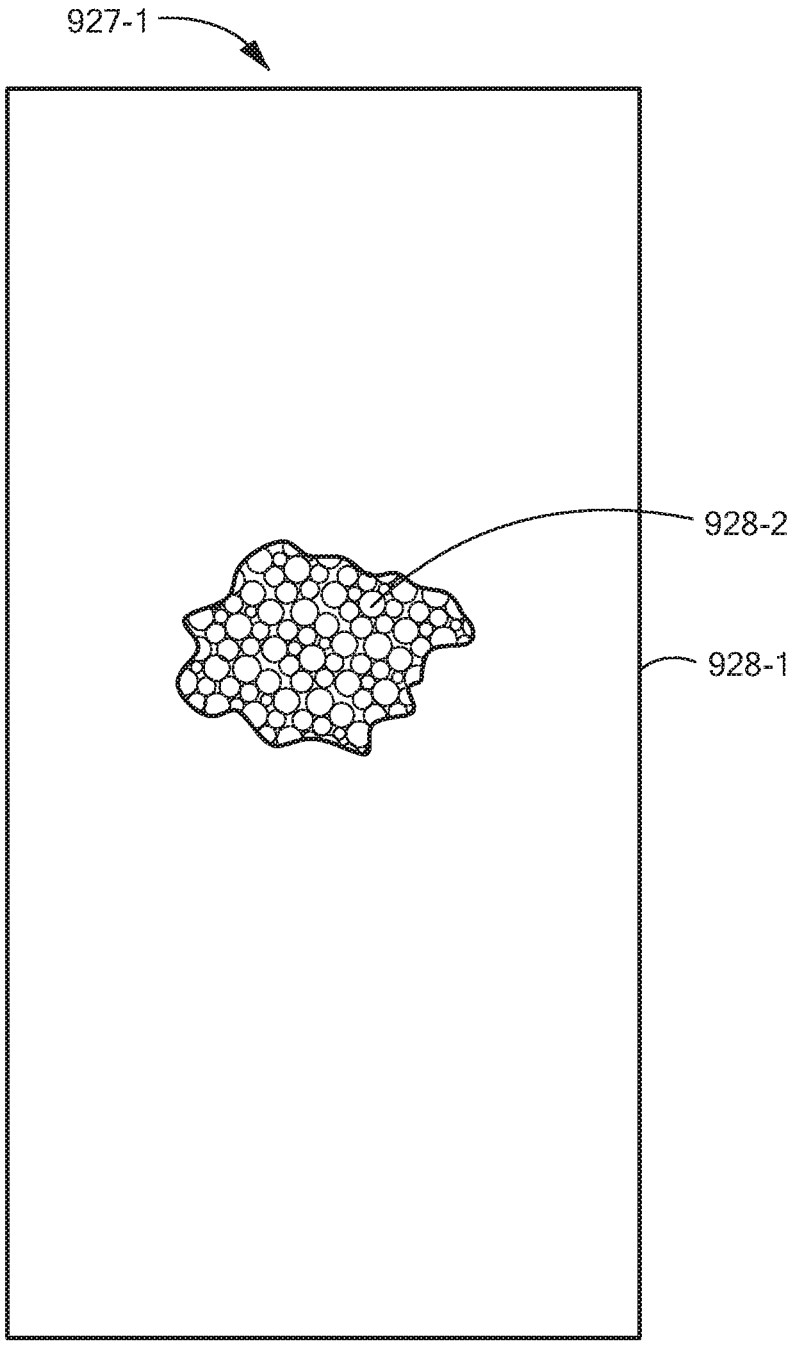
FIG. 28 is an enlarged front view, broken away in part, of one of the inner sleeves of the system of FIG. 27.

Inner sleeves 927-1 through 927-3 may be removably mounted in the inner slot (i.e., the slot more proximal to payload) of front wall 917, inner sleeves 927-4 through 927-6 may be removably mounted in the inner slot of rear wall 919, inner sleeves 927-7 through 927-9 may be removably mounted in the inner slot of left wall 923, and inner sleeves 927-10 through 927-12 may be removably mounted in the inner slot of right wall 925. Inner sleeves 927-1, 927-3, 927-4, 927-6, 927-7, 927-9, 927-10 and 927-12 may be discrete members that may be identical to one another. Referring now to FIG. 28, there is shown an enlarged front view, broken away in part, of inner sleeve 927-1. Inner sleeve 927-1 may comprise a hollow container 928-1, which may be made of a corrugated cardboard or a similar material. Inner sleeve 927-1 may further comprise a quantity of pelletized dry ice 928-2 disposed within container 928-1. The quantity of pelletized dry ice may be approximately 21 lbs. If desired, the top end of inner sleeve 927-1 may be shaped to include a funnel (not shown) to facilitate the loading of dry ice into inner sleeve 927-1. Referring back now to FIG. 27, inner sleeves 927-2, 927-5, 927-8 and 927-11 may be identical to one another and may comprise a hollow container that may be identical to hollow container 928-1. In contrast with inner sleeves 927-1, 927-3, 927-4, 927-6, 927-7, 927-9, 927-10 and 927-12, inner sleeves 927-2, 927-5, 927-8 and 927-11 may be devoid of pelletized dry ice or any other material. Consequently, the inner slot of each of front wall 917, rear wall 919, left wall 921 and right wall 923 may be occupied by two inner sleeves containing dry ice and separated by an empty inner sleeve.

Outer cassettes 929-1 through 929-4, which may be removably mounted in the outer slots (i.e., slots more distal to payload) of front wall 917, rear wall 919, left wall 921, and right wall 923, respectively, may be identical to one another and may be identical to outer cassettes 29-1 through 29-5 of system 11.

Tray 931, which may be removably disposed in a slot of top wall 925, may be a unitary structure shaped to define three identical contiguous sections 933-1 through 933-3. Each of sections 933-1 through 933-3 may have an open top and may be loaded with a quantity of pelletized dry ice. For example, each of sections 933-1 through 933-3 may contain approximately 91 lbs of pelletized dry ice.

It is to be understood that, if desired, one may place additional phase-change material on bottom wall 915 under a pallet.

System 911 may be assembled and used in a fashion generally similar to that described above for system 11, except that dry ice is preferably loaded into inner sleeves 927-1, 927-3, 927-4, 927-6, 927-7, 927-9, 927-10 and 927-12 and tray 931 soon before use. Outer cassettes 929-1 through 929-4 may be preconditioned at about −20° C. Consequently, it may be noted that the phase-change material in the outer slots (i.e., water) may be at a higher temperature than the phase-change material in the inner slots (i.e., dry ice).

Figure 29:
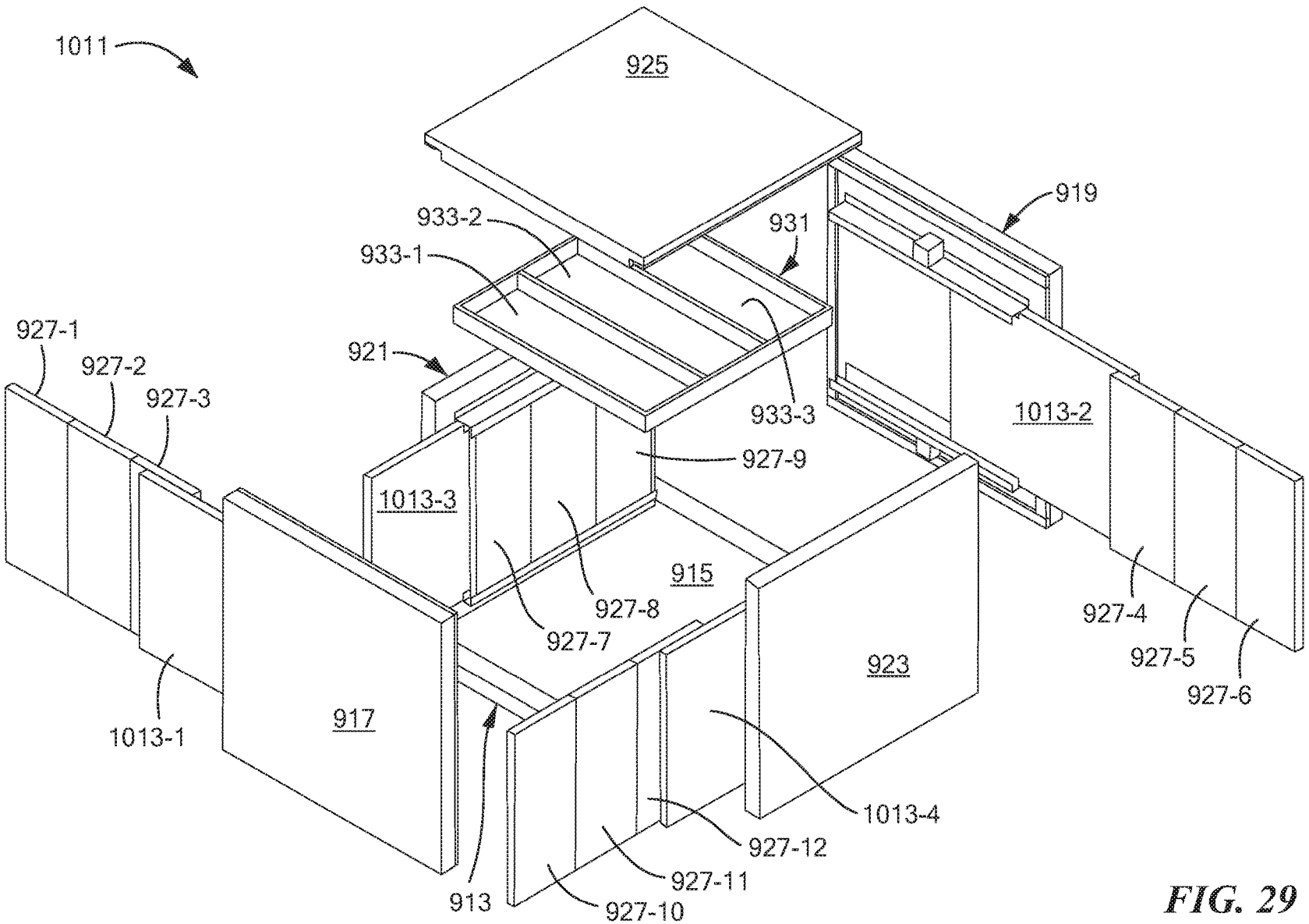
FIG. 29 is a partly exploded perspective view of a seventh embodiment of a thermally insulated shipping system that may be used to transport a pallet-sized payload, the thermally insulated shipping system being constructed according to the teachings of the present invention.

Referring now to FIG. 29, there is shown a partly exploded perspective view of a seventh embodiment of a thermally insulated shipping system that may be used to transport a pallet-sized payload, the thermally insulated shipping system being represented generally by reference numeral 1011.

System 1011 may be similar in most respects to system 911, the principal difference between the two systems being that, whereas system 911 may comprise outer cassettes 929-1 through 929-4, system 1011 may instead comprise insulation panels 1013-1 through 1013-4 removably mounted in the outer slots of front wall 915, rear wall 917, left wall 921 and right wall 923, respectively. Insulation panels 1013-1 through 1013-4 may be identical to one another and may comprise a cut sheet of expanded polystyrene having dimensions of 48"×40"×1.75".

System 1011 may be assembled and used in a fashion generally similar to that described above for system 911.

Figure 30:
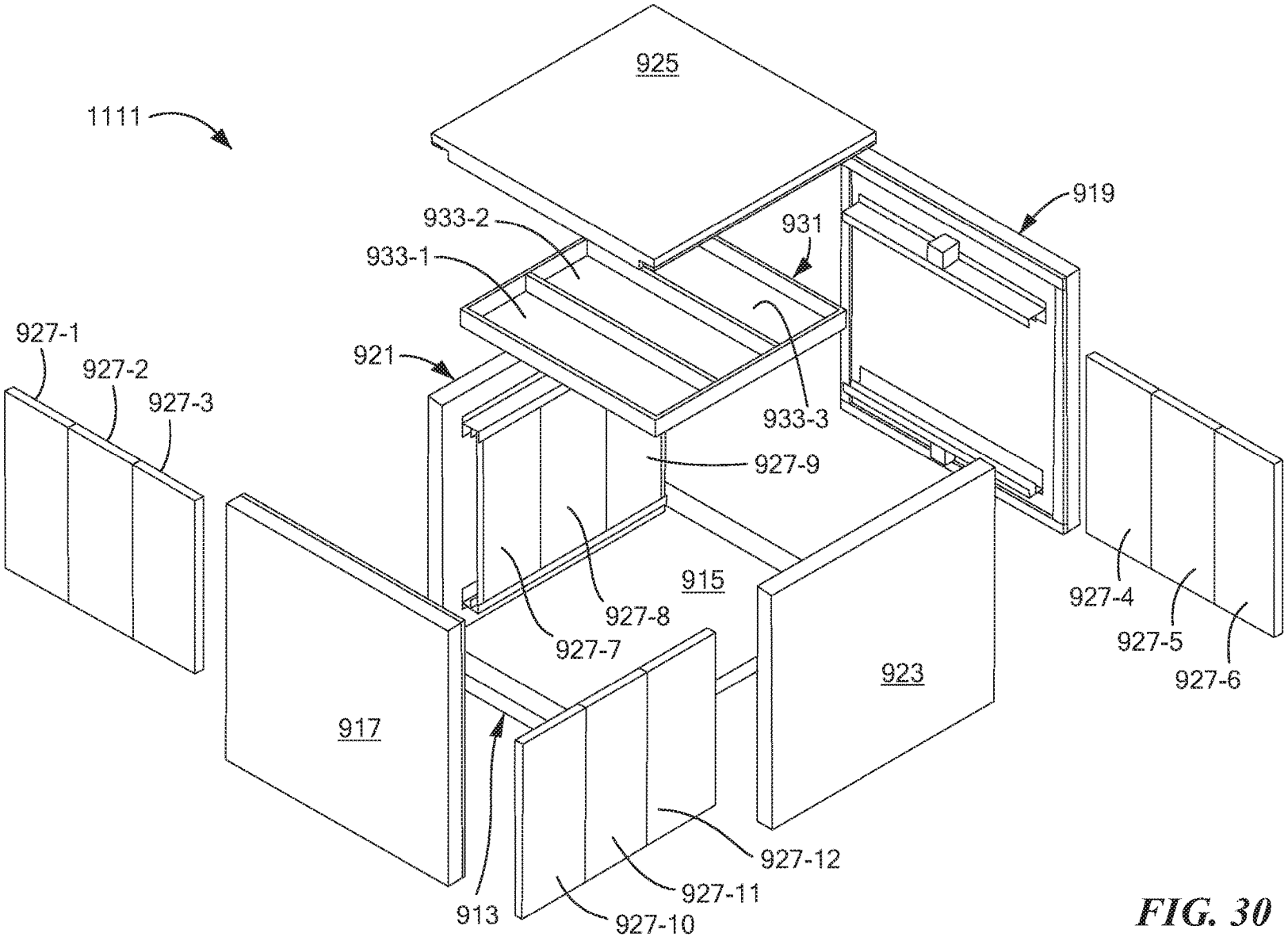
FIG. 30 is a partly exploded perspective view of an eighth embodiment of a thermally insulated shipping system that may be used to transport a pallet-sized payload, the thermally insulated shipping system being constructed according to the teachings of the present invention.

Referring now to FIG. 30, there is shown a partly exploded perspective view of an eighth embodiment of a thermally insulated shipping system that may be used to transport a pallet-sized payload, the thermally insulated shipping system being represented generally by reference numeral 1111.

System 1111 may be similar in most respects to system 911, the principal difference between the two systems being that, whereas system 911 may comprise outer cassettes 929-1 through 929-4, system 1111 may omit outer cassettes 929-1 through 929-4 and may leave empty the outer slots of front wall 915, rear wall 917, left wall 921 and right wall 923.

System 1111 may be assembled and used in a fashion generally similar to that described above for system 911.

The embodiments of the present invention described above are intended to be merely exemplary and those skilled in the art shall be able to make numerous variations and modifications to it without departing from the spirit of the present invention. All such variations and modifications are intended to be within the scope of the present invention.

What is claimed is:

1. A shipping system for use in transporting a pallet-sized payload, the shipping system comprising:

(a) a plurality of walls, the plurality of walls being arranged to define an interior volume suitable for receiving a pallet-sized payload, wherein at least one of the walls comprises at least two slots facing towards the interior volume, one of the slots being an inner slot that is more proximal to the interior volume and one of the slots being an outer slot that is more distal to the interior volume; and (b) a first cassette, the first cassette comprising a quantity of phase-change material and being removably mounted in one of the inner slot and the outer slot.

2. The shipping system as claimed in claim 1 wherein the plurality of walls comprises a top wall, a bottom wall, a front wall, a rear wall, a left wall and a right wall.

3. The shipping system as claimed in claim 2 wherein the interior volume has a generally rectangular prismatic shape.

4. The shipping system as claimed in claim 3 wherein the interior volume is dimensioned to receive a payload having dimensions of length×width×height selected from at least one of 48"×40"×45", 48"×42"×45", and 48"×42"×46".

5. The shipping system as claimed in claim 2 wherein each of the top wall, the bottom wall, the front wall, the rear wall, the left wall, and the right wall comprises thermal insulation.

6. The shipping system as claimed in 5 wherein the thermal insulation comprises a panel of rigid polyurethane foam.

7. The shipping system as claimed in claim 2 wherein each of the top wall, the front wall, the rear wall, the left wall and the right wall comprises a pair of brackets facing towards the interior volume, each of the brackets comprising an inner track and an outer track, the inner tracks of the pair of brackets jointly defining the inner slot, the outer tracks of the pair of brackets jointly defining the outer slot.

8. The shipping system as claimed in claim 1 wherein the first cassette is removably mounted in the inner slot, the shipping system further comprising a second cassette, the second cassette comprising a quantity of phase-change material and being removably mounted in the outer slot.

9. The shipping system as claimed in claim 1 wherein the plurality of walls comprises a top wall, a bottom wall, and a plurality of side walls and wherein at least one of the plurality of side walls comprises a pair of brackets facing towards the interior volume, each of the brackets comprising an inner track and an outer track, the inner tracks of the pair of brackets jointly defining the inner slot, the outer tracks of the pair of brackets jointly defining the outer slot.

10. The shipping system as claimed in claim 9 wherein each of the inner slot and the outer slot is oriented horizontally.

11. The shipping system as claimed in claim 10 wherein the first cassette comprises a first receptacle holding a plurality of sleeves, each of the plurality of sleeves comprising a first container holding a quantity of phase-change material.

12. The shipping system as claimed in claim 11 wherein the plurality of sleeves are different in composition from one another.

13. The shipping system as claimed in claim 8 wherein the first cassette and the second cassette are different in composition from one another.

14. The shipping system as claimed in claim 1 further comprising at least one corner bracket pivotally mounted on the exterior of one of said walls and constructed to support the weight of said wall when said wall is pivoted outwardly.

15. The shipping system as claimed in claim 7 wherein each of the top wall, the front wall, the rear wall, the left wall and the right wall has exactly one inner slot and exactly one outer slot and wherein the first cassette comprises a first receptacle holding a plurality of sleeves, each of the plurality of sleeves comprising a first container holding at least one quantity of phase-change material and at least one piece of insulation.

16. The shipping system as claimed in claim 7 wherein the first cassette comprises a plurality of sleeves, wherein each of the plurality of sleeves contains phase-change material, and wherein at least one of the plurality of sleeves contains a different type and/or quantity of phase-change material than at least another of the plurality of sleeves.

17. The shipping system as claimed in claim 16 wherein the first cassette has four corners and wherein the plurality of sleeves is constructed and arranged to provide greater thermal protection proximate to the four corners of the first cassette than elsewhere in the first cassette.

18. A shipping system for use in transporting a pallet-sized payload, the shipping system comprising:

(a) a plurality of thermally insulating walls, the plurality of thermally insulating walls being arranged to define an interior volume suitable for receiving a pallet-sized payload, the plurality of thermally insulating walls comprising a top wall, a bottom wall, a front wall, a rear wall, a left wall, and a right wall, wherein at least two of the top wall, the front wall, the rear wall, the left wall, and the right wall comprise at least two slots facing towards the interior volume, one of the slots being an inner slot that is more proximal to the interior volume and one of the slots being an outer slot that is more distal to the interior volume;

(b) a plurality of inner cassettes, the plurality of inner cassettes being disposed in at least some of the inner slots, each of the inner cassettes comprising at least a first phase-change material; and (c) a plurality of outer cassettes, the plurality of outer cassettes being disposed in at least some of the outer slots, each of the outer cassettes comprising at least a second phase-change material, the second phase-change material being different from the first phase-change material.

19. The shipping system as claimed in claim 18 wherein each of the top wall, the front wall, the rear wall, the left wall, and the right wall comprises the inner slot and the outer slot.

20. The shipping system as claimed in claim 19 wherein the plurality of inner cassettes comprises five inner cassettes and the plurality of outer cassettes comprises five outer cassettes, the five inner cassettes disposed in the inner slots of the top wall, the front wall, the rear wall, the left wall and the right wall, the five outer cassettes disposed in the outer slots of the top wall, the front wall, the rear wall, the left wall and the right wall.

21. The shipping system as claimed in claim 20 wherein each of the inner cassettes comprises a first receptacle holding two identical outer sleeves and three identical inner sleeves, each of the two identical outer sleeves comprising a first container holding a first insulation panel, a first temperature-control member aligned with the first insulation panel, and a plurality of second temperature-control members positioned at opposite ends of the first insulation panel, the first temperature-control member comprising a first gelled organic phase-change material having a phase-change temperature of approximately +3° C., the second temperature-control member comprising a second gelled organic phase-change material having a phase-change temperature of approximately +5° C., each of the three identical inner sleeves comprising a second container holding a second insulation panel and a third temperature-control member aligned with the second insulation panel, the third temperature-control member comprising a third gelled organic phase-change material having a phase-change temperature of approximately +3° C.

22. The shipping system as claimed in claim 21 wherein each of the outer cassettes comprises a second receptacle holding two identical outer sleeves and three identical inner sleeves, each of the two identical outer sleeves comprising a third container holding a plurality of fourth temperature-control members, each of the fourth temperature-control members comprising a foam brick impregnated with water or a water-based phase-change material and sealed within a pair of polymer films, each of the three identical inner sleeves comprising a fourth container holding a fifth temperature-control member, the fifth temperature-control member comprising a multi-compartmented container holding a plurality of foam bricks impregnated with water or a water-based phase-change material, the inner sleeves holding less phase-change material than the outer sleeves.

23. The shipping system as claimed in claim 22 wherein the inner cassettes are preconditioned at +5° C. and wherein the outer cassettes are preconditioned at −20° C.

24. The shipping system as claimed in claim 18 wherein the plurality of inner cassettes are removably disposed in at least some of the inner slots, wherein the plurality of outer cassettes are removably disposed in at least some of the outer slots, wherein one of the plurality of inner cassette comprises a plurality of sleeves, wherein each of the plurality of sleeves contains phase-change material, and wherein at least one of the plurality of sleeves contains a different type and/or quantity of phase-change material than at least another of the plurality of sleeves.

25. A shipping system for use in transporting a pallet-sized payload, the shipping system comprising:

(a) a plurality of thermally insulating walls, the plurality of thermally insulating walls being arranged to define an interior volume suitable for receiving a pallet-sized payload, the plurality of thermally insulating walls comprising a top wall, a bottom wall, a front wall, a rear wall, a left wall, and a right wall, wherein each of the front wall, the rear wall, the left wall, and the right wall comprises at least two slots facing towards the interior volume, one of the slots being an inner slot that is more proximal to the interior volume and one of the slots being an outer slot that is more distal to the interior volume;

(b) a first inner sleeve, the first inner sleeve disposed in the inner slot of the front wall and comprising a phase-change material;

(c) a second inner sleeve, the second inner sleeve disposed in the inner slot of the rear wall and comprising a phase-change material;

(d) a third inner sleeve, the third inner sleeve disposed in the inner slot of the left wall and comprising a phase-change material; and (e) a fourth inner sleeve, the fourth inner sleeve disposed in the inner slot of the right wall and comprising a phase-change material.

26. The shipping system as claimed in claim 25 further comprising a tray positioned over the payload in the interior volume, the tray holding a phase-change material.

27. The shipping system as claimed in claim 26 wherein the phase-change material in the first, second, third and fourth sleeves and in the tray is dry ice.

28. The shipping system as claimed in claim 27 further comprising eight additional inner sleeves, a first two of the eight additional sleeves disposed adjacent to the first inner sleeve in the inner slot of the front wall to form a first triplet of sleeves, a second two of the eight additional sleeves disposed adjacent to the second inner sleeve in the inner slot of the rear wall to form a second triplet of sleeves, a third two of the eight additional sleeves disposed adjacent to the third inner sleeve in the inner slot of the left wall to form a third triplet of sleeves, and a fourth two of the eight additional sleeves disposed adjacent to the fourth inner sleeve in the inner slot of right wall to form a fourth triplet of sleeves, wherein the outer sleeves of each triplet contain dry ice and the middle sleeve of each triplet is empty.

29. The shipping system as claimed in claim 28 wherein the outer slot of each of the front wall, the rear wall, the left side wall, and the right side wall is empty.

30. The shipping system as claimed in claim 28 further comprising a first insulation panel disposed in the outer slot of the front wall, a second insulation panel disposed in the outer slot of the rear wall, a third insulation panel disposed in the outer slot of the left wall, and a fourth insulation panel disposed in the outer slot of the right wall.

31. The shipping system as claimed in claim 25 wherein the first inner sleeve is removably disposed in the inner slot of the front wall, wherein the second inner sleeve is removably disposed in the inner slot of the rear wall, wherein the third inner sleeve is removably disposed in the inner slot of the left wall, wherein the fourth inner sleeve is removably disposed in the inner slot of the right wall, and wherein each of the first inner sleeve, the second inner sleeve, the third inner sleeve, and the fourth inner sleeve comprises a first container holding at least one quantity of phase-change material and at least one piece of insulation.

* * * * *